US012758017B2

(12) United States Patent
Mullet et al.

(10) Patent No.: US 12,758,017 B2
(45) Date of Patent: Oct. 13, 2026

(54) RECLINING CHAIR WITH CARTRIDGE

(71) Applicant: CURRENT PRODUCTS COMPANY, LLC, Pensacola, FL (US)

(72) Inventors: Willis Jay Mullet, Gulf Breeze, FL (US); Richard Scott Hand, Pensacola, FL (US); Gary Tew, Cantonment, FL (US); Jonathan Derrick Dry, Laurel, MS (US); Brian Nielsen, Milton, FL (US)

(73) Assignee: Current Products Company, LLC, Pensacola, FL (US)

( * ) Notice: Subject to any disclaimer, the term of this patent is extended or adjusted under 35 U.S.C. 154(b) by 284 days.

(21) Appl. No.: 18/407,522

(22) Filed: Jan. 9, 2024

(65) Prior Publication Data

US 2024/0225285 A1 Jul. 11, 2024

Related U.S. Application Data

(60) Provisional application No. 63/438,195, filed on Jan. 10, 2023.

(51) Int. Cl.

| | |
|---|---|
| ***A47C 1/02*** | (2006.01) |
| ***A47C 1/025*** | (2006.01) |
| ***A47C 5/04*** | (2006.01) |

(52) U.S. Cl.

CPC ..... *A47C 1/025* (2013.01); *A47C 5/04* (2013.01)

(58) Field of Classification Search

CPC ..... A47C 1/02; A47C 1/025; A47C 1/03205; A47C 1/03233; A47C 1/121; A47C 3/045; A47C 5/04; A47C 5/10; A47C 7/566

USPC ..... 297/354.1, 361.1, 362

See application file for complete search history.

(56) References Cited

U.S. PATENT DOCUMENTS

| | | | | |
|---|---|---|---|---|
| 206,379 A * | 7/1878 | Wilson | B60N 2/2252 297/282 |
| 349,907 A | 9/1886 | Shults | |
| 1,626,069 A * | 4/1927 | Beech | A47C 1/0342 297/75 |
| 2,143,098 A | 1/1939 | Aage | |
| 2,908,031 A | 10/1959 | Millett | |

(Continued)

FOREIGN PATENT DOCUMENTS

| | | | |
|---|---|---|---|
| DE | 202005015874 U1 * | 2/2006 | A47C 1/03205 |
| EP | 1327400 B1 | 4/2014 | |

(Continued)

OTHER PUBLICATIONS

Haute Juice-Set of 4 Chrome Tubular Cantilever Wire Vintage Arm Chairs Dining Chairs—Mar. 10, 2015.

*Primary Examiner* — Ryan D Kwiecinski

(74) *Attorney, Agent, or Firm* — Christopher A. Proskey; BrownWinick Law Firm

(57) ABSTRACT

In one or more arrangements, as examples, a reclining chair is presented having a frame, a seat operably connected to the frame, a backrest operably connected to the frame, and a cartridge operably connected to the frame. In one or more arrangements, as examples, the backrest includes an upper axle and the cartridge having a link. In one or more arrangements, as examples, the cartridge is configured to connect to the upper axle of the backrest and wherein the link is configured to facilitate movement of the backrest between an upright position and a reclined position.

38 Claims, 91 Drawing Sheets

(56) References Cited

U.S. PATENT DOCUMENTS

| | | | | | |
|---|---|---|---|---|---|
| 3,000,668 | A | | 9/1961 | Croy | |
| 3,072,436 | A | | 1/1963 | Rosco | |
| 3,096,536 | A | | 7/1963 | Rabelos | |
| 3,174,797 | A | | 3/1965 | Neufeld | |
| 3,216,049 | A | | 11/1965 | Nevison | |
| 3,284,131 | A | * | 11/1966 | Fletcher | A47C 1/0355 297/322 |
| 3,337,266 | A | | 8/1967 | Burns | |
| 3,567,280 | A | | 3/1971 | Bradshaw | |
| 3,699,609 | A | | 10/1972 | Spatz | |
| 4,092,041 | A | * | 5/1978 | Landry | A47C 1/035 297/DIG. 7 |
| 4,181,357 | A | * | 1/1980 | Swenson | B60N 2/2252 297/358 |
| 4,703,974 | A | | 11/1987 | Brauning | |
| 4,911,500 | A | | 3/1990 | Saiger | |
| 4,938,530 | A | | 7/1990 | Snyder | |
| 5,108,149 | A | | 4/1992 | Ambasz | |
| 5,335,966 | A | | 8/1994 | Vogtherr | |
| 5,366,231 | A | | 11/1994 | Hung | |
| 5,370,445 | A | | 12/1994 | Golynsky | |
| 5,407,249 | A | | 4/1995 | Bonutti | |
| 5,695,251 | A | * | 12/1997 | Scolari | A47C 7/40 297/410 |
| 5,971,475 | A | | 10/1999 | Lawson | |
| 6,264,007 | B1 | | 7/2001 | Norton | |
| 6,473,935 | B1 | | 11/2002 | Cherukuri | |
| 7,021,712 | B2 | | 4/2006 | Spendlove | |
| 7,096,533 | B2 | | 8/2006 | Griepentrog | |
| 7,641,284 | B2 | | 1/2010 | Jones | |
| 7,815,259 | B2 | | 10/2010 | Fookes | |
| D659,444 | S | | 5/2012 | James | |
| 8,256,845 | B2 | | 9/2012 | Wang | |
| 9,554,654 | B1 | * | 1/2017 | Jung | A47C 7/566 |
| 12,022,959 | B2 | | 7/2024 | Mullet | |
| 12,207,736 | B1 | * | 1/2025 | Chan | A47C 4/20 |
| 2008/0252124 | A1 | | 10/2008 | Chen | |
| 2009/0195040 | A1 | | 8/2009 | Birkbeck | |
| 2010/0237680 | A1 | | 9/2010 | Pedersen | |
| 2013/0001994 | A1 | | 1/2013 | Wu | |
| 2013/0119735 | A1 | * | 5/2013 | Thurow | A47C 1/024 297/354.1 |
| 2023/0103963 | A1 | * | 4/2023 | Mullet | A47C 7/4454 297/301.3 |
| 2024/0225285 | A1 | * | 7/2024 | Mullet | A47C 1/025 |
| 2024/0341477 | A1 | * | 10/2024 | Larsen | A47C 1/03294 |

FOREIGN PATENT DOCUMENTS

| | | | | | |
|---|---|---|---|---|---|
| GB | 2496516 | A | | 5/2013 | |
| GB | 2537799 | A | * | 11/2016 | A47C 1/0242 |
| KR | 20160000012 | A | * | 1/2016 | A47C 7/566 |
| WO | 1993004613 | A1 | | 3/1993 | |
| WO | WO-2008132481 | A2 | * | 11/2008 | A47C 1/0342 |
| WO | WO-2013160296 | A1 | * | 10/2013 | A47C 1/121 |

* cited by examiner

FIG. 12A
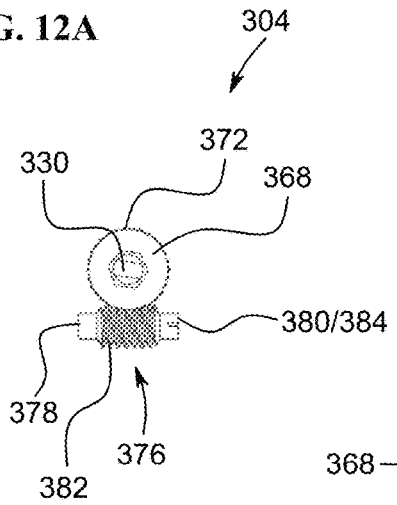
FIG. 12C
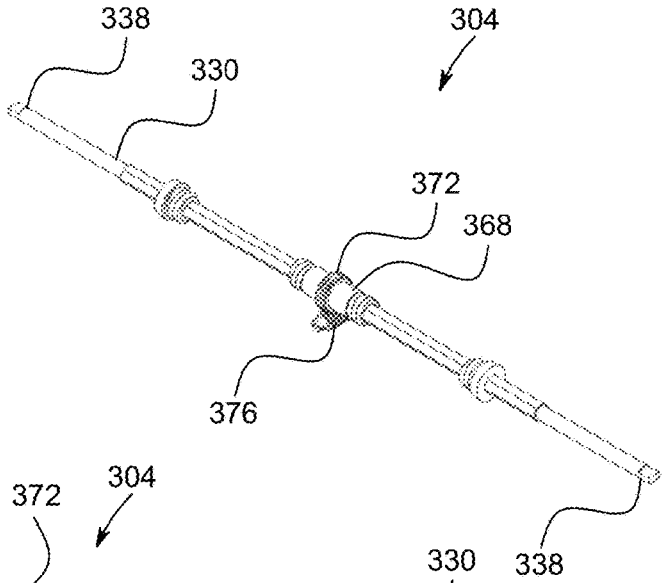
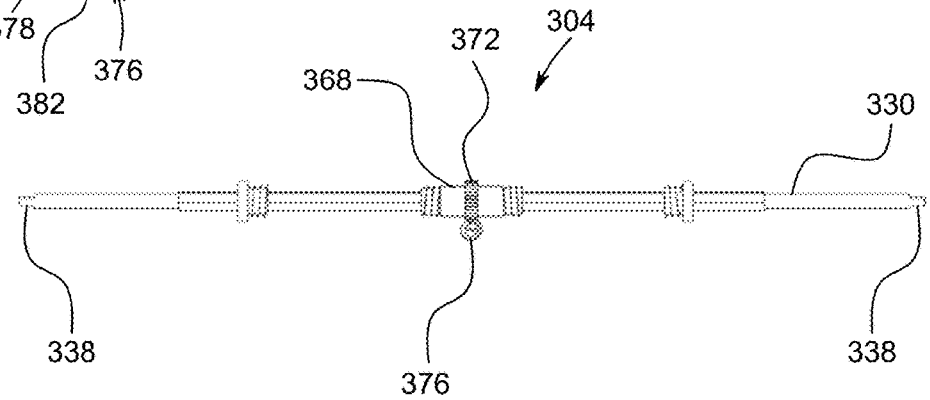
FIG. 12B

DETAIL A
SCALE 1 : 1

DETAIL B
SCALE 1 : 1

RECLINING CHAIR WITH CARTRIDGE

CROSS-REFERENCE TO RELATED APPLICATIONS

This application claims priority to U.S. Provisional Application No. 63/438,195 entitled RECLINING CHAIR WITH CARTRIDGE, and filed on Jan. 10, 2023, the entirety of which is hereby incorporated by reference herein, including any figures, tables, drawings, or other information. This application is related to U.S. patent application Ser. No. 17/955,866 and filed on Sep. 29, 2022 and titled SEATING SYSTEM, which claims priority to U.S. Provisional Application No. 63/251,360 titled SEATING SYSTEM and filed on Oct. 1, 2021, the entirety of each of which is hereby incorporated by reference herein, including any figures, tables, drawings, and other information.

FIELD OF THE DISCLOSURE

This disclosure relates generally to furniture. More specifically, and without limitation, this disclosure is directed to chairs.

OVERVIEW OF THE DISCLOSURE

Many chairs can be uncomfortable to use for extended periods of time due to the inability to properly support an occupant in both upright and reclined positions. Many chairs, such as office chairs, have backrests with reclining mechanisms to permit an occupant to sit with a backrest of the chair in a reclined position. However, such reclining mechanisms tend to be bulky external devices which are not aesthetically pleasing and, as such, may not be desirable for use in certain settings (e.g., in a dining room setting).

Therefore, for all the reasons stated above, and the reasons stated below, there is a need in the art for a seating system having a compact reclining mechanism concealed within the chair that is configured to support an occupant in upright and reclined positions.

It is an object of the disclosure to provide a seating system that improves upon the prior art.

Another object of the disclosure is to provide a seating system having a compact internal reclining mechanism configured to support an occupant in upright and reclined positions.

Yet another object of the disclosure is to provide a seating system that is strong, robust, and durable.

Another object of the disclosure is to provide a seating system that is comfortable.

Yet another object of the disclosure is to provide a seating system that is easy and intuitive to use.

Another object of the disclosure is to provide a seating system that is easy to manufacture.

Yet another object of the disclosure is to provide a seating system that is cost effective.

Another object of the disclosure is to provide a seating system that is high quality.

Yet another object of the disclosure is to provide a seating system that has a long useful life.

Another object of the disclosure is to provide a seating system that is that is aesthetically pleasing.

These and other objects, features, or advantages of the disclosure will become apparent from the specification, figures, and claims.

BRIEF DESCRIPTION OF THE DRAWINGS

FIG. 12A is a side elevation view of a counterbalance assembly of a reclining mechanism of a reclining chair in accordance with one or more arrangements; the view showing the counterbalance assembly having an upper axle, a tube of a tensioner assembly, with such tube having teeth, and a worm gear engaging the teeth of the tube of the upper axle.

FIG. 12B is a front elevation view of a counterbalance assembly of a reclining mechanism of a reclining chair in accordance with one or more arrangements; the view showing the counterbalance assembly having an upper axle, a tube of a tensioner assembly, with such tube having teeth, and a worm gear engaging the teeth of the tube of the upper axle.

FIG. 12C is a perspective view of a counterbalance assembly of a reclining mechanism of a reclining chair in accordance with one or more arrangements; the view showing the counterbalance assembly having an upper axle, a tube of a tensioner assembly, with such tube having teeth, and a worm gear engaging the teeth of the tube of the upper axle.

SUMMARY OF THE DISCLOSURE

Figure 1:
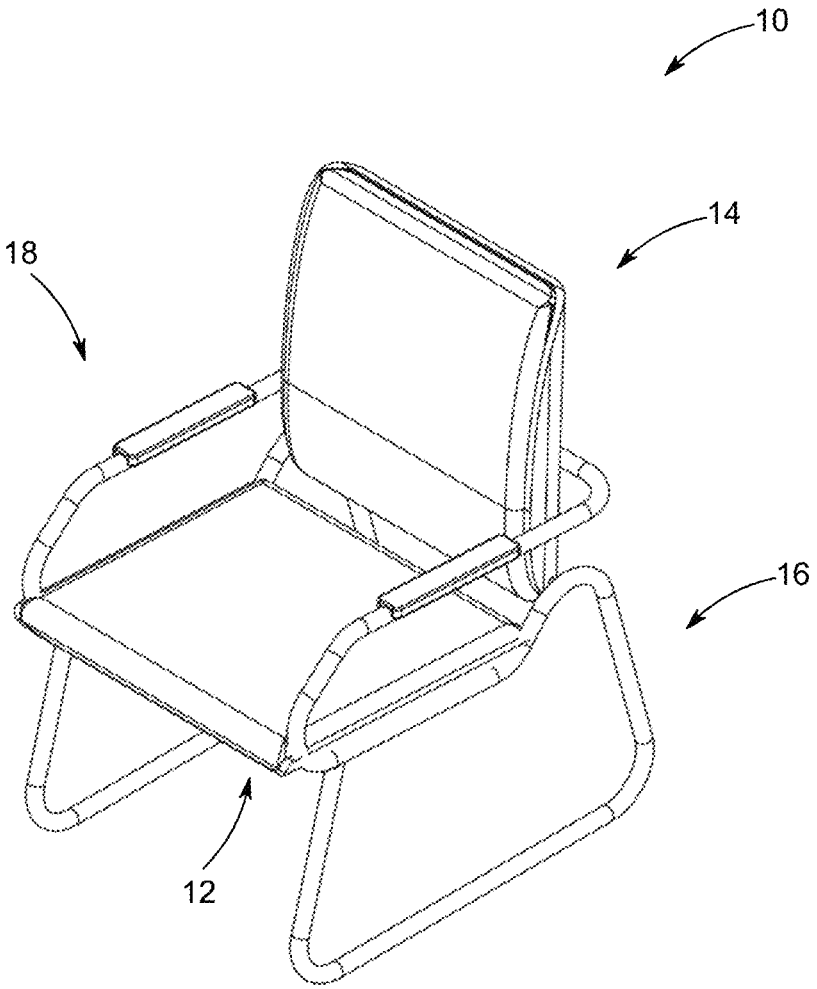
FIG. 1 is a front perspective view of a reclining chair in accordance with one or more arrangements; the view showing the reclining chair having a seat, a backrest, a frame, and arm covers.
Figure 2:
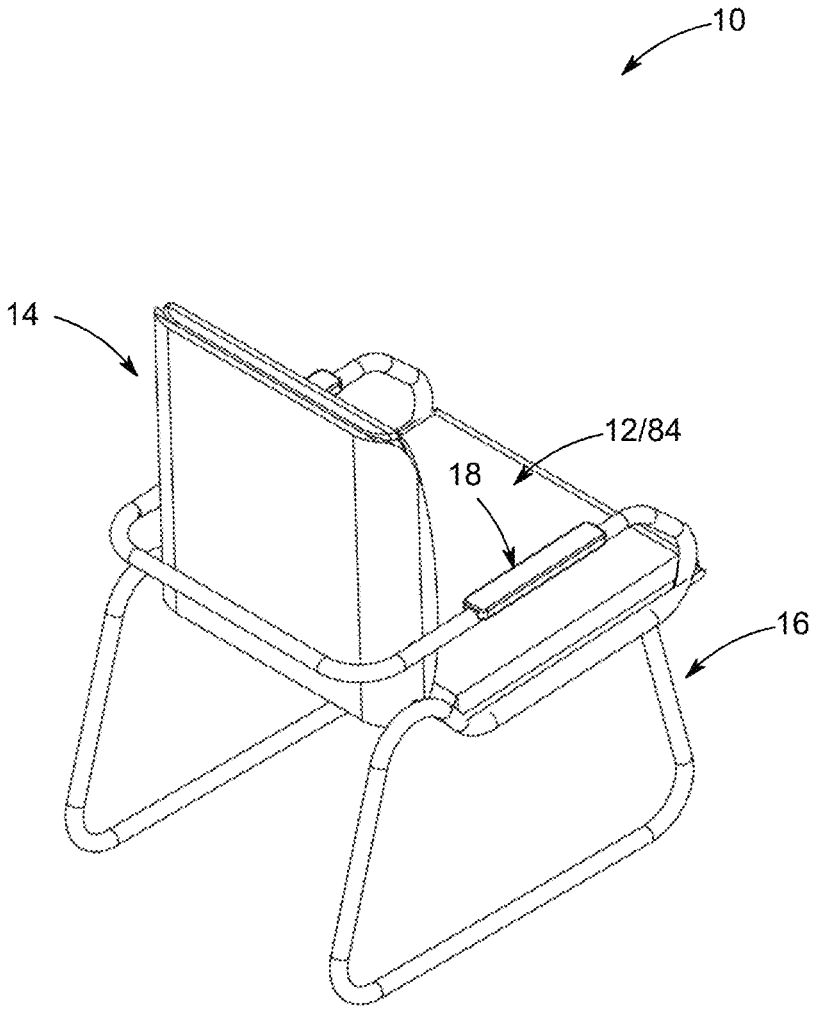
FIG. 2 is back perspective view of a reclining chair in accordance with one or more arrangements; the view showing the reclining chair having a seat, a backrest, a frame, and arm covers.
Figure 3:
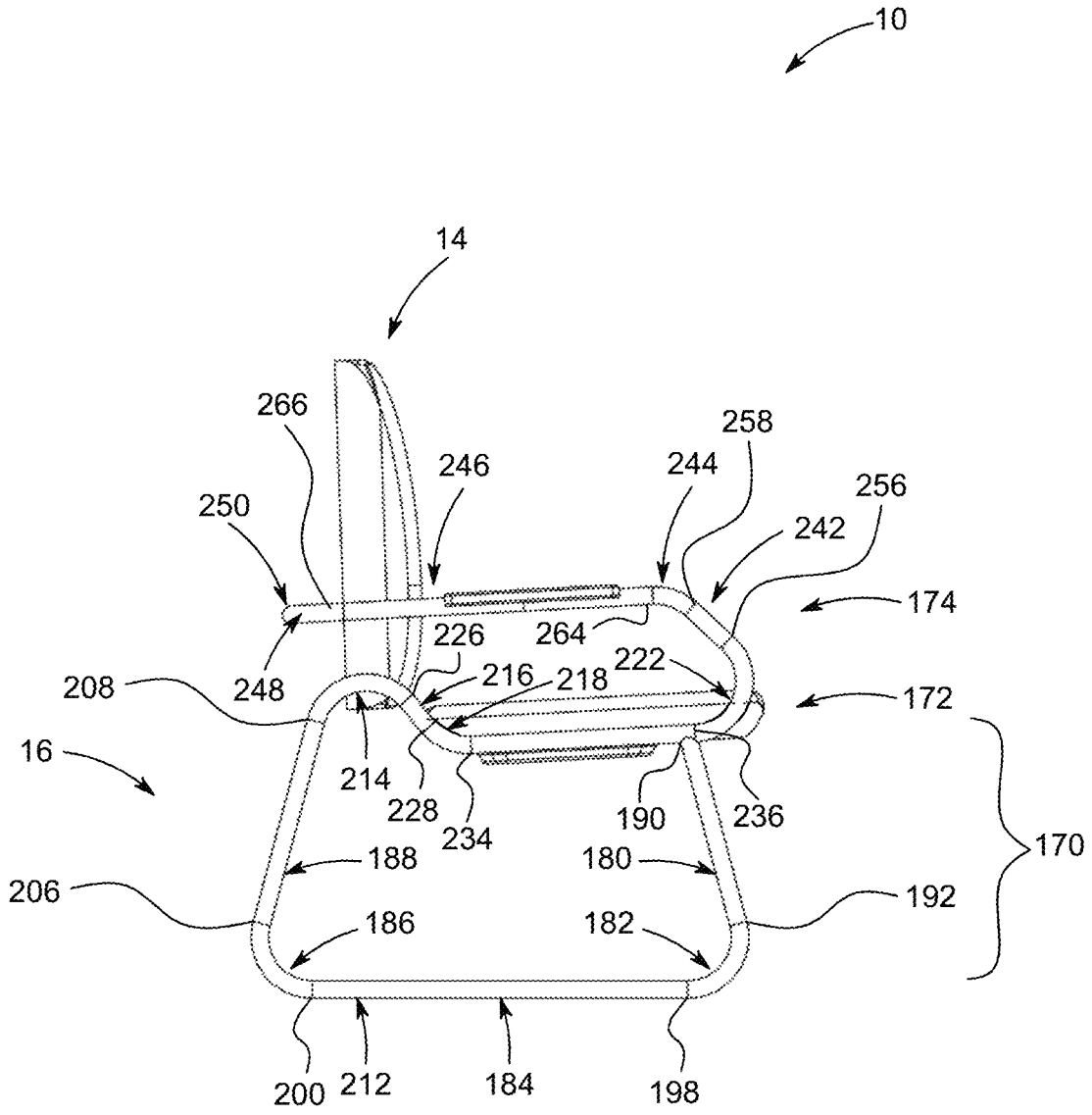
FIG. 3 is a side elevation view of a reclining chair in accordance with one or more arrangements; the view showing the reclining chair having a seat, a backrest, a frame, and arm covers. The view also showing the frame of the reclining chair having a base section, a seat support section, and an arm support section.
Figure 4:
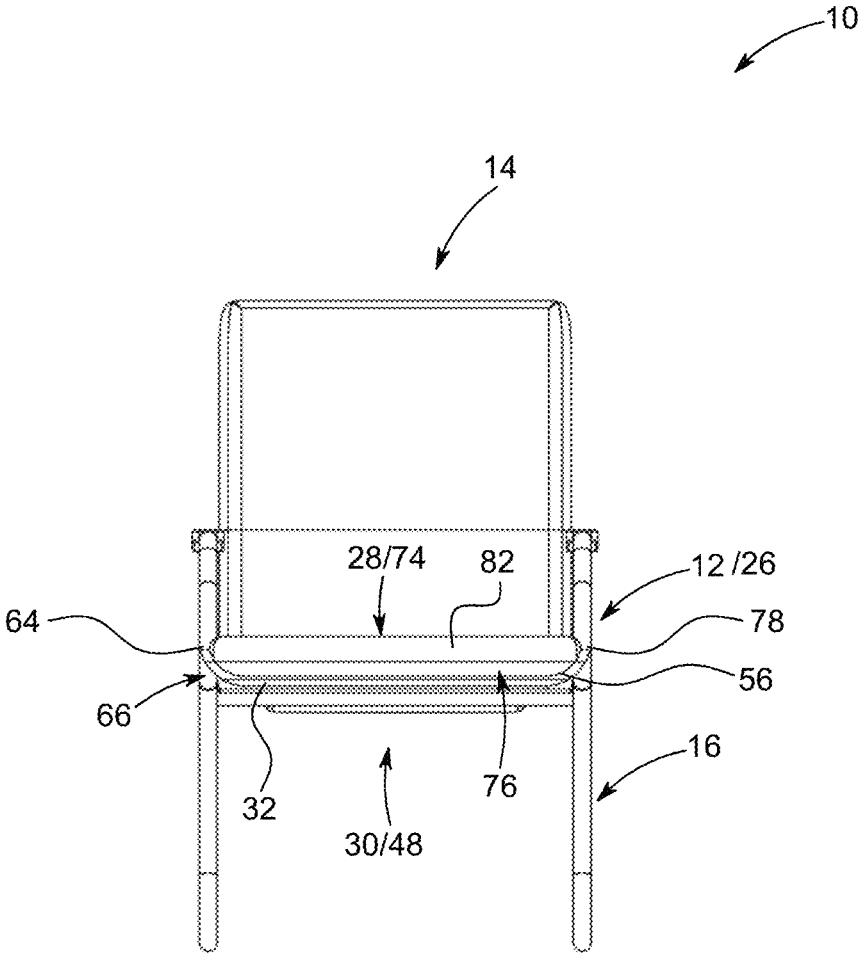
FIG. 4 is a front elevation view of a reclining chair in accordance with one or more arrangements; the view showing the reclining chair having a seat, a backrest, a frame, and arm covers. The view also showing the seat of the reclining chair having a lower support member and an upper seat member.
Figure 5:
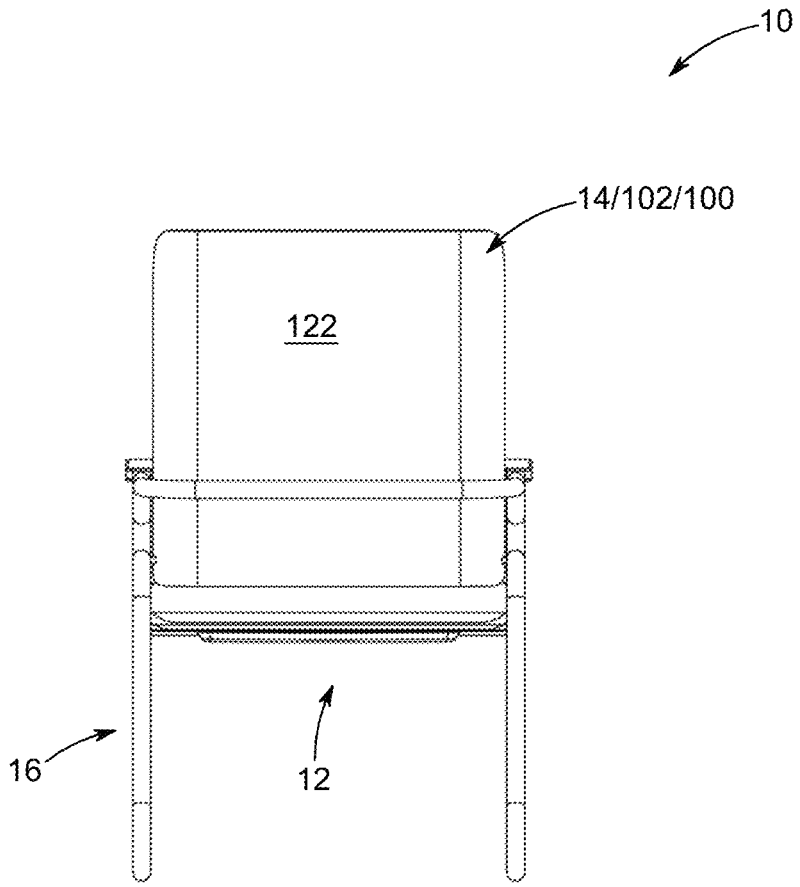
FIG. 5 is a rear elevation view of a reclining chair in accordance with one or more arrangements; the view showing the reclining chair having a seat, a backrest, a frame, and arm covers. The view also showing the backrest of the reclining chair having a backrest support assembly with a rear support member.
Figure 6:
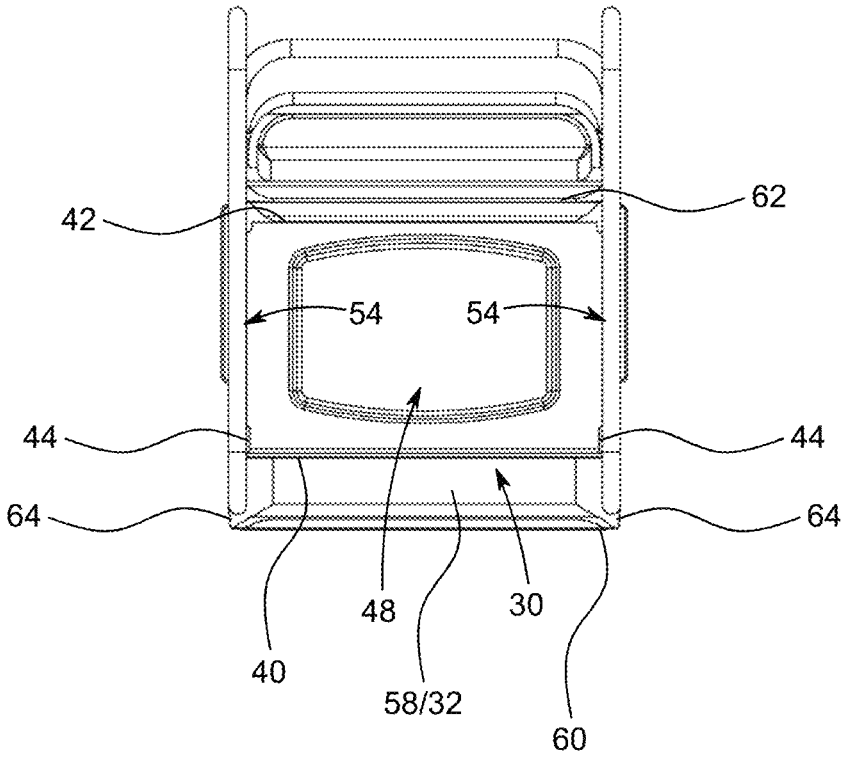
FIG. 6 is a bottom elevation view of a reclining chair in accordance with one or more arrangements; the view showing the reclining chair having a seat, a backrest, a frame, and arm covers. The view also showing the seat of the reclining chair having an upper seat member and a lower support member having a center indent.
Figure 7:
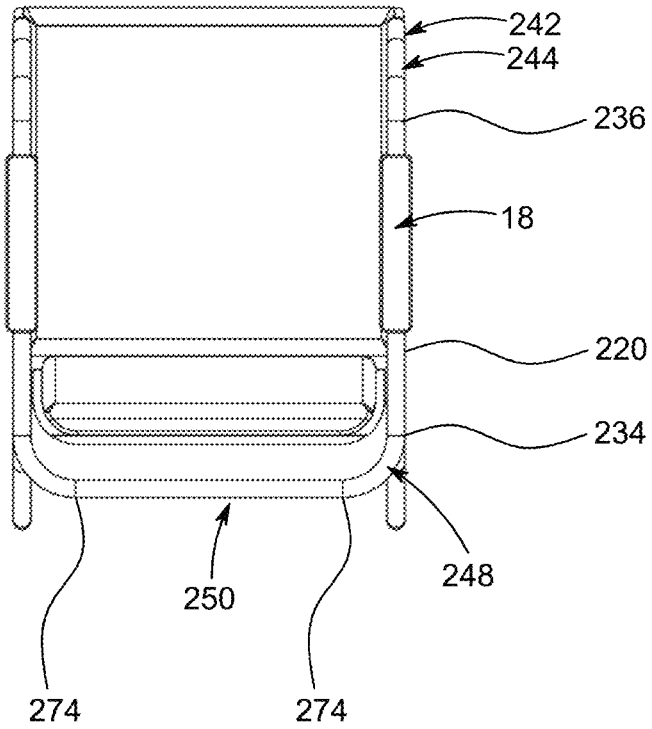
FIG. 7 is a top elevation view of a reclining chair in accordance with one or more arrangements; the view showing the reclining chair having a seat, a backrest, a frame, and arm covers. The view also showing the frame of the reclining chair having an arm support section and a seat support section.
Figures 8A, 8B:
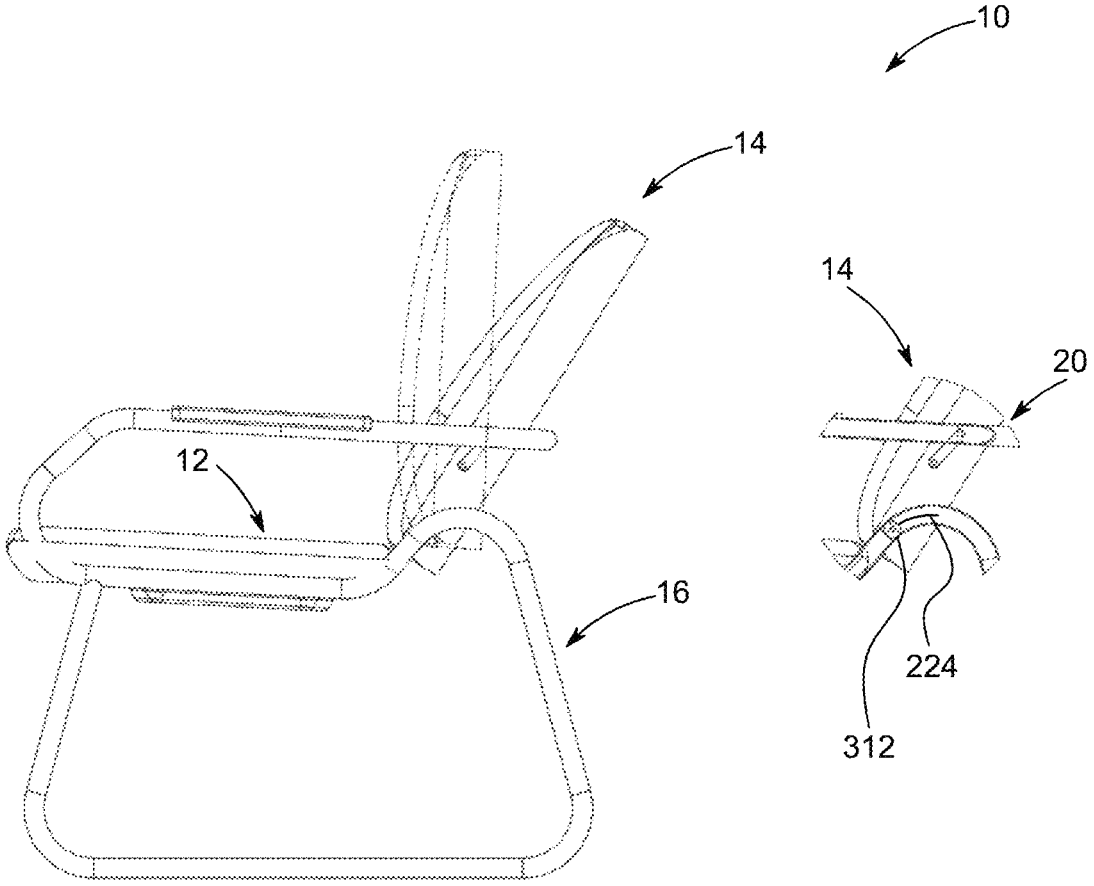
FIG. 8A is a side elevation view of a reclining chair in accordance with one or more arrangements; the view showing the reclining chair in a reclined position.
FIG. 8B is a section view of a portion of a reclining chair in accordance with one or more arrangements; the view showing the reclining chair in a reclined state with a slotted track and rollers on the frame of the reclining chair.
Figure 9:
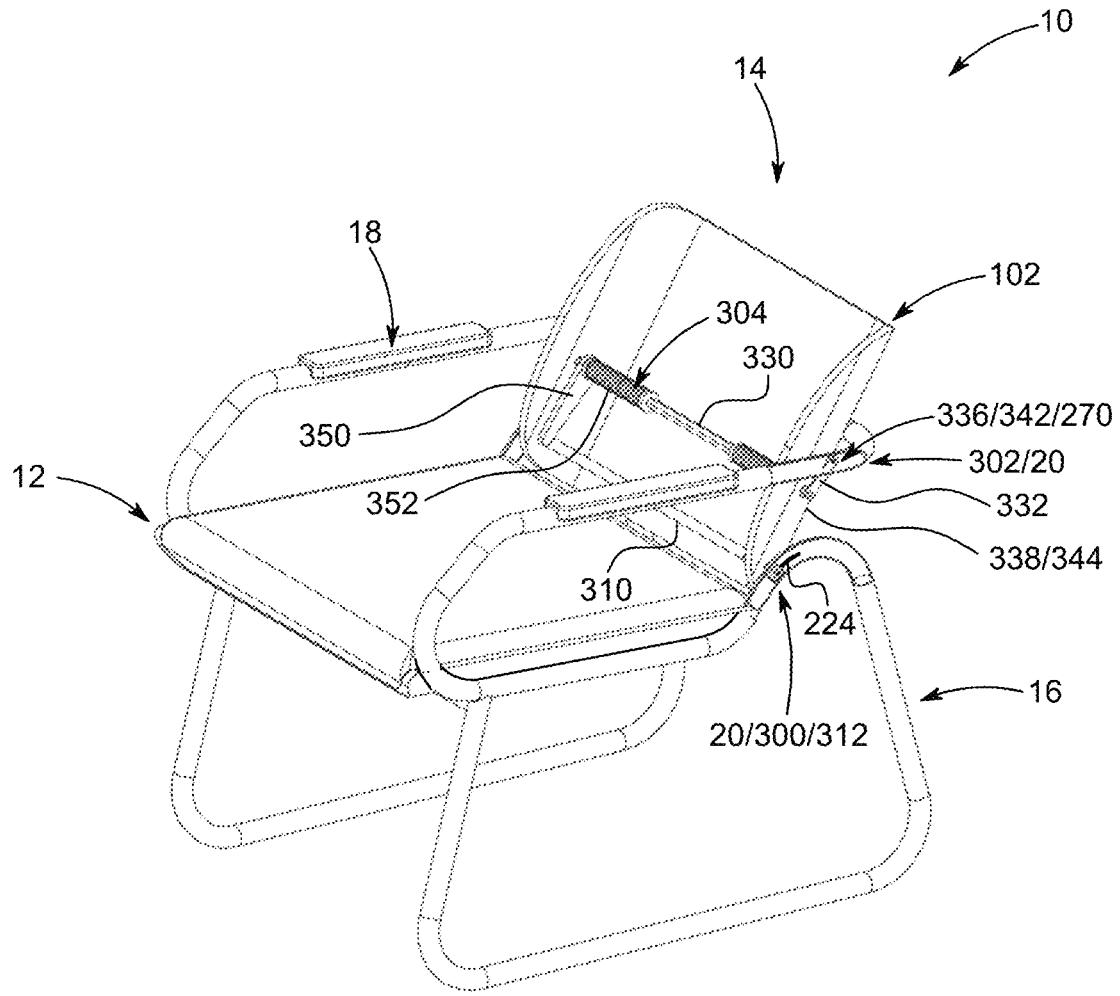
FIG. 9 is a perspective view of a reclining chair in accordance with one or more arrangements; the view showing the reclining chair having a seat, a backrest, a frame, and arm covers. The view showing a cut-away view of the backrest, with the backrest having a rear support member and a counterbalance assembly positioned in the backrest.
Figure 10:
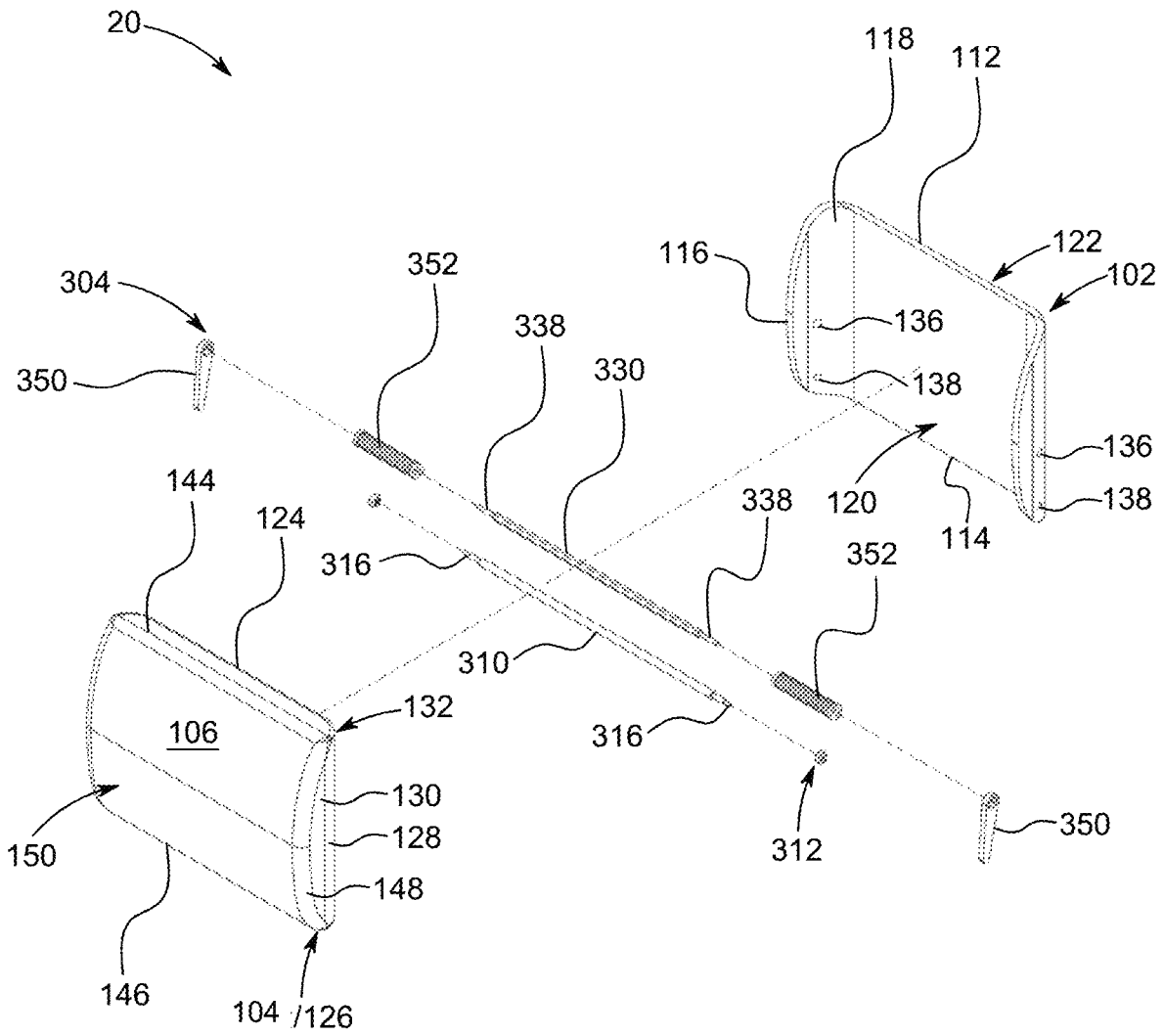
FIG. 10 is an exploded view of a reclining mechanism of a reclining chair in accordance with one or more arrangements; the view showing the backrest having a counterbalance assembly positioned between a rear support member and a front support member of the backrest.
Figure 11:
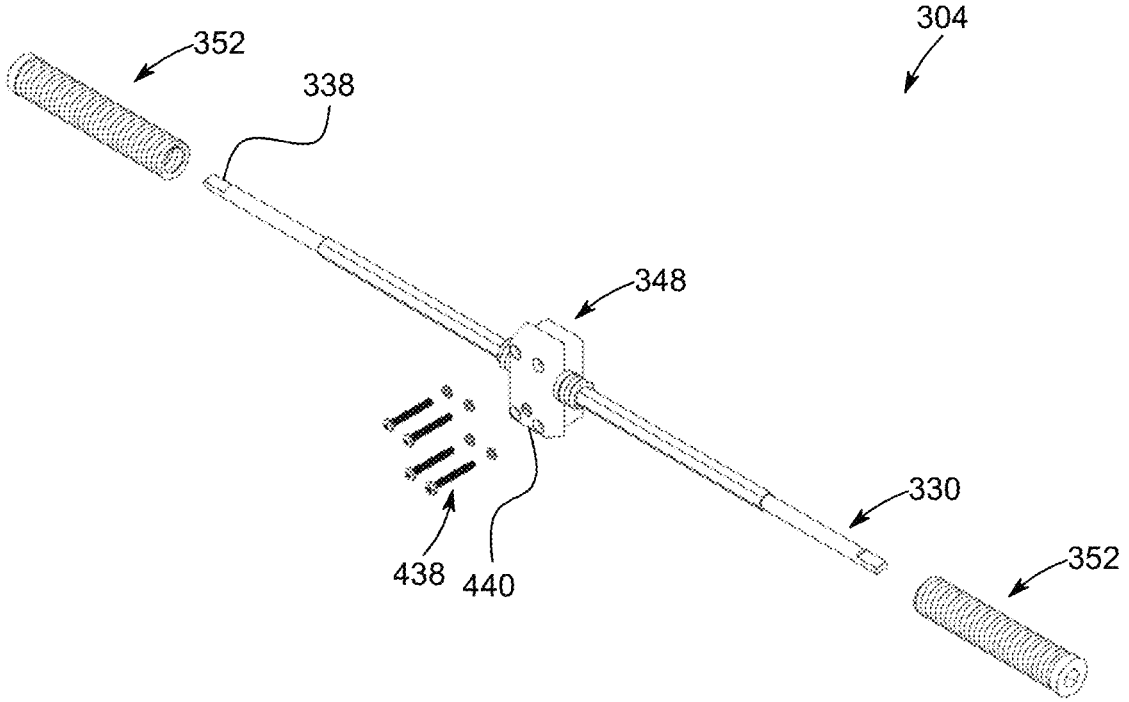
FIG. 11 is an exploded view of a counterbalance assembly of a reclining mechanism of a reclining chair in accordance with one or more arrangements; the view showing the counterbalance assembly having an upper axle, a tensioner assembly, and torsion springs assemblies.
Figure 13:
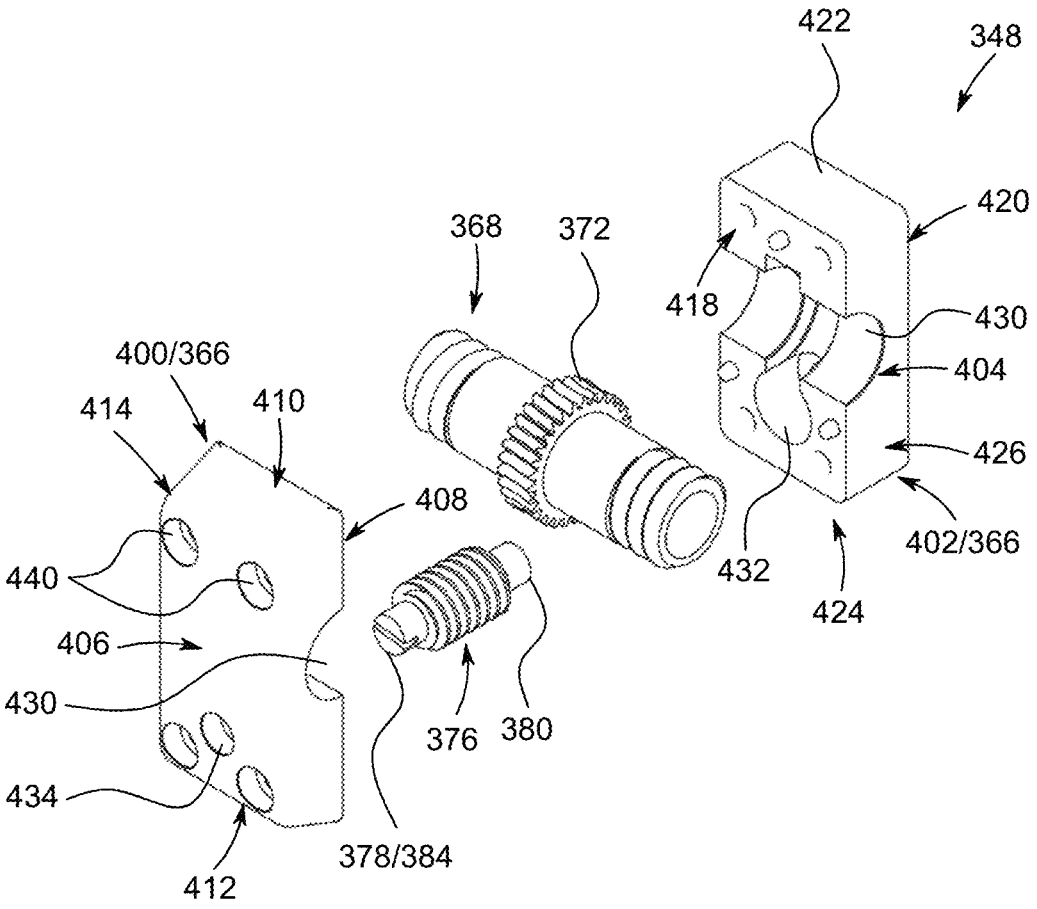
FIG. 13 is an exploded view of a tensioner assembly of a counterbalance assembly of a reclining chair in accordance with one or more arrangements; the view showing the tensioner assembly having housing with a front plate and a back plate, and a tube with teeth positioned between the front plate and back plate; the view also showing the tensioner assembly having a worm gear configured to engage with the teeth of the tube.

In one or more arrangements, as examples, a reclining chair is presented having a frame, a seat operably connected to the frame, a backrest operably connected to the frame, and a cartridge operably connected to the frame. In one or more arrangements, as examples, the backrest includes an upper axle and the cartridge having a link. In one or more arrangements, as examples, the cartridge is configured to connect to the upper axle of the backrest and wherein the link is configured to facilitate movement of the backrest between an upright position and a reclined position.

In one or more arrangements, as examples, the cartridge has a front plate with a slot and a backplate. In one or more arrangements, the link of the cartridge is operably connected to the front plate and the back plate, and a portion of the link is configured to extend through, and slide within, the slot of the front plate.

In one or more arrangements, the reclining chair includes a counterbalance assembly positioned within a hollow interior of the backrest, and the counterbalance assembly is configured to provide a counterbalance force to the backrest. In one or more arrangements, the counterbalance assembly includes the upper axle, and the upper axle operably connects the counterbalance assembly to the link of the cartridge.

In one or more arrangements, the cartridge includes a bumper configured to reduce sound and impact when the backrest is moved from a reclined position to an upright position.

In one or more arrangements, the frame includes a slot and the backrest includes a lower axle configured to move within the slot when the backrest is moved between an upright position and a reclined position. In one or more arrangements, a bumper of the cartridge is positioned in the slot and is configured to reduce sound and impact when the backrest is moved from the reclined position to an upright position.

DETAILED DESCRIPTION OF THE DISCLOSURE

In the following detailed description of the embodiments, reference is made to the accompanying drawings which form a part hereof, and in which is shown by way of illustration specific embodiments in which the disclosure may be practiced. The embodiments of the present disclosure described below are not intended to be exhaustive or to limit the disclosure to the precise forms in the following detailed description. Rather, the embodiments are chosen and described so that others skilled in the art may appreciate and understand the principles and practices of the present disclosure. It will be understood by those skilled in the art that various changes in form and details may be made without departing from the principles and scope of the invention. It is intended to cover various modifications and similar arrangements and procedures, and the scope of the appended claims therefore should be accorded the broadest interpretation so as to encompass all such modifications and similar arrangements and procedures. For instance, although aspects and features may be illustrated in or described with reference to certain figures or embodiments, it will be appreciated that features from one figure or embodiment may be combined with features of another figure or embodiment even though the combination is not explicitly shown or explicitly described as a combination. In the depicted embodiments, like reference numbers refer to like elements throughout the various drawings.

It should be understood that any advantages and/or improvements discussed herein may not be provided by various disclosed embodiments, or implementations thereof. The contemplated embodiments are not so limited and should not be interpreted as being restricted to embodiments which provide such advantages or improvements. Similarly, it should be understood that various embodiments may not address all or any objects of the disclosure or objects of the invention that may be described herein. The contemplated embodiments are not so limited and should not be interpreted as being restricted to embodiments which address such objects of the disclosure or invention. Furthermore, although some disclosed embodiments may be described relative to specific materials, embodiments are not limited to the specific materials or apparatuses but only to their specific characteristics and capabilities and other materials and apparatuses can be substituted as is well understood by those skilled in the art in view of the present disclosure.

It is to be understood that the terms such as "left, right, top, bottom, front, backrest, side, height, length, width, upper, lower, interior, exterior, inner, outer, and the like as may be used herein, merely describe points of reference and do not limit the present invention to any particular orientation or configuration.

As used herein, "and/or" includes all combinations of one or more of the associated listed items, such that "A and/or B" includes "A but not B," "B but not A," and "A as well as B," unless it is clearly indicated that only a single item, subgroup of items, or all items are present. The use of "etc." is defined as "et cetera" and indicates the inclusion of all other elements belonging to the same group of the preceding items, in any "and/or" combination(s).

As used herein, the singular forms "a," "an," and "the" are intended to include both the singular and plural forms, unless the language explicitly indicates otherwise. Indefinite articles like "a" and "an" introduce or refer to any modified term, both previously-introduced and not, while definite articles like "the" refer to a same previously-introduced term; as such, it is understood that "a" or "an" modify items that are permitted to be previously-introduced or new, while definite articles modify an item that is the same as immediately previously presented. It will be further understood that the terms "comprises," "comprising," "includes," and/or "including," when used herein, specify the presence of stated features, characteristics, steps, operations, elements, and/or components, but do not themselves preclude the presence or addition of one or more other features, characteristics, steps, operations, elements, components, and/or groups thereof, unless expressly indicated otherwise. For example, if an embodiment of a system is described as comprising an article, it is understood the system is not limited to a single instance of the article unless expressly indicated otherwise, even if elsewhere another embodiment of the system is described as comprising a plurality of articles.

It will be understood that when an element is referred to as being "connected," "coupled," "mated," "attached," "fixed," etc. to another element, it can be directly connected to the other element, and/or intervening elements may be present. In contrast, when an element is referred to as being "directly connected," "directly coupled," "directly engaged" etc. to another element, there are no intervening elements present. Other words used to describe the relationship between elements should be interpreted in a like fashion (e.g., "between" versus "directly between," "adjacent" versus "directly adjacent," "engaged" versus "directly engaged," etc.). Similarly, a term such as "operatively", such as when used as "operatively connected" or "operatively engaged" is to be interpreted as connected or engaged, respectively, in any manner that facilitates operation, which may include being directly connected, indirectly connected, electronically connected, wirelessly connected, or connected by any other manner, method or means that facilitates desired operation. Similarly, a term such as "communicatively connected" includes all variations of information exchange and routing between two electronic devices, including intermediary devices, networks, etc., connected wirelessly or not. Similarly, "connected" or other similar language particularly for electronic components is intended to mean connected by any means, either directly or indirectly, wired and/or wirelessly, such that electricity and/or information may be transmitted between the components.

It will be understood that, although the ordinal terms "first," "second," etc. may be used herein to describe various elements, these elements should not be limited to any order by these terms unless specifically stated as such. These terms are used only to distinguish one element from another; where there are "second" or higher ordinals, there merely must be a number of elements, without necessarily any difference or other relationship. For example, a first element could be termed a second element, and, similarly, a second element could be termed a first element, without departing from the scope of example embodiments or methods.

Similarly, the structures and operations discussed herein may occur out of the order described and/or noted in the figures. For example, two operations and/or figures shown in succession may in fact be executed concurrently or may sometimes be executed in the reverse order, depending upon the functionality/acts involved. Similarly, individual operations within example methods described below may be executed repetitively, individually, or sequentially, to provide looping or other series of operations aside from single operations described below. It should be presumed that any embodiment or method having features and functionality described below, in any workable combination, falls within the scope of example embodiments.

As used herein, various disclosed embodiments may be primarily described in the context of chairs. However, the embodiments are not so limited. It is appreciated that the embodiments may be adapted for use in other applications which may be improved by the disclosed structures, arrangements and/or methods. The system is merely shown and described as being used in the context of chairs for ease of description and as one of countless examples.

System 10

With reference to the figures, a seating system 10 (or simply system 10) is presented. The system 10 is formed of any suitable size, shape, and design and is configured to hold and support an occupant in a seated position as well as facilitate movement between an upright position and a reclined position. In the arrangement shown, as one example, system 10 includes the following component pieces: a seat 12, a backrest 14, a frame 16, arm covers 18, and a reclining mechanism 20, among other components.

Seat 12

Seat 12 is formed of any suitable size, shape, and design and is configured to provide a surface for seating of an occupant thereupon. In the arrangement shown, as one example, seat 12 includes a seat assembly 26 and a cushion 28 among other components. In this example arrangement, seat assembly 26 is configured to operably connect with frame 16 and support cushion 28 on a top surface of seat assembly 26.

Seat Assembly 26

Seat assembly 26 is formed of any suitable size, shape, and design and is configured to provide a surface for seating of an occupant thereupon. In the arrangement shown, as one example, seat assembly 26 includes a lower support member 30 and an upper seat member 32.

Lower support member 30 is formed of any suitable size, shape, and design and is configured to operably connect with frame 16 and support upper seat member 32. In the arrangement shown, as one example, lower support member 30 has a generally rectangular planar shaped top 56 and bottom 58 extending between a front edge 40, a back edge 42, and opposing side edges 44. In this example arrangement, lower support member 30 has an outer perimeter positioned in an upper plane and a center indent 48, in which lower support member 30 extends downward to a lower plane. Center indent 48 forms a recess in an upper surface of lower support member 30 to accommodate flexing of webbing 70 (not shown) of upper seat member 32. Center indent 48 also provide structural rigidity to seat assembly 26.

In this example arrangement, lower support member 30 includes flanges extending outward from opposing side edges 44 to form connection members 54. In one or more arrangements, connection members 54 are configured engage frame 16 in a manner to hold seat 12 in place on the frame 16. Additionally or alternatively, in one or more arrangements, connection members 54 and frame 16 may include holes (not shown) to facilitate connection of connection members 54 of seat 12 to frame 16, for example using bolts. However, embodiments are not so limited. Rather, it is contemplated that in various arrangements, connection members 54 may be attached to frame 16 using various methods or means including but not limited to, for example, screws, bolts, clamps, pins, rivets, welding, snap connectors, friction fit connectors, adhesives, chemical bonding, and/or any other process or means that results in a permanent of semi-permanent connection.

Upper seat member 32 is formed of any suitable size, shape, and design and is configured to operably connect with lower support member 30 and cushion 28 and provide a surface to support cushion 28. In the arrangement shown, as one example, upper seat member 32 has a generally rectangular planar shape extending between a front edge 60, a back edge 62, and opposing side edges 64. In this example arrangement, upper seat member 32 has contoured side portions 66 that curve upward proximate to opposing side edges 64. However, the embodiments are not so limited. Rather, it is contemplated that in various arrangements, various portions of upper seat member 32 may be contoured for comfort and/or aesthetic appearance.

In one or more arrangements, upper seat member 32 is connected to lower support member 30 by fasteners (not shown) through holes (not shown) in lower support member 30. However, the embodiments are not so limited. Rather, it is contemplated that in various arrangements, upper seat member 32 may be attached to lower support member 30 using various methods or means including but not limited to, for example, screws, bolts, clamps, pins, rivets, welding, snap connectors, friction fit connectors, adhesives, chemical bonding, and/or any other process or means that results in a permanent of semi-permanent connection.

In one or more arrangements, upper seat member 32 has a rectangular opening 68 (not shown) in a center portion of upper seat member 32 and webbing 70 (not shown) extending across opening 68. Webbing 70 provides a strong seating base while offering some give to provide a more comfortable seating surface.

Cushion 28

Cushion 28 is formed of any formed of any suitable size, shape, and design and is configured to comfortably support a person sitting thereon. In the arrangement shown, as one example, cushion 28 has a generally cuboid shape having a top 74, a bottom 76, and sides 78. In this example arrangement, cushion 28 includes a foam core 82 covered by upholstery material 84 on at least one side.

Foam Core 82

Foam core 82 is formed of any suitable size, shape, and design and is configured to provide comforting support when seated upon. In one or more arrangements, foam core 82 is also configured to prevent water from becoming trapped within the foam core 82. For instance, in some various arrangements, foam core 82 may be comprised of one or more foams (e.g., reticulated foam, polyurethane foam, open cell rubber and/or any other foam material), feathers, fibers, polyester, batting and/or any other fill material for cushions.

Upholstery Material 84

Upholstery material 84 is formed of any formed of any suitable size, shape, and design and is configured to provide a comfortable seating surface and aesthetically pleasing appearance. In some various arrangements, upholstery material 84 may include but is not limited to, for example, natural materials such as cotton, silk, wool, linen, and/or leather, or synthetic material such as polyester, polypropylene, nylon, acrylic, rayon, vinyl, and/or synthetic leathers, and/or any other upholstery material.

In one or more arrangements, bottom 76 of cushion 28 is attached to a top 56 of upper seat member 32 of seat assembly 26. It is contemplated that in various arrangements, cushion 28 may be attached to upper seat member 32 using various methods or means including but not limited to, for example, screws, bolts, clamps, pins, rivets, welding, snap connectors, friction fit connectors, stitching, hook and loop connectors, adhesives, chemical bonding, and/or any other process or means that results in a permanent of semi-permanent connection.

Backrest 14

The backrest 14 is formed of any suitable size, shape, and design and is configured to provide a surface to provide backrest support for an occupant seated on seat 12. In the arrangement shown, as one example, backrest 14 includes a backrest support assembly 100 and a cushion 106 among other components.

Backrest Support Assembly 100

Backrest support assembly 100 is formed of any suitable size, shape, and design and is configured to provide a backrest rest surface for an occupant seated on seat 12. In the arrangement shown, as one example, backrest support assembly 100 includes a rear support member 102 and a front support member 104 that form a hollow interior 108 when joined together. However, the arrangements are not so limited. Rather, it is contemplated that in one or more arrangements, backrest support assembly 100 may be of solid construction without hollow interior (e.g., in arrangements omitting reclining mechanism 20 or components thereof in hollow interior 108).

Rear Support Member 102 and Front Support Member 104

Rear support member 102 and front support member 104 are formed of any suitable size, shape, and design and are configured to form a hollow interior 108 and provide a forward surface suitable for operation as a backrest rest. In the arrangement shown, as one example, rear support member 102 has a generally rectangular planar shape having a front surface 120 and a rear surface 122 extending between an upper edge 112, a lower edge 114, and opposing side edges 116. In this example arrangement, rear support member 102 has contoured side portions 118 that curve forward proximate to side edges 116. In the arrangement shown, rear support member 102 includes an upper set of holes 136 and a lower set of holes 138 positioned in side portions 118 to facilitate connection with reclining mechanism 20.

In one or more arrangements, front support member 104 has a front surface 130 and rear surface 132 extending between an upper edge 124, lower edge 126, and opposing side edges 128. In this example arrangement, front support member 104 has a complementary shape to rear support member 102 so that upper edge 124, lower edge 126, and side edges 128 align with upper edge 112, a lower edge 114, and opposing side edges 116 of rear support member 102 when front support member 104 and rear support member 102 are connected together. In this example arrangement, rear surface 132 of front support member 104 includes a recess (not shown) to form hollow interior 108 when front support member 104 and rear support member 102 are connected together.

Cushion 106

In the arrangement shown, backrest 14 includes a cushion 106 connected to front surface 130 of front support member 104. Cushion 106 is formed of any formed of any suitable size, shape, and design and is configured to provide a comfortable backrest support surface for an occupant of system 10. In the arrangement shown, as one example, cushion 106 has a generally rectangular shape, when viewed from the front, having a top 144, a bottom 146, opposing sides 148, a front surface 150, and a backrest surface 152 (not shown). In this example arrangement, front surface 150 of cushion 106 has an outward curved shape when viewed from the side. In this example arrangement, cushion 106 includes a foam core 82 covered by upholstery material 84 on at least one side as discussed with reference to cushion 28. As described with reference to cushion 28, cushion 106 may be attached to front support member 104 using various methods or means including but not limited to, for example, screws, bolts, clamps, pins, rivets, welding, snap connectors, friction fit connectors, stitching, hook and loop connectors, adhesives, chemical bonding, and/or any other process or means that results in a permanent of semi-permanent connection.

In one or more arrangements, front support member 104 is connected to rear support member 102 by fasteners (not shown) through holes (not shown) in front support member 104 and/or rear support member 102. However, the embodiments are not so limited. Rather, it is contemplated that in various arrangements, front support member 104 may be attached to rear support member 102 using various methods or means including but not limited to, for example, screws, bolts, clamps, pins, rivets, welding, snap connectors, friction fit connectors, adhesives, chemical bonding, and/or any other process or means that results in a permanent of semi-permanent connection.

Additionally or alternatively, in one or more arrangements front support member 104 and cushion 106 of backrest 14 may be connected to rear support member 102 of backrest by one or more magnetic components 158 (e.g., magnetic and/or ferric materials). Use of magnetic components 158 to facilitate connection between front support member 104 and rear support member 102 may be useful, for example, to facilitate easy removal of front support member 104 and cushion 106 for adjustment or maintenance of system 10. For example, in the arrangement shown, one or more components of reclining mechanism 20 (e.g., a counterbalance assembly 304) are positioned within hollow interior 108. For instance, in one or more arrangements, it may be desirable to facilitate easy removal of front support member 104 and cushion 106 for adjustment of the counterbalance assembly 304 to provide a desired amount of resistance force to backrest 14 when a user reclines. In one or more arrangements, front support member 104 and/or rear support member 102 have features (e.g., protrusions) configured to hold the magnetic components 158 connected to front support member 104 in close proximity to the magnetic components 158 connected to rear support member 102 when front support member 104 and rear support member 102 are connected together, thereby ensuring a strong magnetic bond.

Frame 16

Frame 16 is formed of any suitable size, shape, and design and is configured to operably connect with and support seat 12, backrest 14, and reclining mechanism 20 of system 10 to provide seating for an occupant of system 10. In the arrangement shown, as one example, frame 16 is a tubular chair frame having a base section 170, a seat support section 172, and an arm support section 174, among other components. In the example arrangement shown, frame 16 is formed of cylindrical shaped tube(s). However, the arrangements are not so limited. Rather, it is contemplated that frame 16 may be formed of materials of any type including but not limited to, for example, tubing, pipes, rods, wires, bars, structural stock, and/or any other type of material and may have various shapes including but not limited to, for example, round, triangular, square, pentagonal, hexagonal, heptagonal, octagonal, flat or rectangular, rebar, angled, tee, channel, I-beam, H-beam, wide flange, or any other shape.

Base Section 170

Base Section 170 of frame 16 is formed of any suitable size, shape, and design and is configured to provide stable support of system 10 on a floor. In the arrangement shown, as one example, base section 170 includes front legs 180, lower front corners 182, side bars 184, lower rear corners 186, and rear legs 188, among other components.

In this example arrangement, front legs 180 have a generally elongated tube shape extending from upper ends 190, connected to seat support section 172, to lower ends 192 connected to lower front corners 182. In this example arrangement, lower front corners 182 have a generally elongated tube shape extending from lower ends 192 and curving rearward before connecting to front ends 198 of side bars 184. In this example arrangement, side bars 184 each have an elongated tube shape extending from front end 198, where side bars 184 are connected to lower front corner 182, to a rear end 200, where side bars 184 are connected to lower rear corner 186. In one or more arrangements, side bars 184 may include one or more drain holes 212 positioned in a lower side of side bars 184 to facilitate draining of fluid that enters or condenses inside of frame 16. In this example arrangement, lower rear corners 186 have a generally elongated tube shape extending from rear ends 200 of side bars 184 and curving upward before connecting to lower ends 206 of rear legs 188. In this example arrangement, rear legs 188 have an elongated tube shape extending from lower ends 206, where rear legs 188 are connected to lower rear corners 186, to upper ends 208, where rear legs 188 connect with seat support section 172.

Seat Support Section 172

Seat support section 172 of frame 16 is formed of any suitable size, shape, and design and is configured to support and facilitate connection of frame 16 with seat 12, while operably connecting arm support section 174 to base section 170. In the arrangement shown, as one example, seat support section 172 includes upper rear corners 214, rear sloped sections 216, center corners 218, side bars 220, and upper front corners 222, among other components.

In this example arrangement, upper rear corners 214 have a generally elongated tube shape extending from upper ends 208 of rear legs 188 and curving upward and forward and then downward and forward before connecting to upper ends 226 of rear sloped sections 216. In this example arrangement, upper rear corners 214 include a slotted track 224 positioned on an inner side of upper rear corners 214. As discussed in more detail with reference to reclining mechanism 20, slotted track 224 is configured to facilitate guiding a lower end of backrest 14 along a designated path when being moved from an upright position to a reclined position.

In this example arrangement, rear sloped sections 216 have a generally elongated tube shape extending downward at an angle from upper ends 226, where rear sloped sections 216 connect to upper rear corners 214 to lower ends 228, where rear sloped sections 216 connect to center corners 218. In this example arrangement, center corners 218 have a generally elongated tube shape extending from lower ends 228 of rear sloped sections 216 and curving forward to rear ends 234 of side bars 220. In this example arrangement, side bars 220 each have an elongated tube shape extending from rear ends 234, where side bars 220 are connected to center corners 218, to a front end 236 of side bars 220, where side bars 220 are connected to upper front corners 222. In this example arrangement, upper front corners 222 have a generally elongated tube shape extending from front ends 236 of side bars 220 and curving upward and forward and then slightly rearward before connecting to lower ends 256 of front sloped section 242 of arm support section 174.

Arm Support Section 174

Arm support section 174 of frame 16 is formed of any suitable size, shape, and design and is configured to provide an arm rest for an occupant seated in seat 12 while operably connecting backrest 14 with frame 16. In the arrangement shown, arm support section 174 includes front sloped sections 242, front bends 244, a pair of arms 246, rear bends 248, and a rear crossbar 250 connected between rear bends 248.

In this example arrangement, front sloped sections 242 each have a contoured elongated shape extending rearward at an angle from a lower end 256, where front sloped sections 242 connect to upper front corners 222 of seat support section 172, to an upper end 258, where front sloped sections 242 connect to front bend 244. In this example arrangement, front bends 244 have a generally elongated tube shape extending from upper end 258 of front sloped sections and curving rearward before connecting to front end 264 of arms 246. In this example arrangement, arms 246 each have an elongated tube shape extending from front end 264 to rear ends 266, where arms 246 are connected to rear bends 248. In this example arrangement, arms 246 include holes 270 (not shown) located proximate to rear ends 266 and extending sideways through arms 246 to facilitate connection with reclining mechanism 20. In this example arrangement, rear bends 248 connect arms 246 to rear crossbar 250. In this example arrangement, rear bends 248 have a generally elongated tube shape extending from rear end 266 of arms 246 and curving inward before connecting to opposing ends 274 of rear crossbar 250. In this example arrangement, rear crossbar 250 has an elongated tube shape extending between the opposing ends 274 to operably connect right and left sides of the frame 16 together.

In one or more arrangements shown, components of frame 16 are illustrated as separate components and/or sections that are connected together. However, the embodiments are not so limited. Rather, it is contemplated that, in one or more arrangements, frame 16 may be formed as a unitary frame, for example, formed by bending a single tube.

Arm Covers 18

In the arrangement shown, system 10 include arm covers 18 positioned on top of arms 246. Arm covers 18 are formed of any suitable size, shape, and design and is configured to connect with arms 246 and provide comfortable arm rests for an occupant seated in seat 12 while providing an aesthetically pleasing appearance. In the arrangement shown, as one example, arm covers 18 each have a generally elongated rectangular shape having a top, a bottom, and opposing sides extending between a front end and a back end. In this example arrangement, arm covers 18 each have a recessed cylindrical channel 290 (not shown) formed in bottom and extending from front end to back end. In this example arrangement, recessed cylindrical channels 290 (not shown) are configured to fit over arms 246.

In one or more arrangements, arm covers 18 are connected to arms 246 by a set of fasteners 292 (not shown) such as bolts which extend through holes (not shown) in arms 246 and connect with arm covers 18. As another example, in one or more arrangements, fasteners 292 (not shown) may include connectors extending upward from arms 246 and are configured to be received and connect with receivers formed in bottom of arm covers 18. For instance, bottom may include keyhole shaped openings having wide portion and a narrow portion. Such openings may be configured to receive a head of connectors of arms 246 and lock with the connectors by sliding arm covers 18 so the head is positioned in the narrow portion, thereby connecting arm covers 18 to arms 246. In one or more arrangements, the keyhole shaped opening may have a J-shape or L-shape, for example, to prevent arm covers 18 from being disconnected from arms 246 via movement or arm covers 18 in a single direction.

However, embodiments are so limited. Rather, it is contemplated that in various arrangements, arm covers 18 may be connected to arms 246 of frame 16 using various methods or means including but not limited to, for example, screws, bolts, clamps, pins, rivets, welding, snap connectors, interconnects (e.g., slide connectors, rotational connectors, or any other type of interconnect), friction fit connectors, adhesives, chemical bonding, and/or any other process or means that results in a permanent of semi-permanent connection.

Materials

In the arrangement shown, upper seat member 32 of seat assembly 26 of seat 12 and rear support member 102 of backrest support assembly 100 of backrest 14 and arm covers 18 are formed of a wooden material, which provides an aesthetically pleasing appearance. However, the embodiments are not so limited. Rather, it is contemplated that in various arrangements, upper seat member 32, rear support member 102, arm covers 18 and/or various other components of system 10 may be formed of various natural or synthetic materials including but not limited to metals, woods, plastics, composites, laminins, of any other material.

Reclining Mechanism 20

In one or more arrangements, system 10 includes a reclining mechanism 20. Reclining mechanism 20 is formed of any suitable size, shape, and design and is configured to facilitate connection of backrest 14 with frame 16 and facilitate movement of backrest 14 between an upright position and a reclined position. Some example reclining mechanisms 20 are shown and discussed in more detail in related U.S. patent application Ser. No. 17/955,866 filed on Sep. 29, 2022 and titled SEATING SYSTEM, the entirety of which is incorporated by reference herein. However, the arrangements are not so limited. Rather, it is contemplated that in one or more arrangements, system 10 may include various other reclining mechanism 20 implementations or may have reclining mechanism 20 omitted. In one or more arrangements shown, as one example, reclining mechanism 20 is configured to recline backrest 14 by moving an upper edge 112/124 of backrest 14 downward and rearward while also moving lower edge 114/126 of backrest 14 downward and forward. In the arrangement shown, as one example, reclining mechanism 20 includes a lower guide assembly 300, an upper guide assembly 302, and a counterbalance assembly 304.

Lower Guide Assembly 300

Lower guide assembly 300 is formed of any suitable size, shape, and design and is configured to connect with and guide a lower portion of backrest 14 along slotted track 224 in frame 16 when backrest 14 is moved from an upright position to a reclined position.

In one or more arrangements shown, as one example, lower guide assembly 300 includes a lower axle 310 and a pair of rollers 312 among other components. In this example arrangement, lower axle 310 has an elongated cylindrical shape extending between opposing ends 316. In this example arrangement, lower axle 310 extends through lower set of holes 138 in side portions 118 of rear support member 102 of backrest 14. In this example arrangement, lower axle 310 extends outward from the sides of backrest 14 through slotted track 224 in frame 16 to connect with rollers 312 positioned within frame 16 at opposing ends 316 of lower axle 310.

Figure 14:
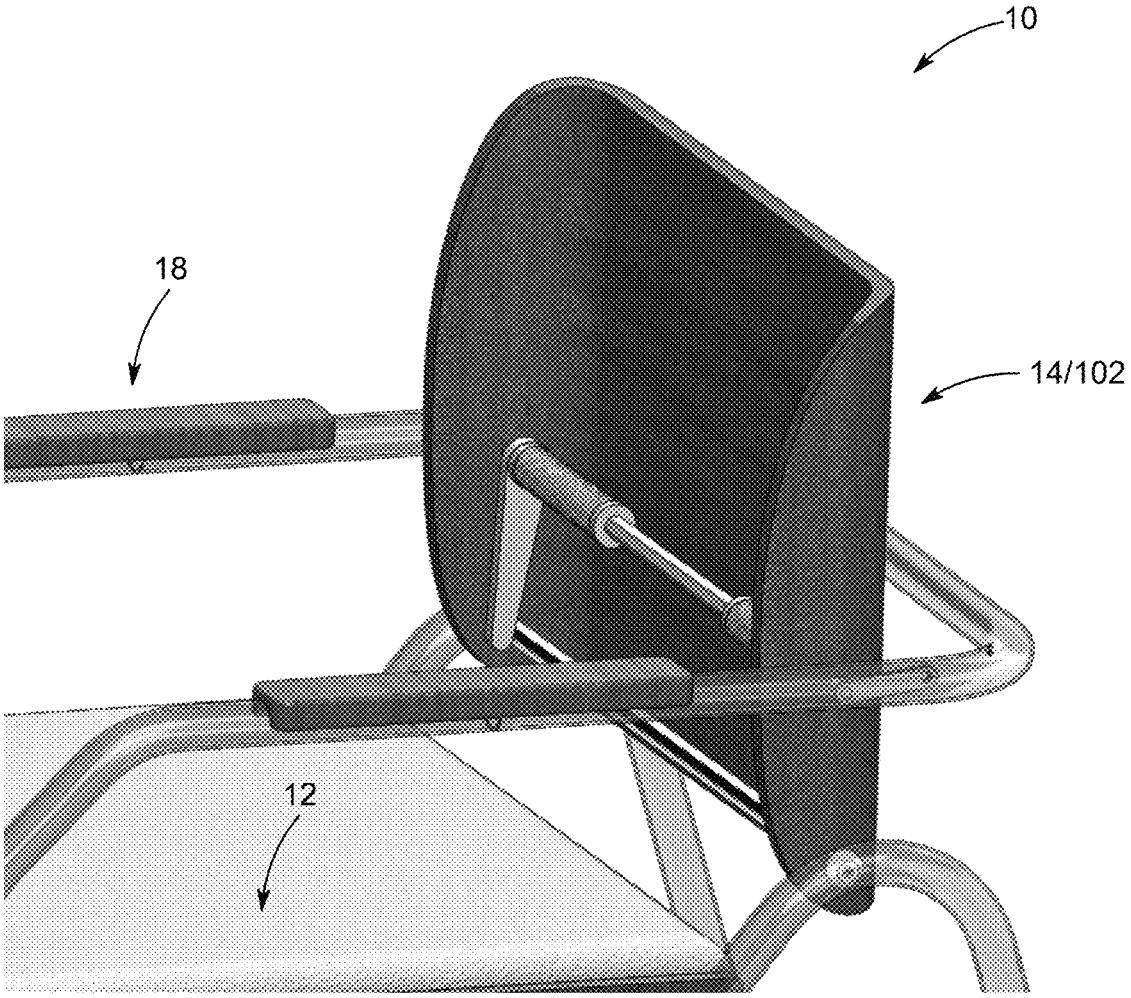
FIG. 14 is a perspective view of a reclining chair in accordance with one or more arrangements; the view showing the reclining chair having a backrest, a seat, and arm covers; the view also showing the backrest partially cutaway with a rear support member and a counterbalance assembly within the backrest.
Figure 15:
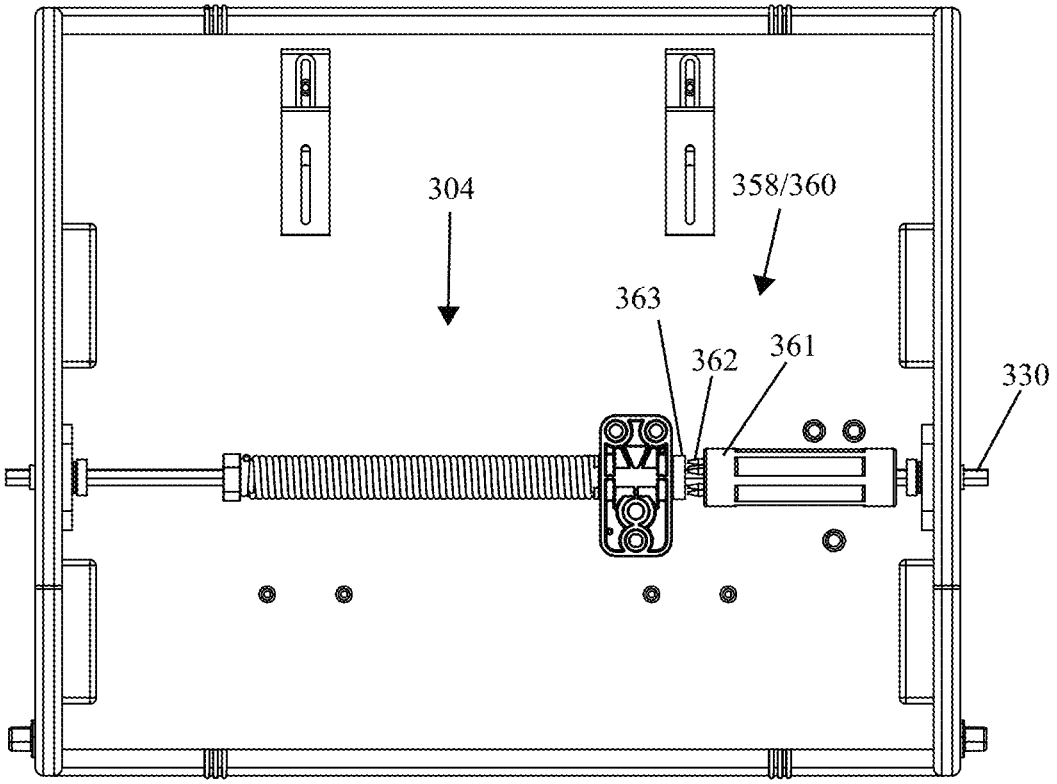
FIG. 15 is a front elevation view of a reclining mechanism of a reclining chair in accordance with one or more arrangements; the view showing the reclining mechanism having a counterbalance assembly and a locking mechanism having a movable body, teeth, and a stationary member positioned on the upper axle of the upper guide assembly of the reclining mechanism.
Figure 16:
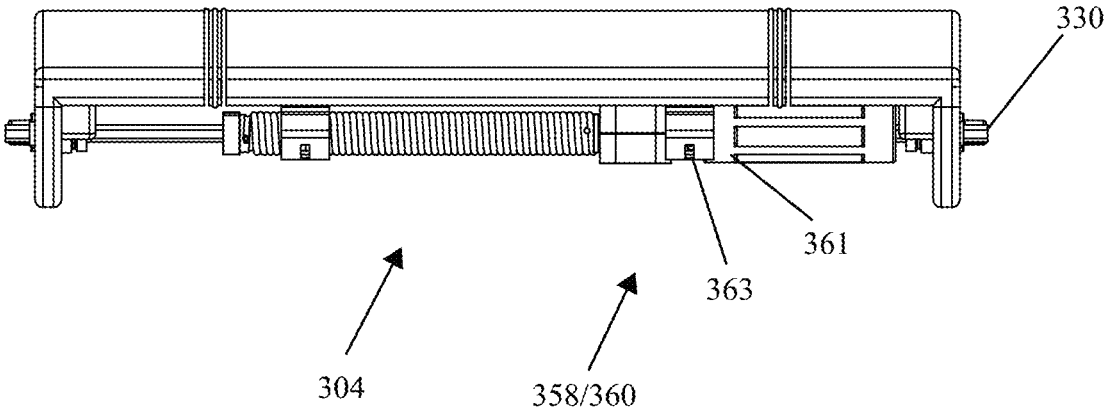
FIG. 16 is a top elevation view of a reclining mechanism of a reclining chair in accordance with one or more arrangements; the view showing the reclining mechanism having a counterbalance assembly and a locking mechanism having a movable body, teeth, and a stationary member positioned on the upper axle of the upper guide assembly of the reclining mechanism.
Figure 17:
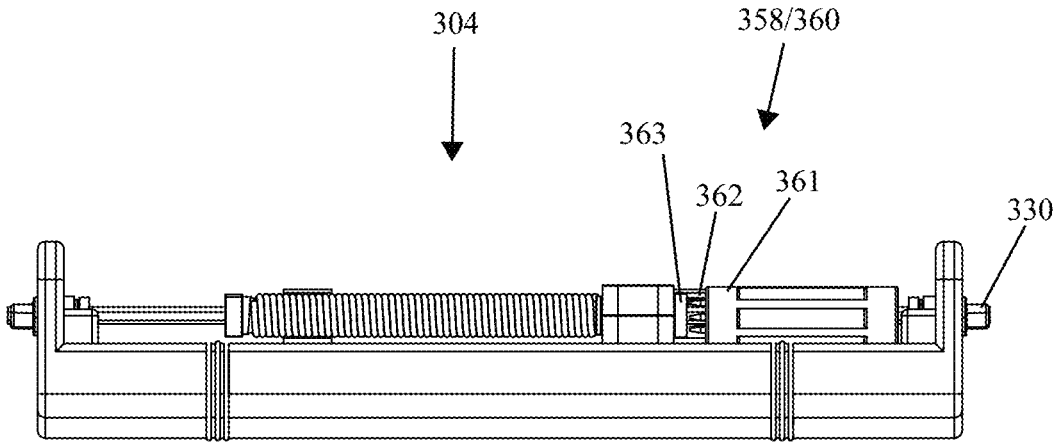
FIG. 17 is a bottom elevation view of a reclining mechanism of a reclining chair in accordance with one or more arrangements; the view showing the reclining mechanism having a counterbalance assembly and a locking mechanism having a movable body, teeth, and a stationary member positioned on the upper axle of the upper guide assembly of the reclining mechanism.
Figure 18:
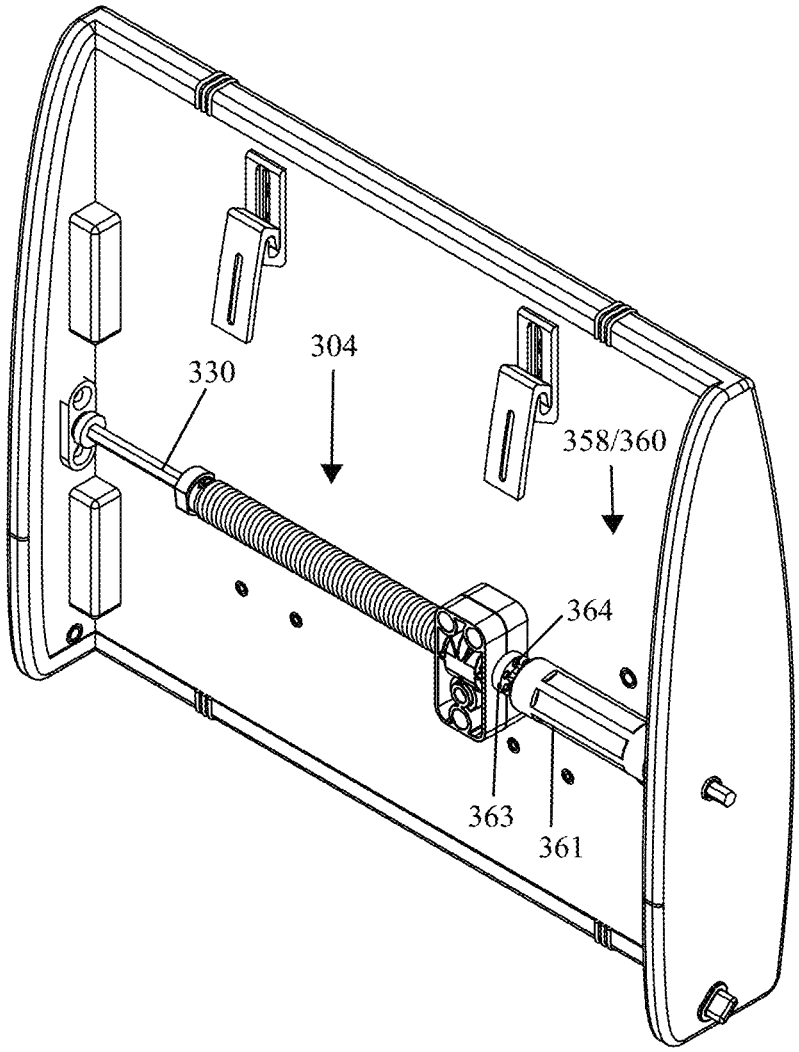
FIG. 18 is a perspective view of a reclining mechanism of a reclining chair in accordance with one or more arrangements; the view showing the reclining mechanism having a counterbalance assembly and a locking mechanism having a movable body, teeth, and a stationary member positioned on the upper axle of the upper guide assembly of the reclining mechanism.
Figure 19:
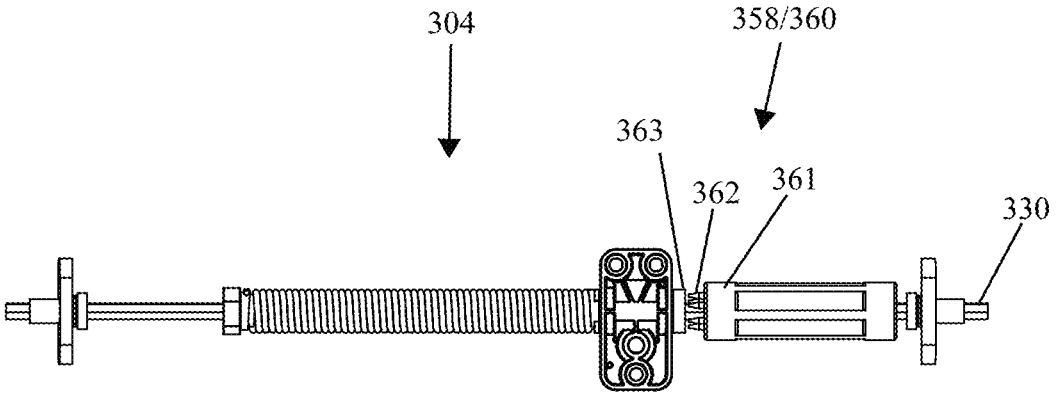
FIG. 19 is a front elevation view of a counterbalance assembly of a reclining mechanism of a reclining chair in accordance with one or more arrangements; the view showing the counterbalance assembly and a locking mechanism having a movable body, teeth, and a stationary member positioned on the upper axle of the upper guide assembly of the reclining mechanism. The view showing the locking mechanism in an unlocked position.
Figure 20:
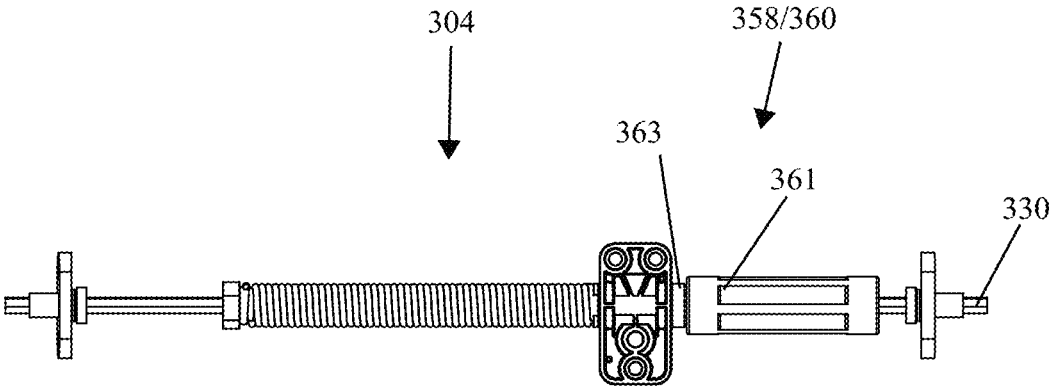
FIG. 20 is a front elevation view of a counterbalance assembly of a reclining mechanism of a reclining chair in accordance with one or more arrangements; the view showing the counterbalance assembly and a locking mechanism having a movable body, teeth, and a stationary member positioned on the upper axle of the upper guide assembly of the reclining mechanism. The view showing the locking mechanism in an locked position.
Figure 21:
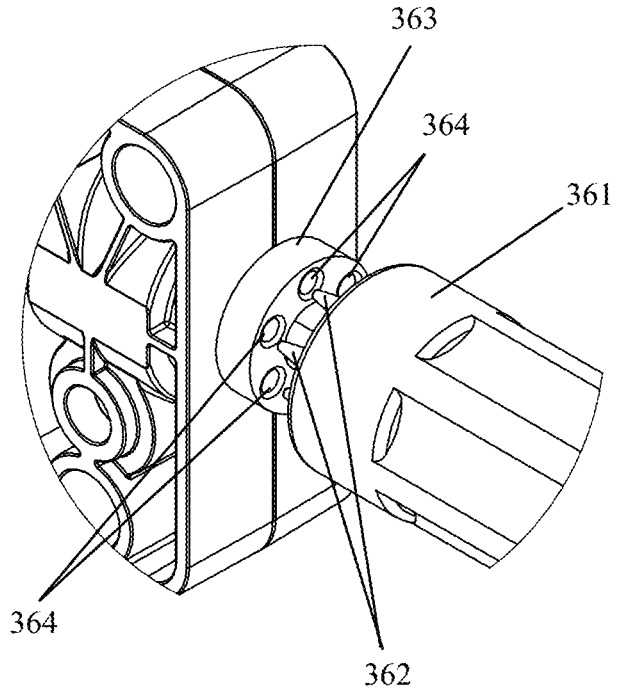
FIG. 21 is a perspective view of a counterbalance assembly of a reclining mechanism of a reclining chair in accordance with one or more arrangements; the view showing the counterbalance assembly and a locking mechanism having a movable body, teeth, and a stationary member positioned on the upper axle of the upper guide assembly of the reclining mechanism. The view showing the locking mechanism in an unlocked position.
Figure 21:
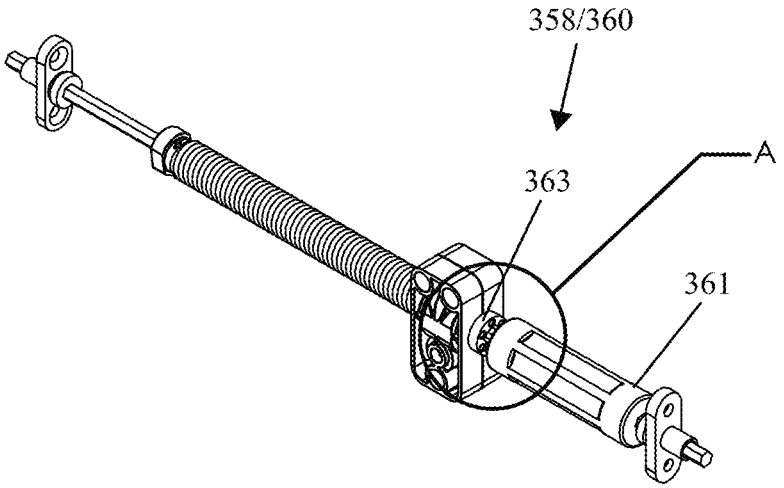
Figure 22:
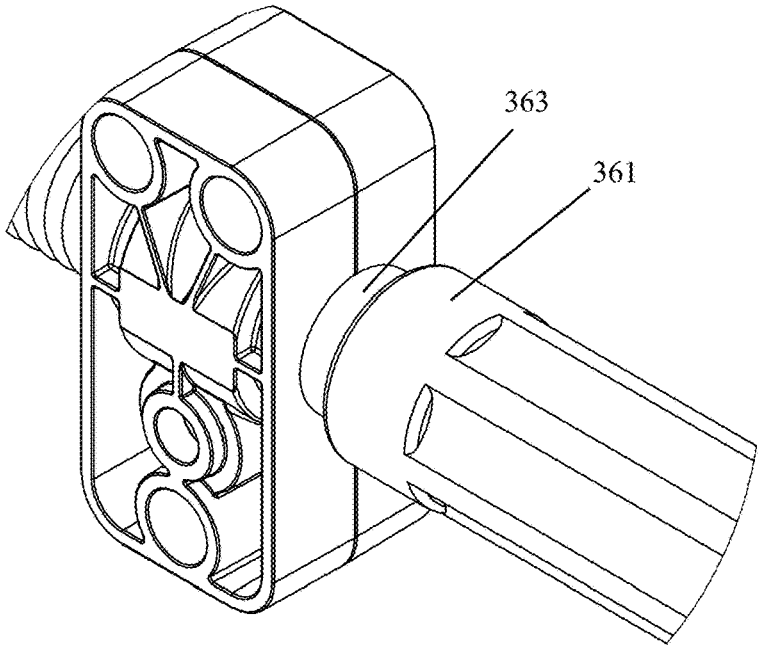
FIG. 22 is a perspective view of a counterbalance assembly of a reclining mechanism of a reclining chair in accordance with one or more arrangements; the view showing the counterbalance assembly and a locking mechanism having a movable body, teeth, and a stationary member positioned on the upper axle of the upper guide assembly of the reclining mechanism. The view showing the locking mechanism in an locked position.
Figure 22:
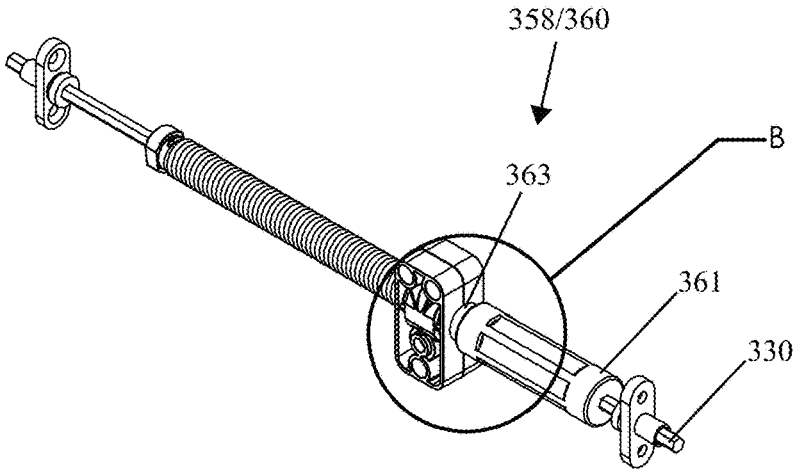
Figure 23:
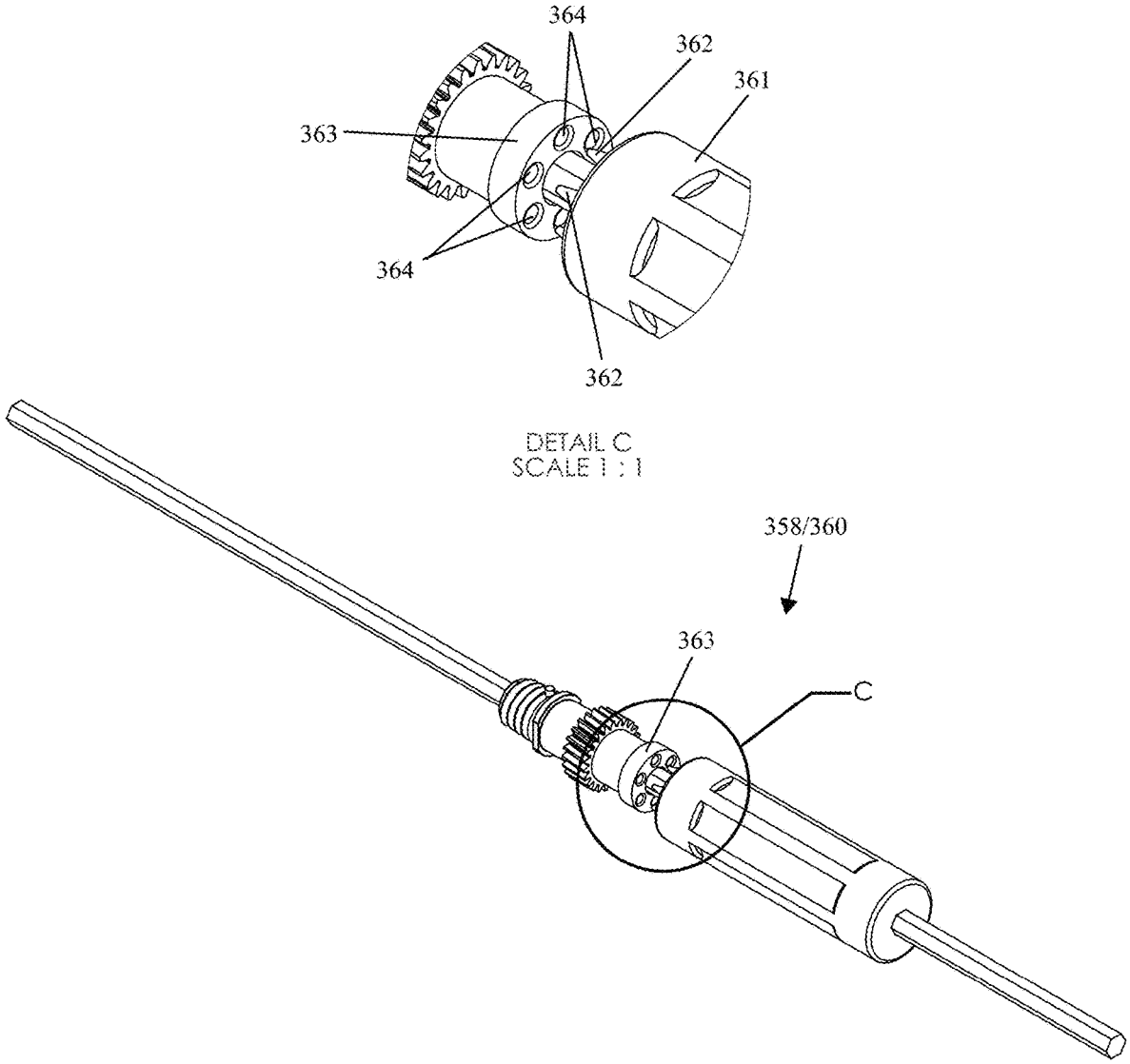
FIG. 23 is a perspective view of a counterbalance assembly of a reclining mechanism of a reclining chair in accordance with one or more arrangements; the view showing the counterbalance assembly and a locking mechanism having a movable body, teeth, and a stationary member positioned on the upper axle of the upper guide assembly of the reclining mechanism. The view showing the locking mechanism in an unlocked position.
Figure 24:
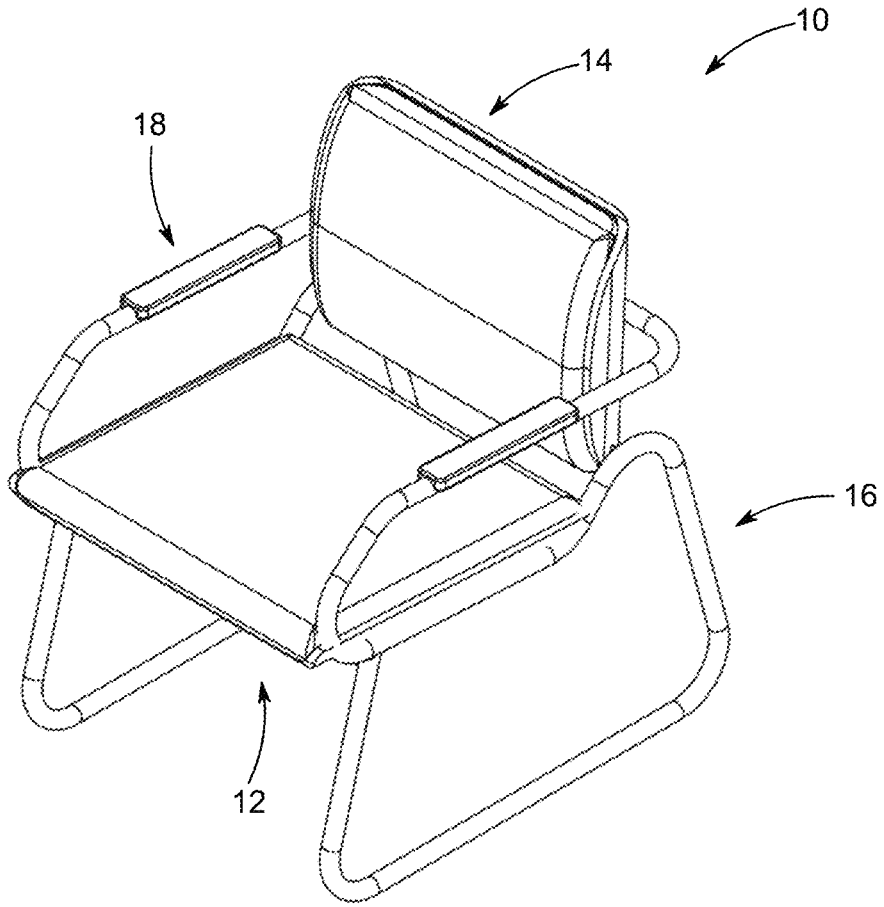
FIG. 24 is a front perspective view of a reclining chair in accordance with one or more arrangements in accordance with one or more arrangements; the view showing the reclining chair having a seat, a backrest, a frame, and arm covers.
Figure 25:
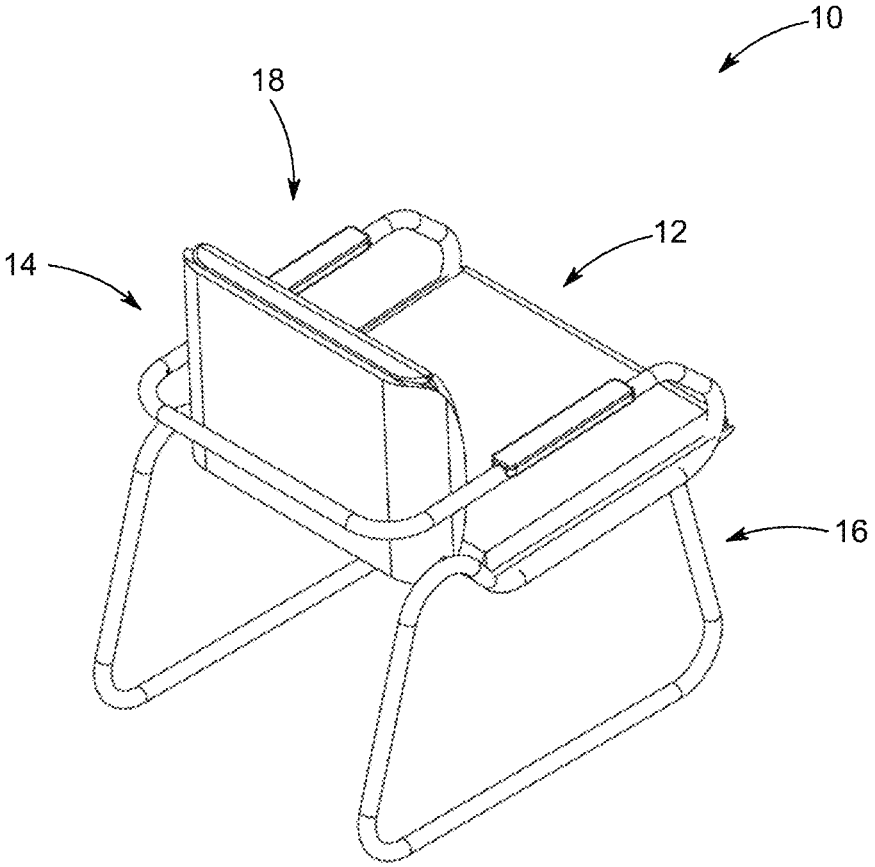
FIG. 25 is a rear perspective view of a reclining chair in accordance with one or more arrangements in accordance with one or more arrangements; the view showing the reclining chair having a seat, a backrest, a frame, and arm covers.
Figure 26:
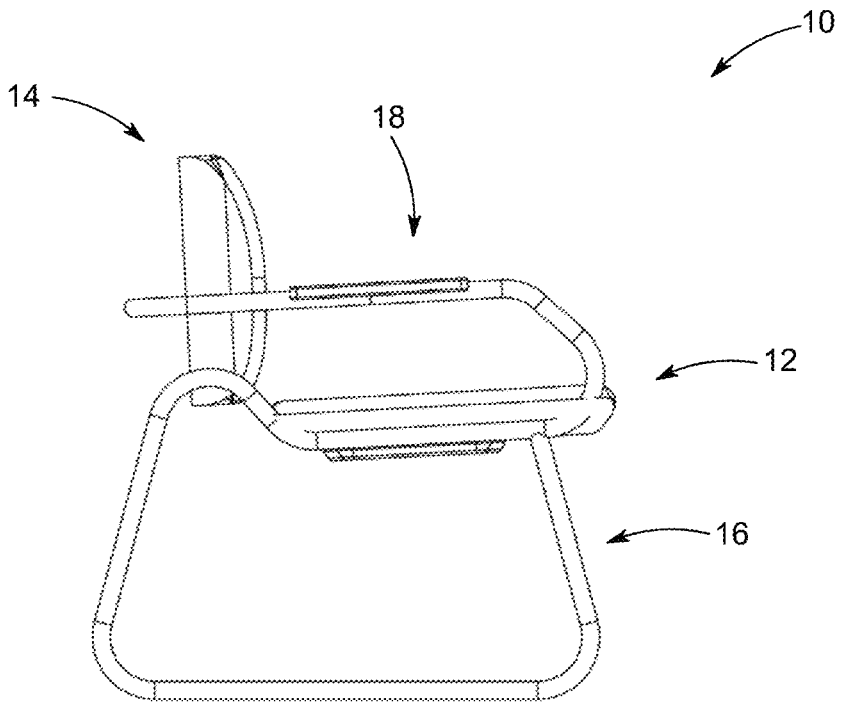
FIG. 26 is a side elevation view of a reclining chair in accordance with one or more arrangements in accordance with one or more arrangements; the view showing the reclining chair having a seat, a backrest, a frame, and arm covers.
Figure 27:
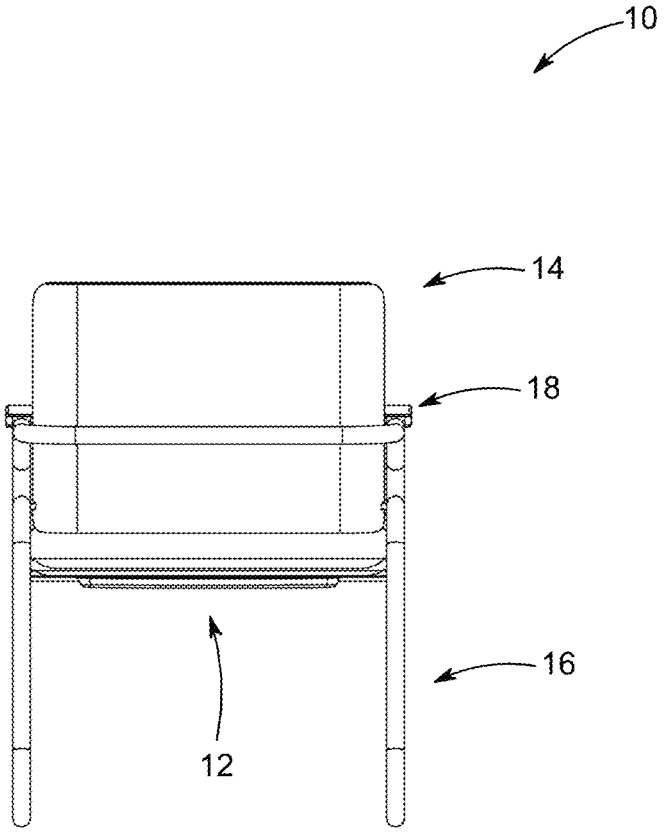
FIG. 27 is a rear elevation view of a reclining chair in accordance with one or more arrangements in accordance with one or more arrangements; the view showing the reclining chair having a seat, a backrest, a frame, and arm covers.
Figure 28:
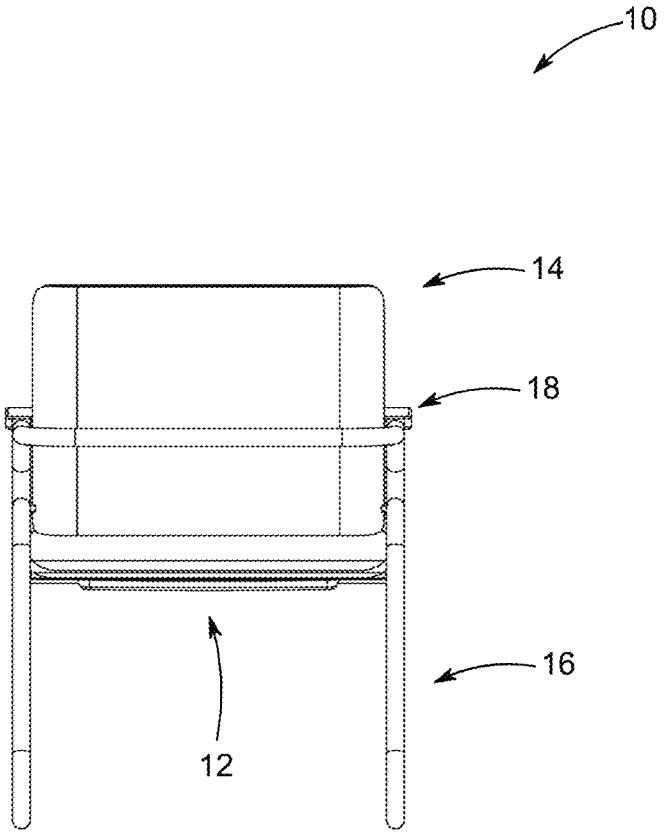
FIG. 28 is a rear elevation view of a reclining chair in accordance with one or more arrangements in accordance with one or more arrangements; the view showing the reclining chair having a seat, a backrest, a frame, and arm covers.
Figure 29:
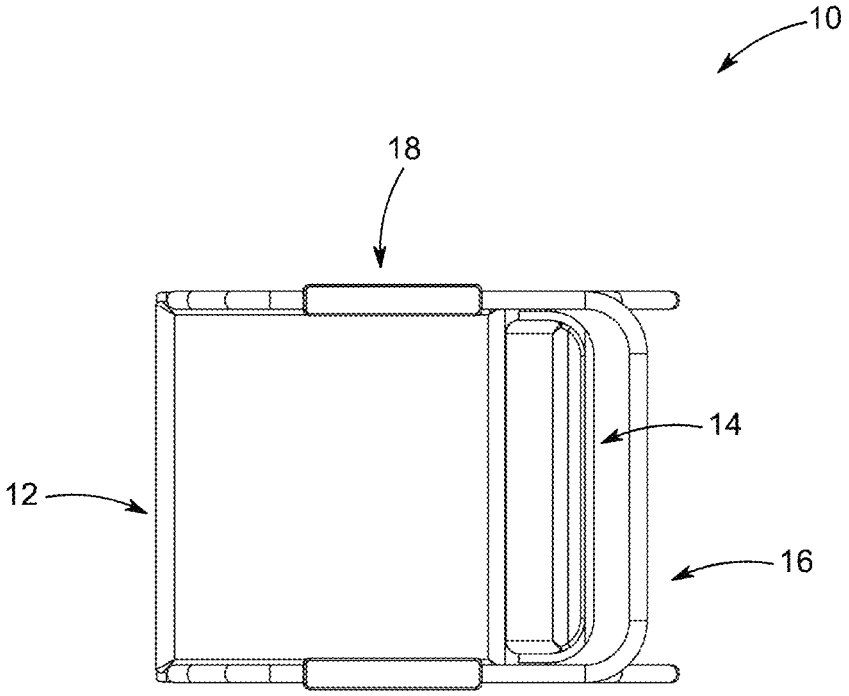
FIG. 29 is a top elevation view of a reclining chair in accordance with one or more arrangements in accordance with one or more arrangements; the view showing the reclining chair having a seat, a backrest, a frame, and arm covers.
Figure 30:
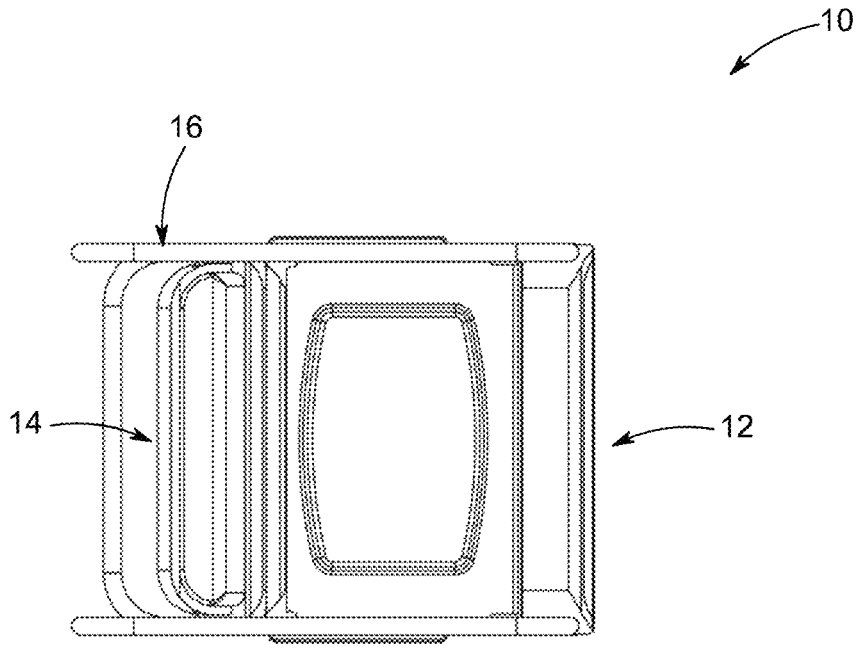
FIG. 30 is a bottom elevation view of a reclining chair in accordance with one or more arrangements in accordance with one or more arrangements; the view showing the reclining chair having a seat, a backrest, a frame, and arm covers.
Figure 31:
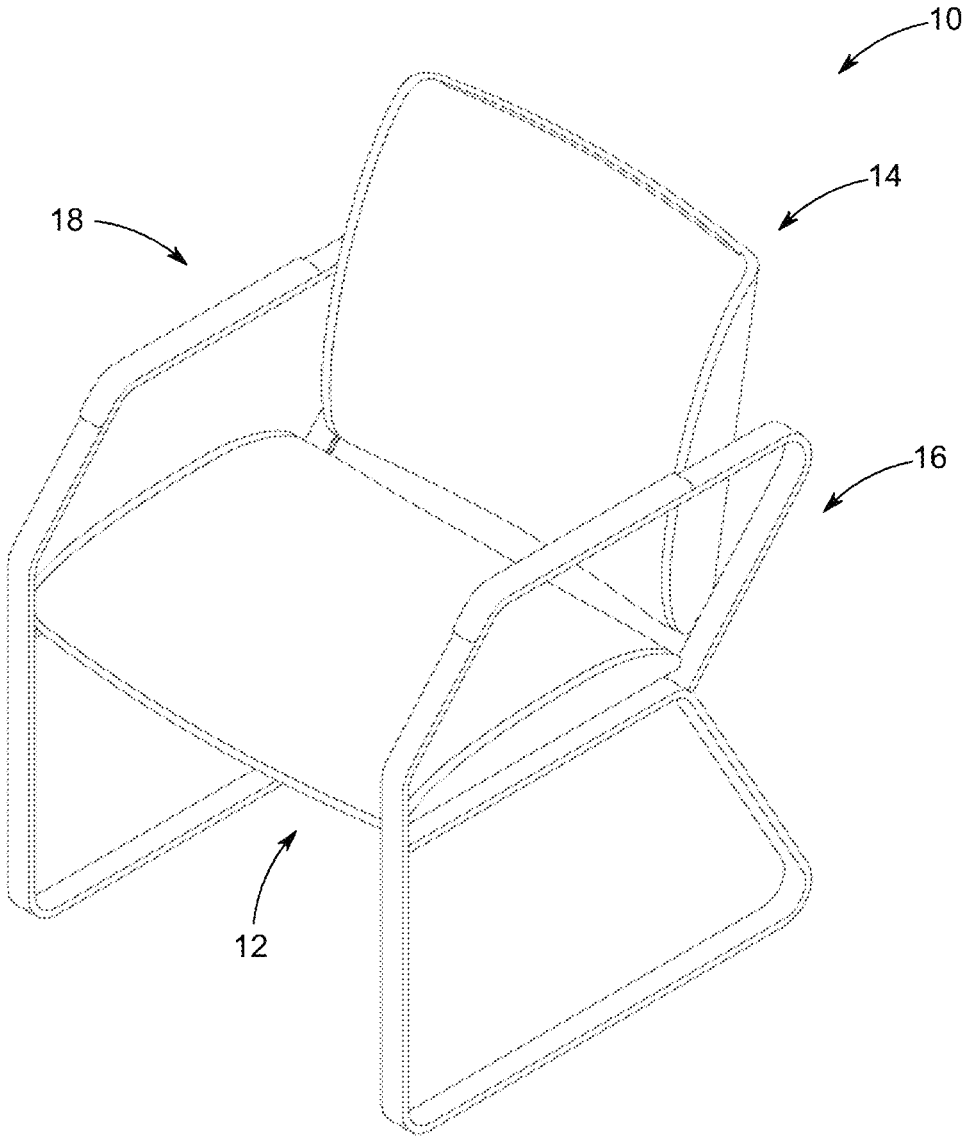
FIG. 31 is a front perspective view of a reclining chair in accordance with one or more arrangements in accordance with one or more arrangements; the view showing the reclining chair having a seat, a backrest, a frame, and arm covers.
Figure 32:
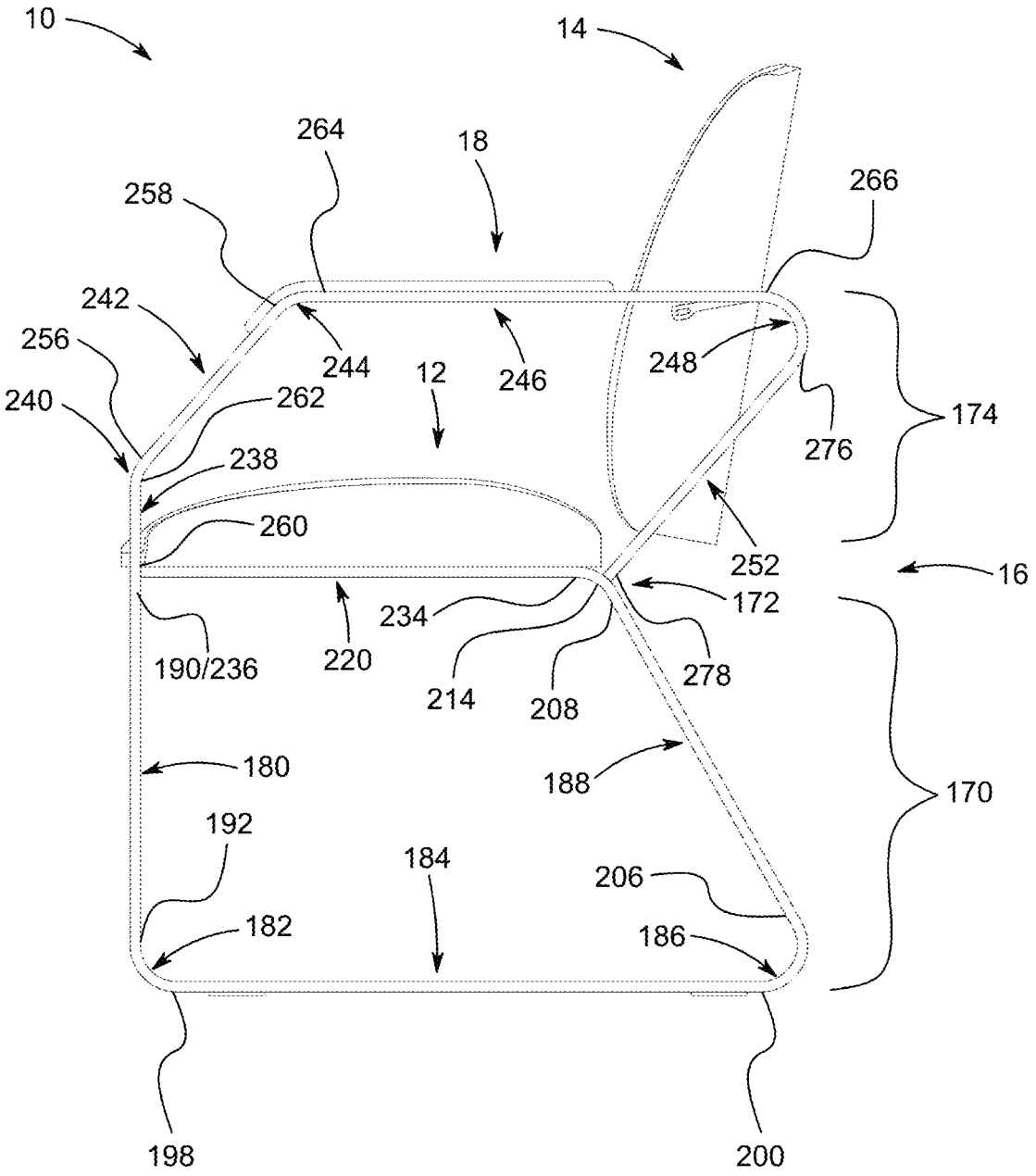
FIG. 32 is a side elevation view of a reclining chair in accordance with one or more arrangements in accordance with one or more arrangements; the view showing the reclining chair having a seat, a backrest, a frame, and arm covers; the view also showing the frame having a base section, a seat support section, and an arm support section.
Figure 33:
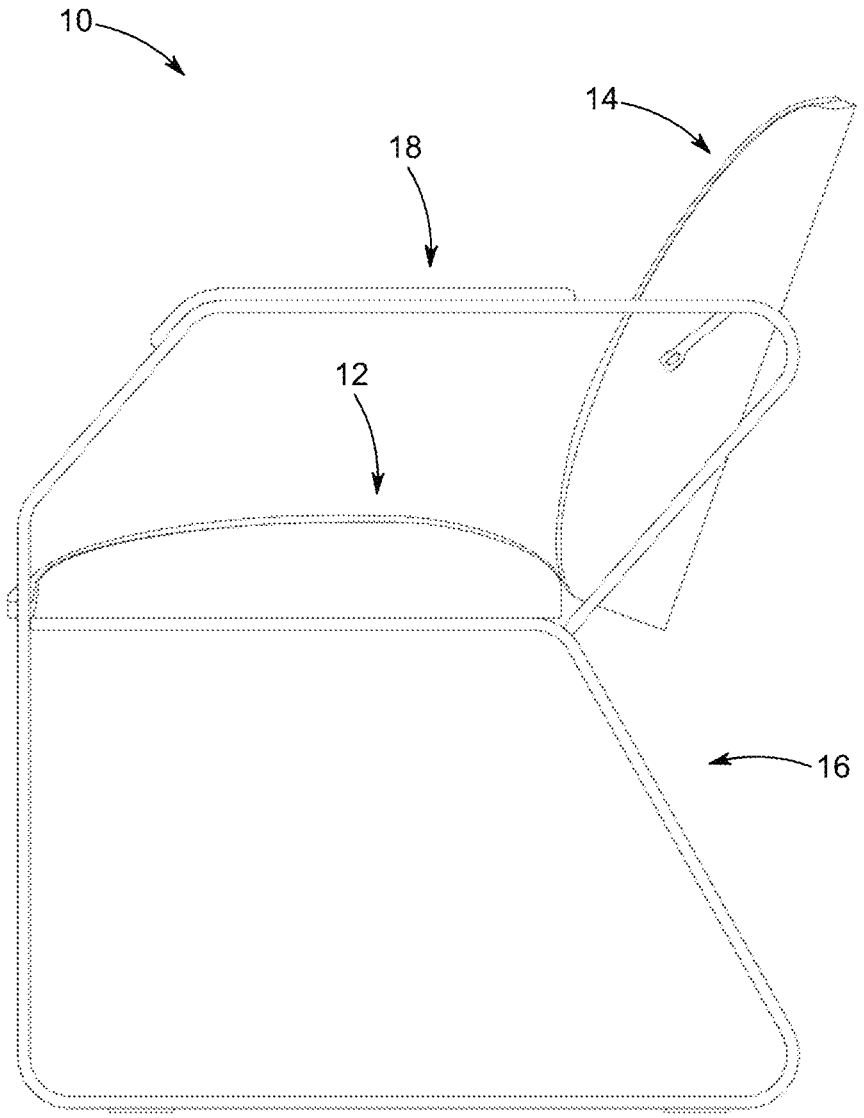
FIG. 33 is a side elevation view of a reclining chair in accordance with one or more arrangements in accordance with one or more arrangements; the view showing the reclining chair having a seat, a backrest, a frame, and arm covers.
Figure 34:
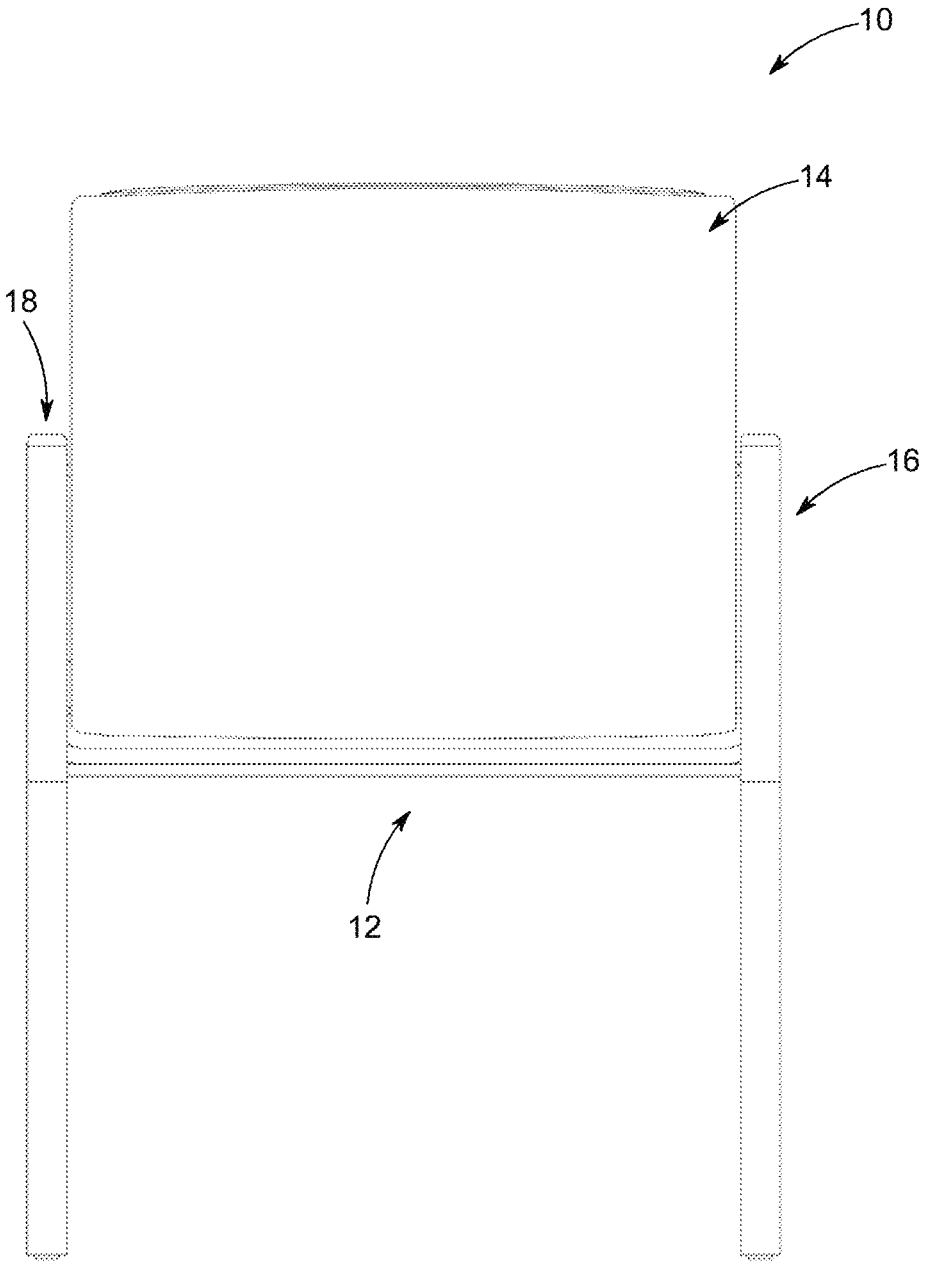
FIG. 34 is a back elevation view of a reclining chair in accordance with one or more arrangements in accordance with one or more arrangements; the view showing the reclining chair having a seat, a backrest, a frame, and arm covers.
Figure 35:
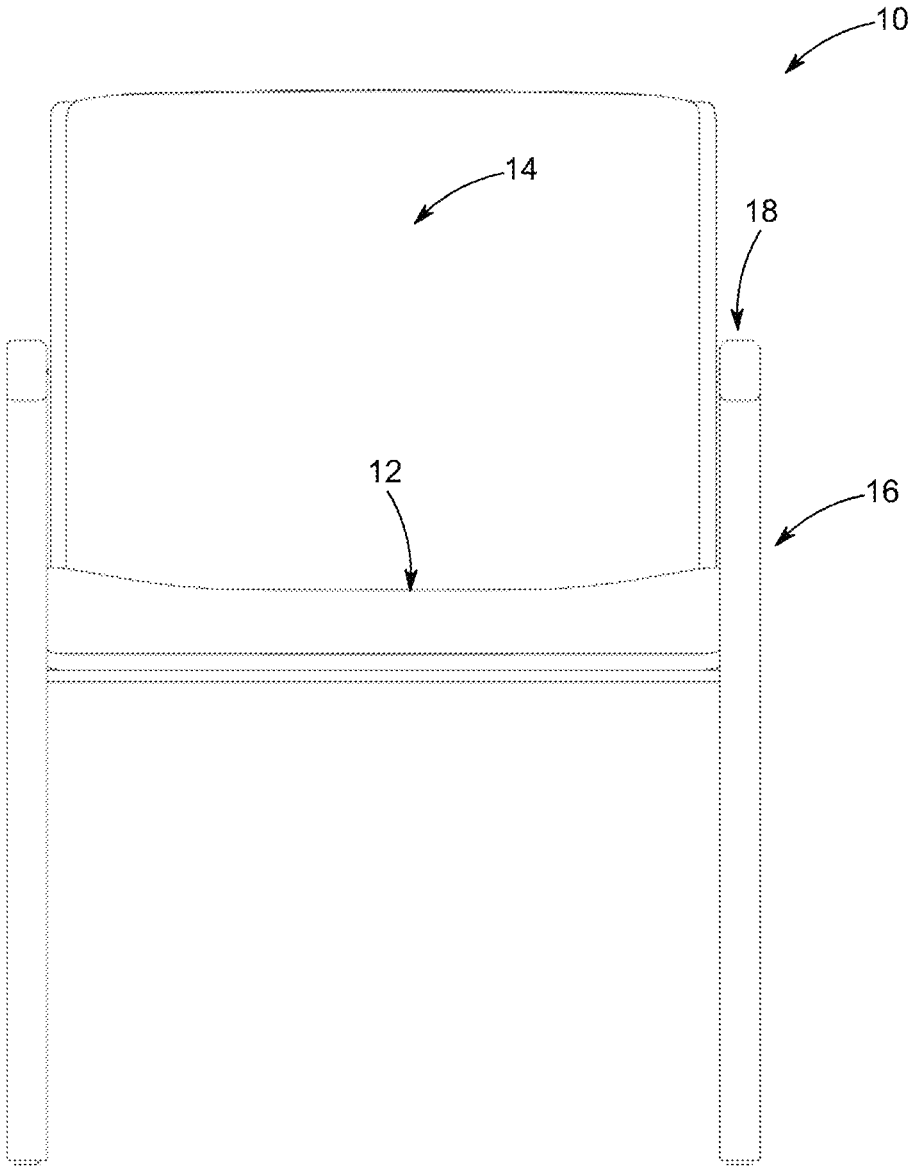
FIG. 35 is a front elevation view of a reclining chair in accordance with one or more arrangements in accordance with one or more arrangements; the view showing the reclining chair having a seat, a backrest, a frame, and arm covers.
Figure 36:
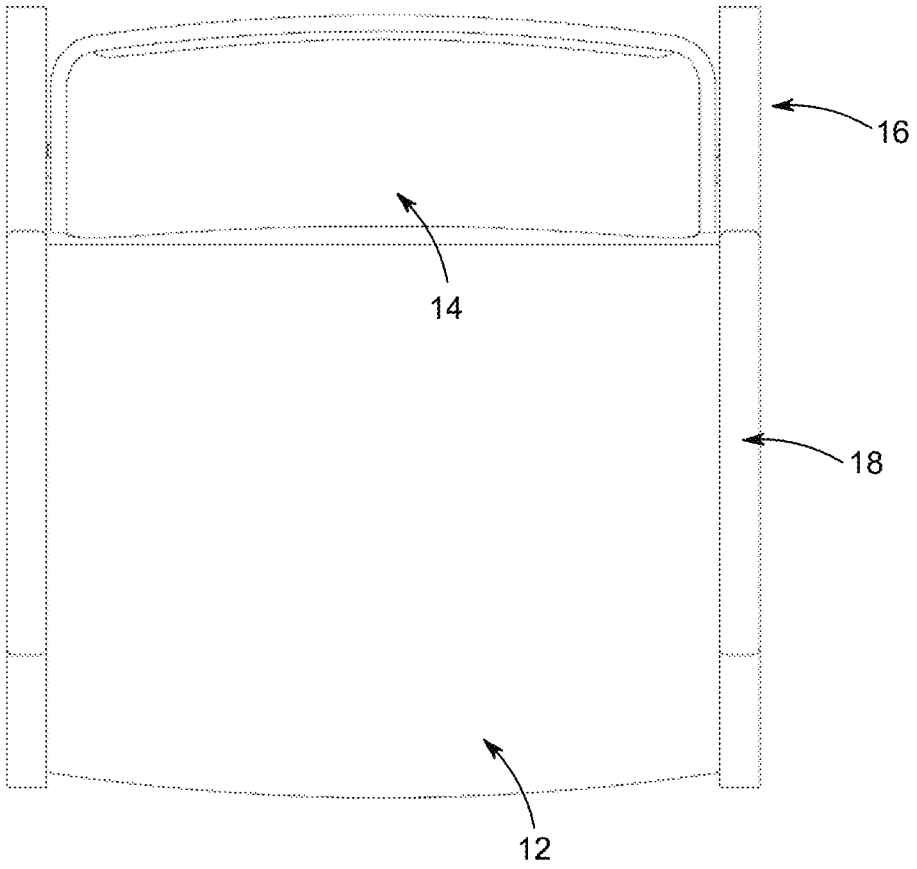
FIG. 36 is a top elevation view of a reclining chair in accordance with one or more arrangements in accordance with one or more arrangements; the view showing the reclining chair having a seat, a backrest, a frame, and arm covers.
Figure 37:
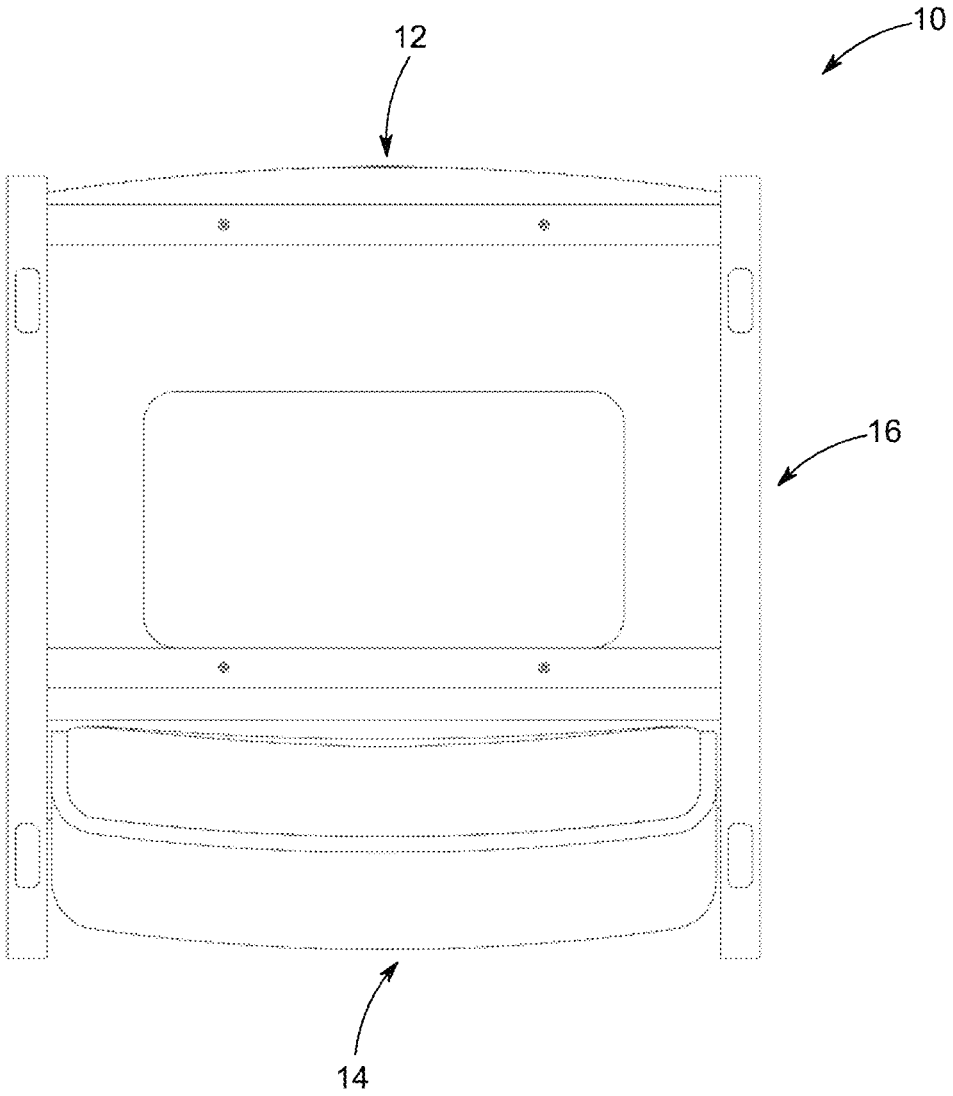
FIG. 37 is a bottom elevation view of a reclining chair in accordance with one or more arrangements in accordance with one or more arrangements; the view showing the reclining chair having a seat, a backrest, a frame, and arm covers.
Figure 38:
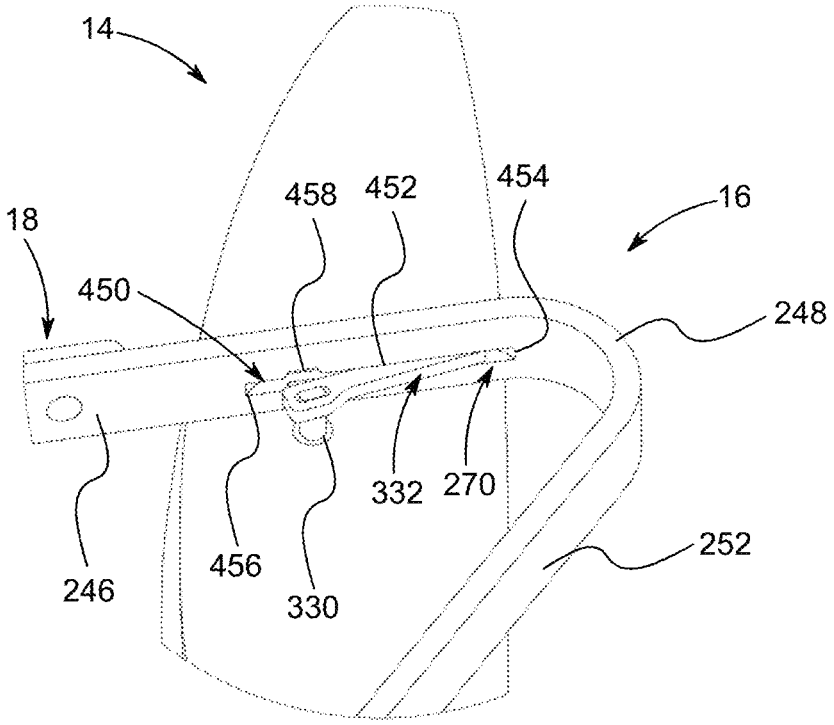
FIG. 38 is a detail view of a reclining chair in accordance with one or more arrangements; the view showing the reclining chair having a backrest, a frame, and arm covers, the view also showing an upper guide assembly of a reclining mechanism, the upper guide assembly having a link positioned at least partially within the arm of the arm support section of the frame.
Figure 39:
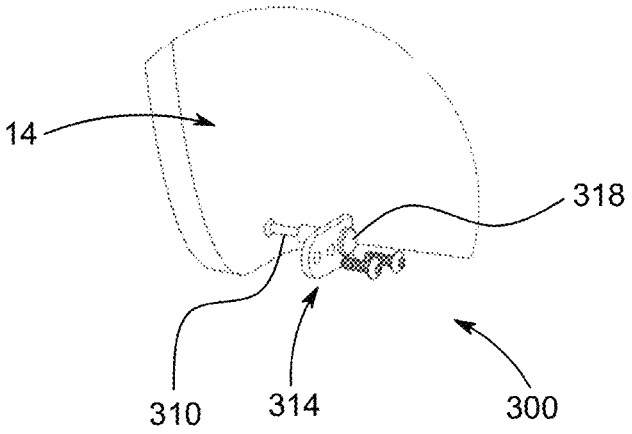
FIG. 39 is a detail view of a reclining chair in accordance with one or more arrangements; the view showing the reclining chair having a backrest and a lower guide assembly of a reclining mechanism, the lower guide assembly having a lower axle and a guide member.
Figure 40:
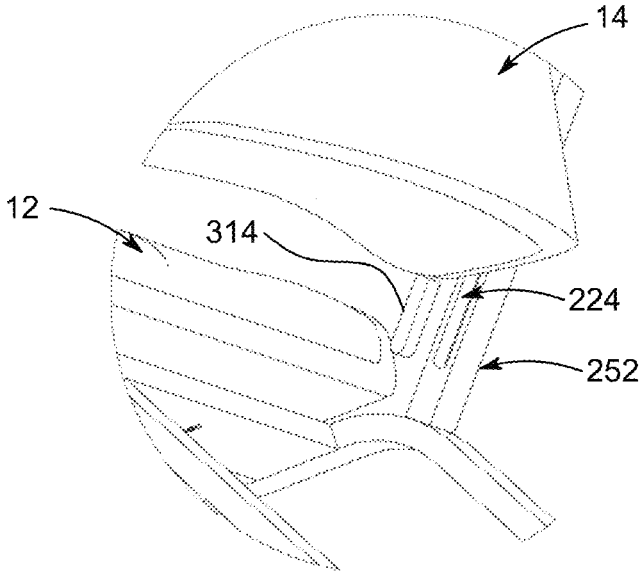
FIG. 40 is a detail view of a reclining chair in accordance with one or more arrangements; the view showing the reclining chair having a backrest, a seat, and a slotted track with a guide member.
Figure 41:
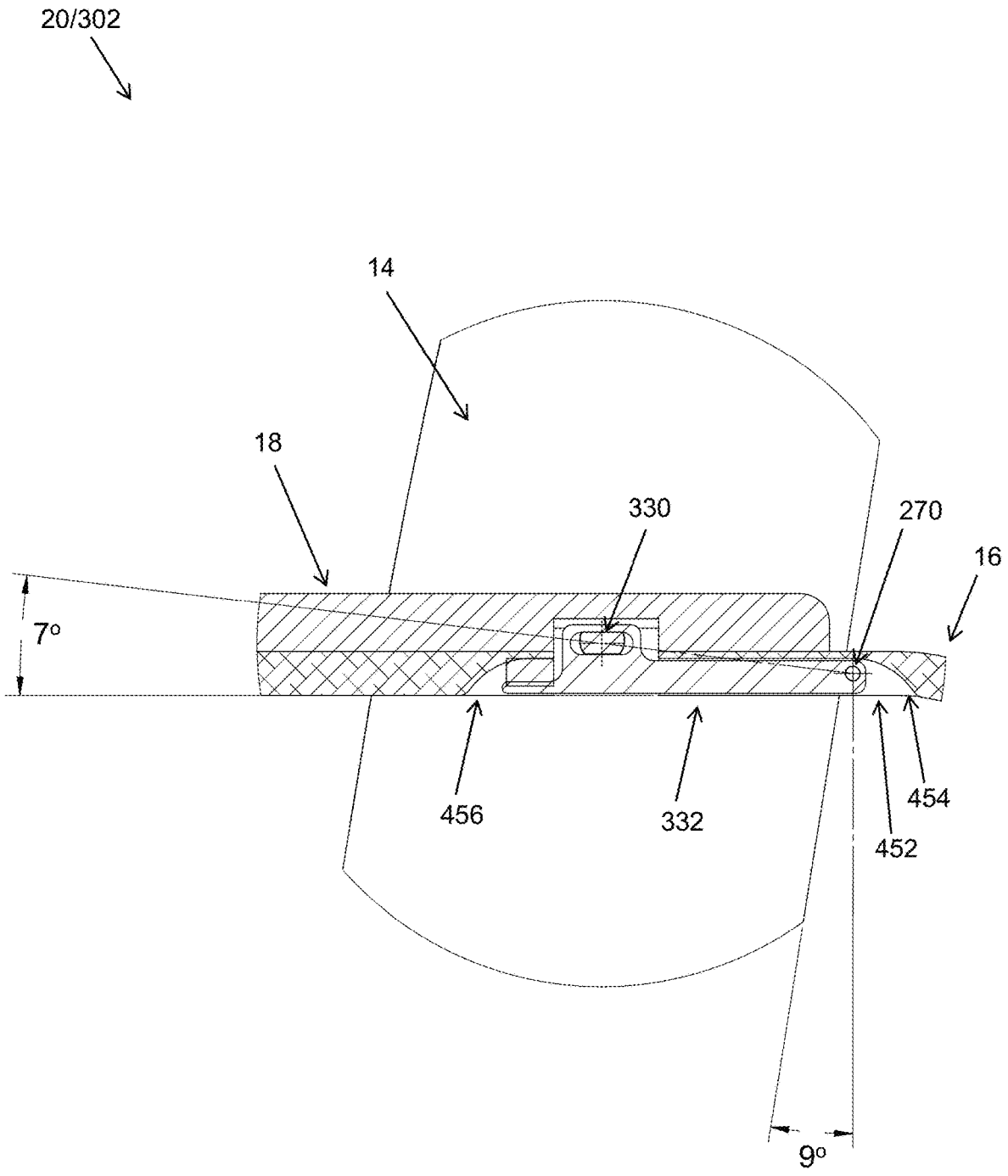
FIG. 41 is a section view of a reclining chair in accordance with one or more arrangements; the view showing the reclining chair having a backrest, a frame, arm covers, and an upper guide assembly of a reclining mechanism; the view also showing the upper guide assembly having an upper axle and a link.
Figure 42:
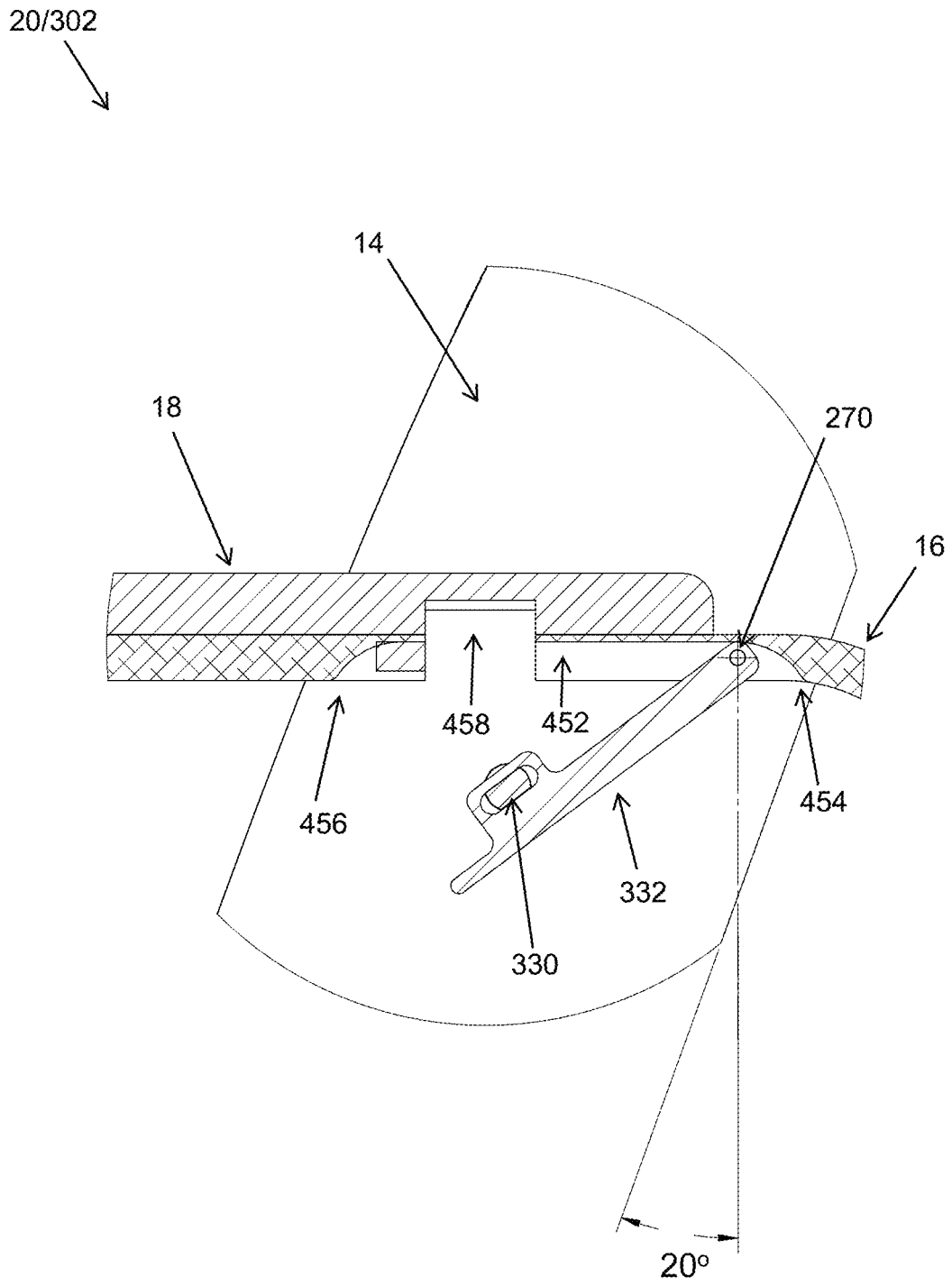
FIG. 42 is a section view of a reclining chair in accordance with one or more arrangements; the view showing the reclining chair having a backrest, a frame, arm covers, and an upper guide assembly of a reclining mechanism; the view also showing the upper guide assembly having an upper axle and a link.
Figure 43:
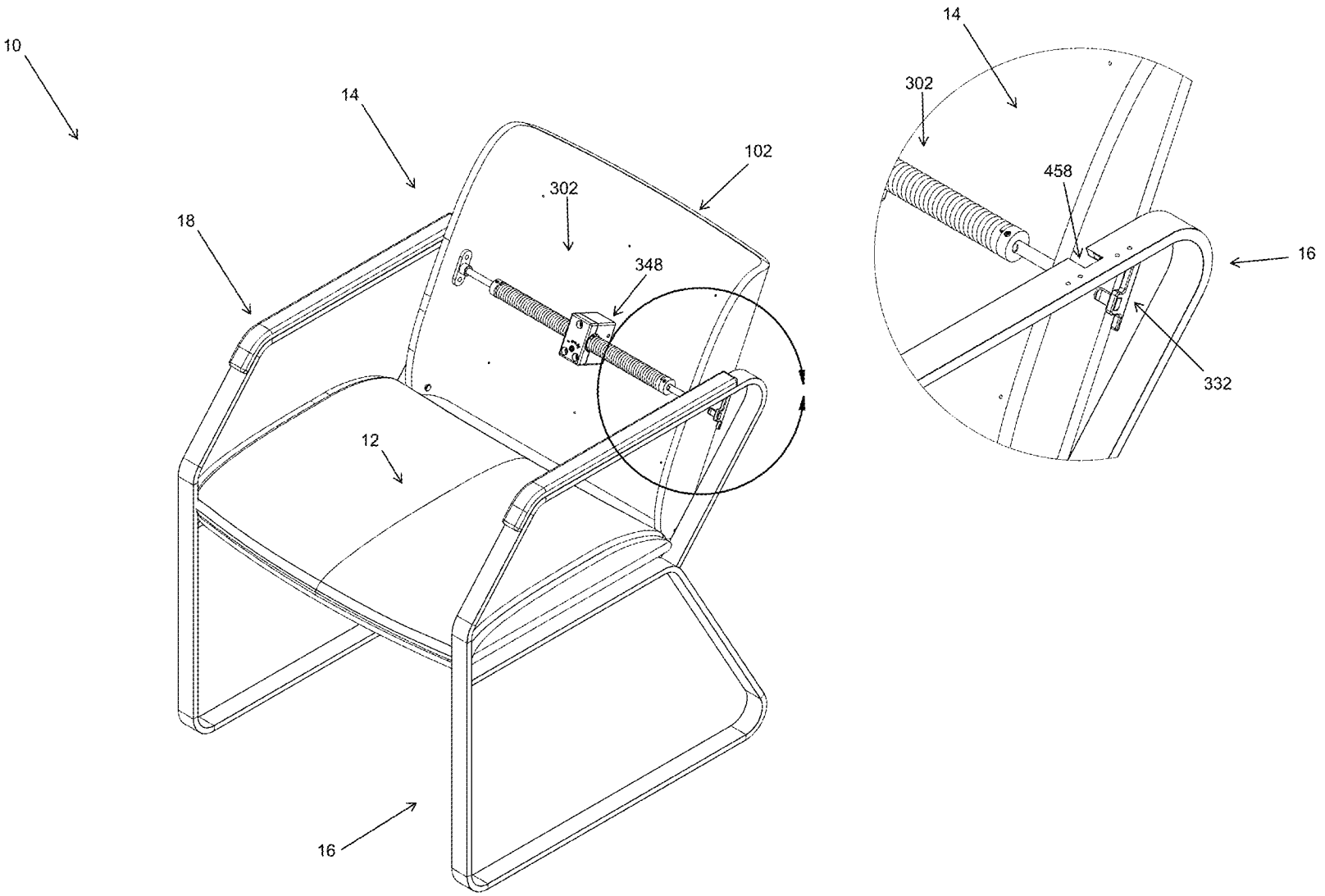
FIG. 43 is a front perspective view of a reclining chair in accordance with one or more arrangements; the view showing the reclining chair having a seat, a backrest, a frame, and arm covers; the view also showing the reclining chair having a reclining mechanism having an upper guide assembly and a tensioner assembly. The view showing the reclining chair in a reclined position.
Figure 44:
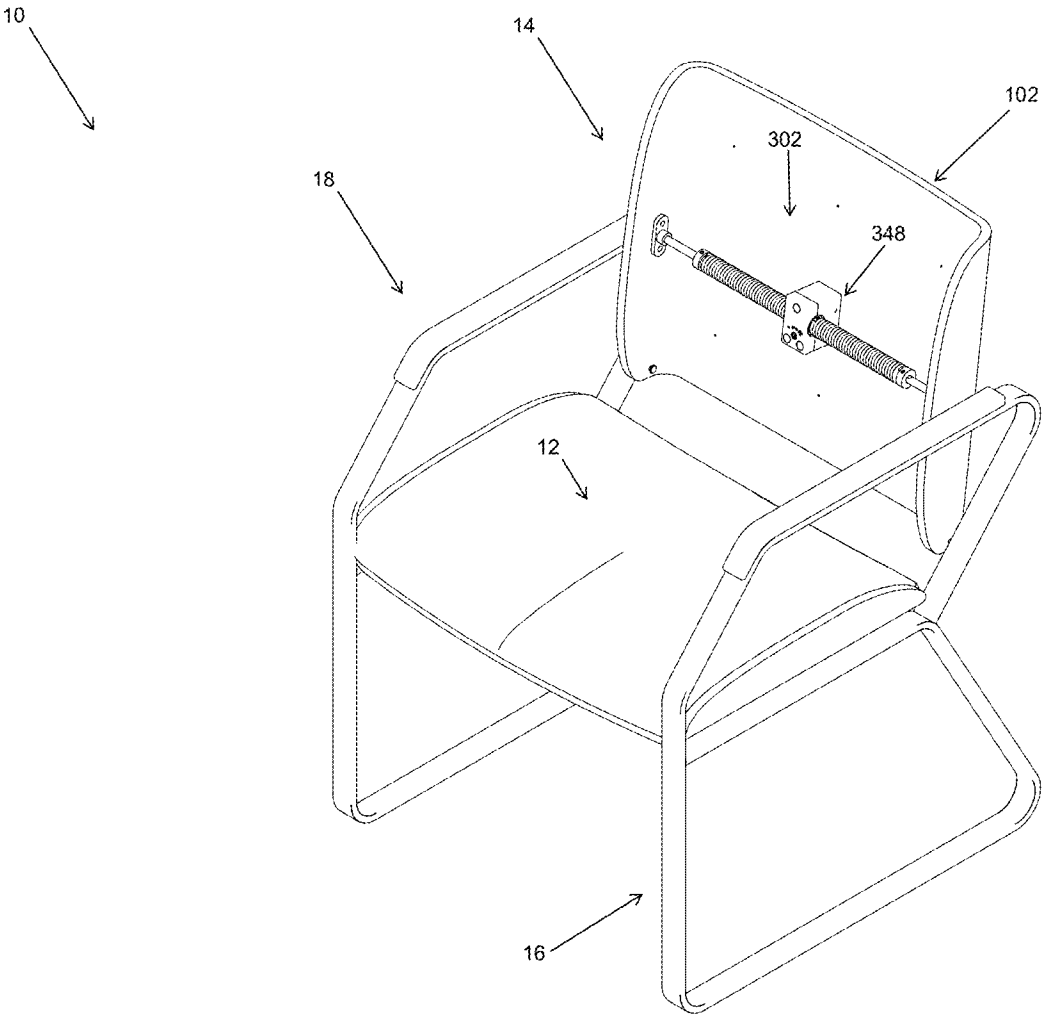
FIG. 44 is a front perspective view of a reclining chair in accordance with one or more arrangements; the view showing the reclining chair having a seat, a backrest, a frame, and arm covers; the view also showing the reclining chair having a reclining mechanism having an upper guide assembly and a tensioner assembly. The view showing the reclining chair in an upright position.
Figure 45:
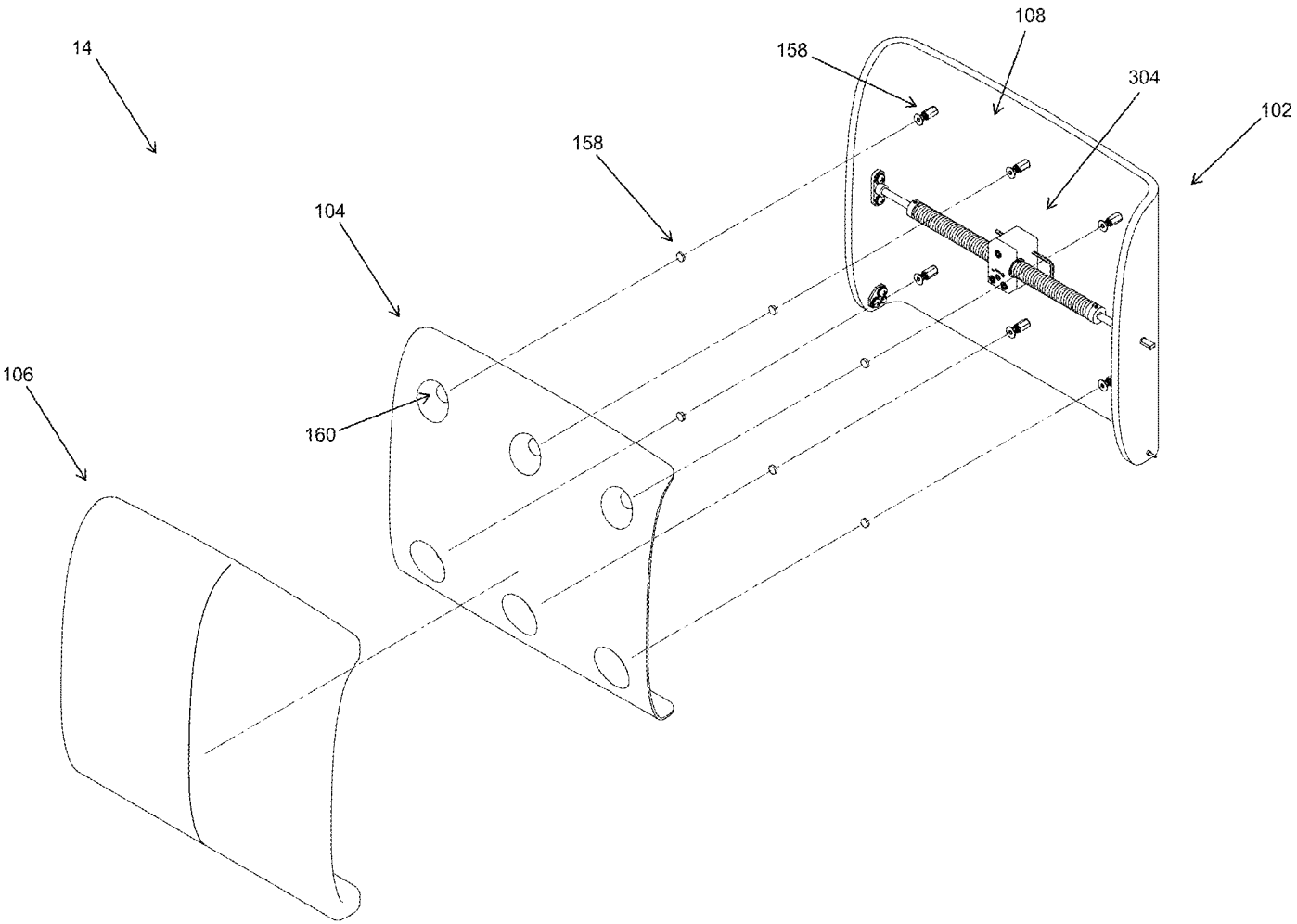
FIG. 45 is an exploded view of a reclining mechanism of a reclining chair in accordance with one or more arrangements; the view showing the backrest having a counterbalance assembly positioned within the backrest.
Figure 46:
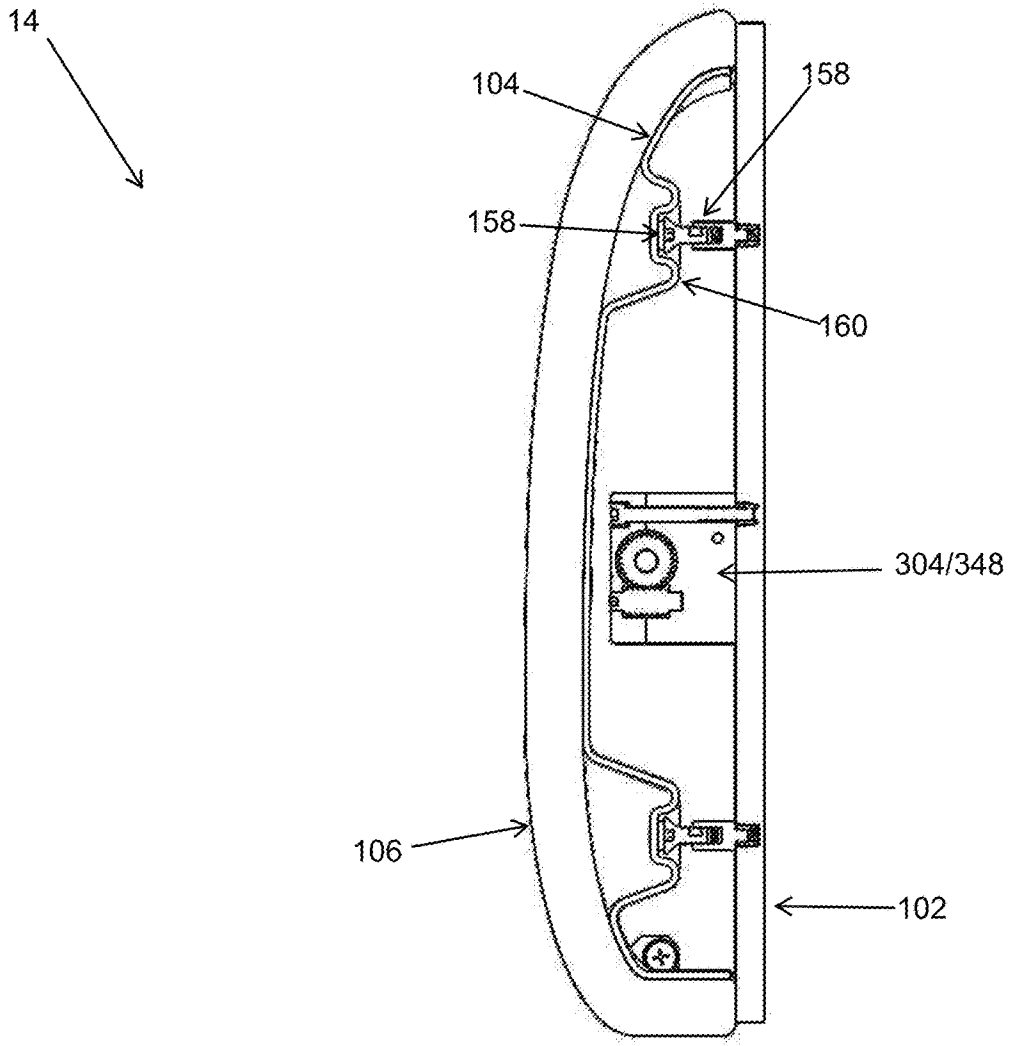
FIG. 46 is a side elevation view of a reclining chair in accordance with one or more arrangements; the view showing the reclining chair having a backrest with a cushion; the view also showing a backrest support assembly and a counterbalance assembly having a tensioner assembly.
Figure 47:
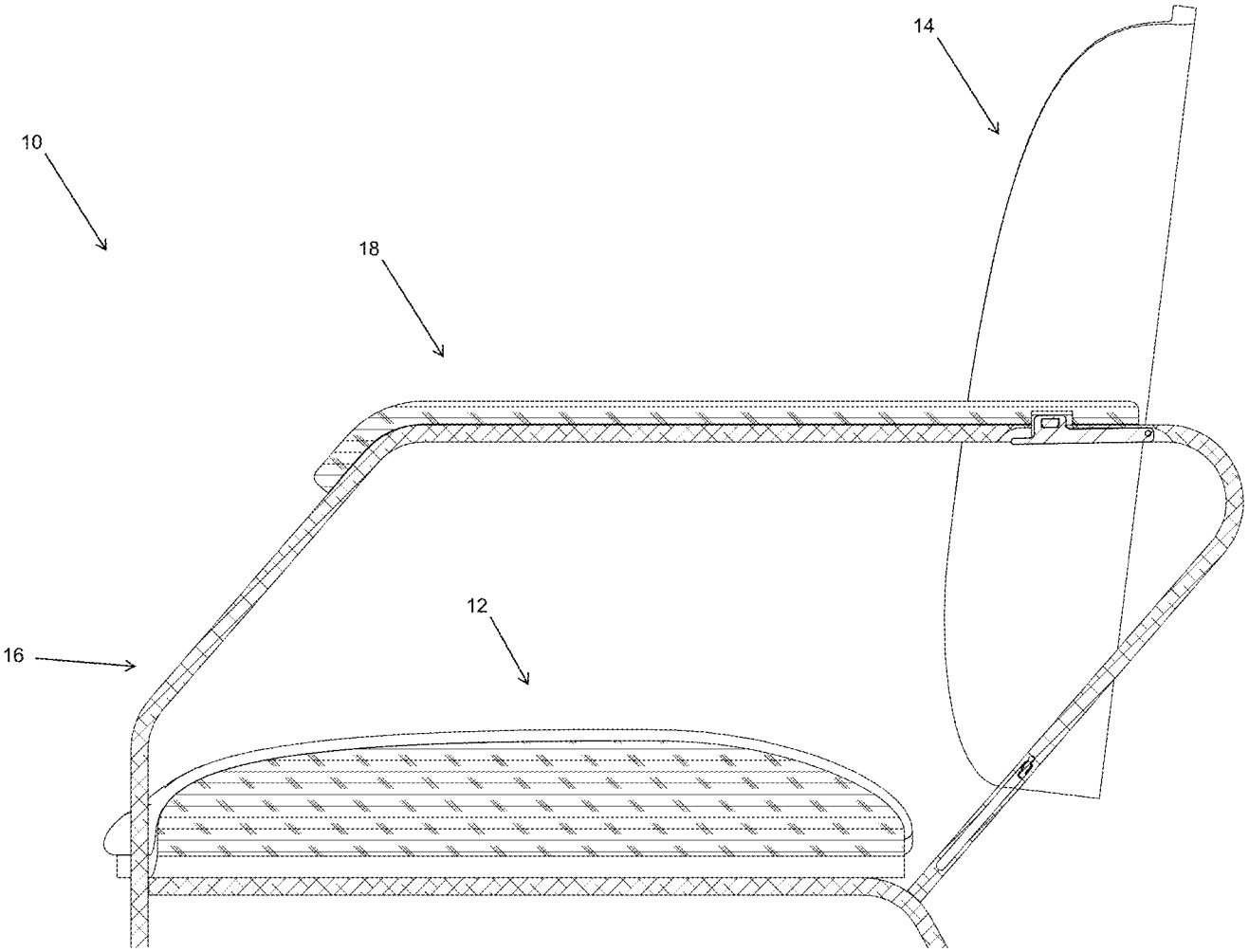
FIG. 47 is a section view of a reclining chair in accordance with one or more arrangements; the view showing the reclining chair having a backrest, a seat, a frame, and arm covers; the view also showing the reclining chair in an upright position.
Figure 48:
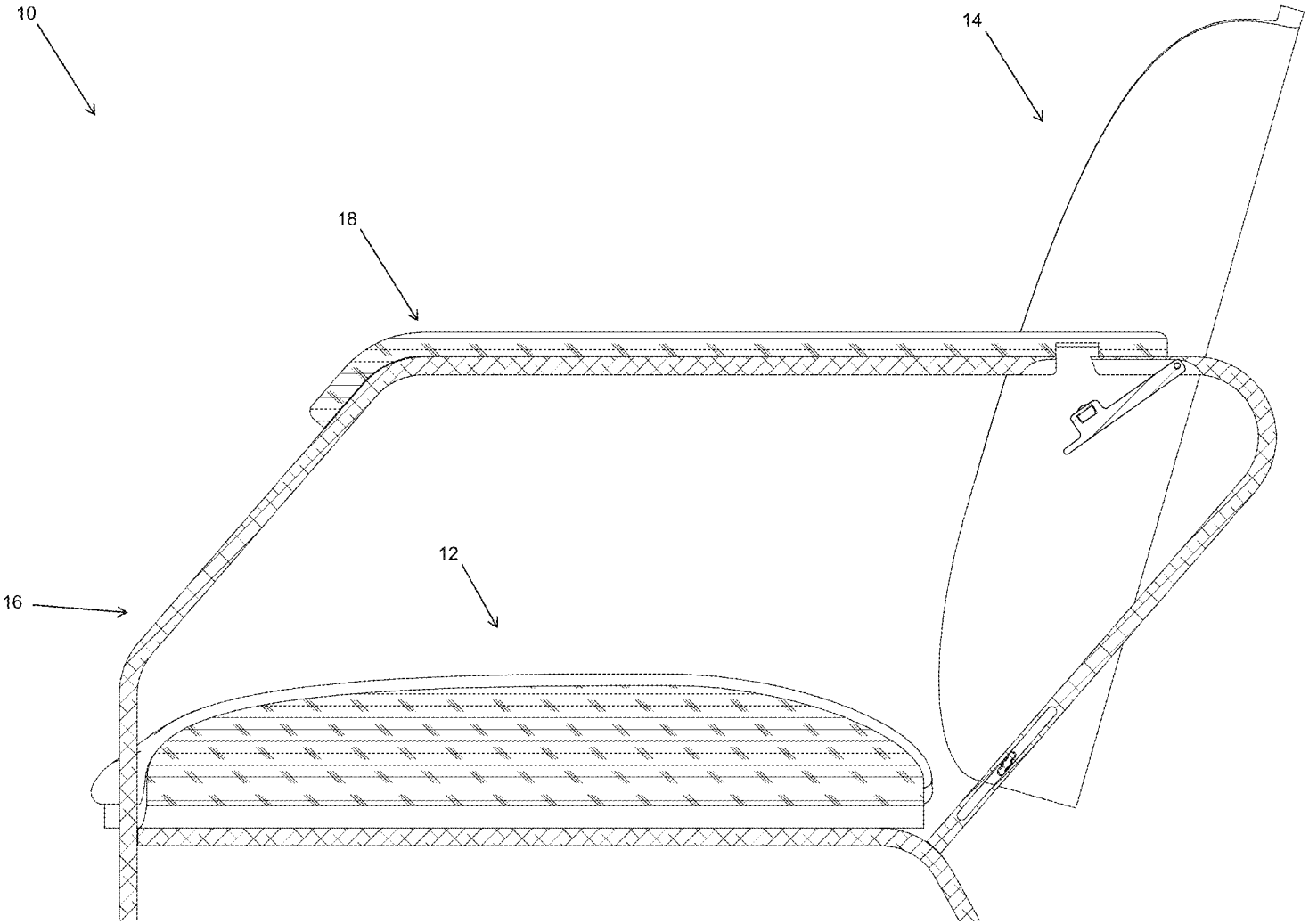
FIG. 48 is a section view of a reclining chair in accordance with one or more arrangements; the view showing the reclining chair having a backrest, a seat, a frame, and arm covers; the view also showing the reclining chair in a reclined position.
Figure 49:
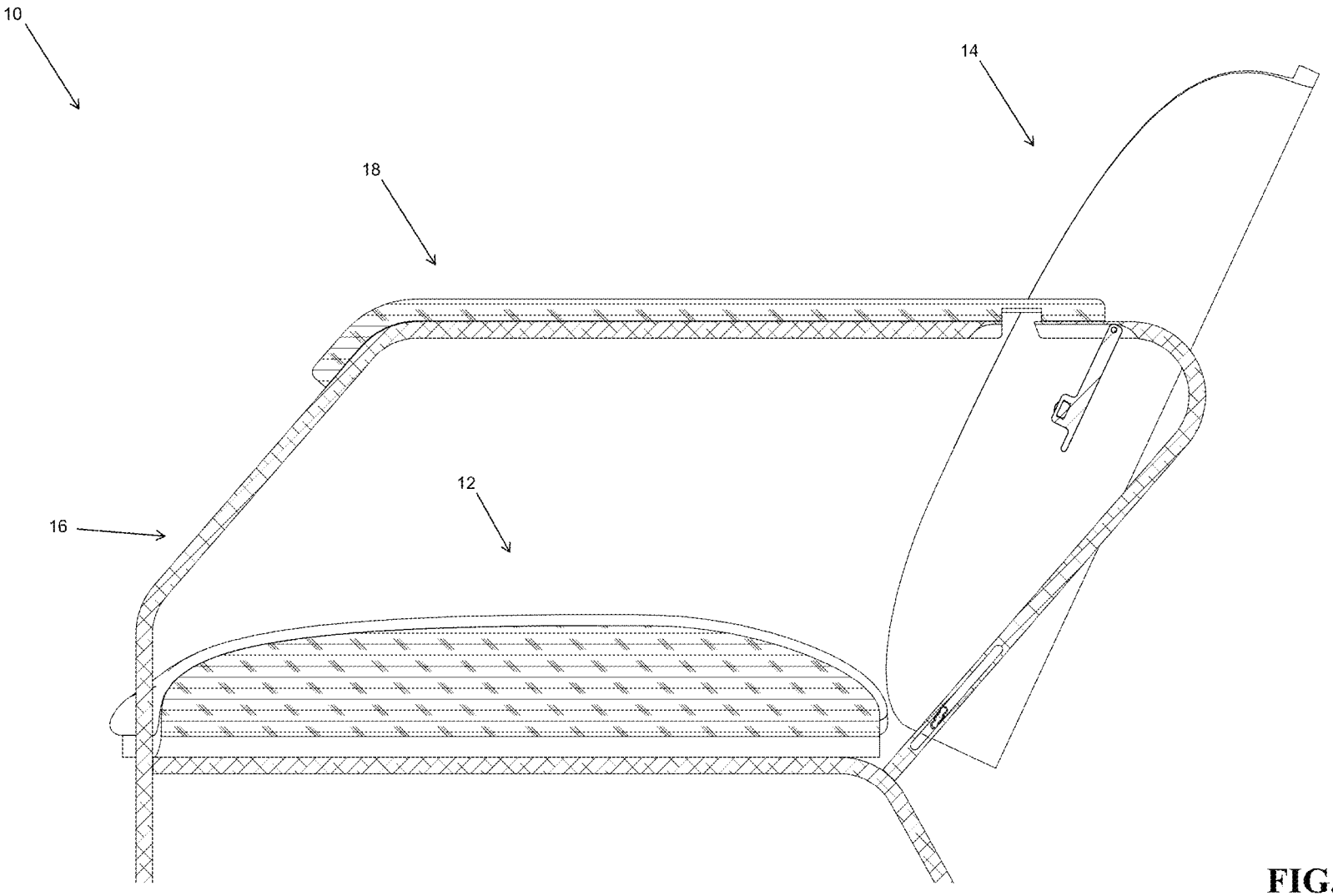
FIG. 49 is a section view of a reclining chair in accordance with one or more arrangements; the view showing the reclining chair having a backrest, a seat, a frame, and arm covers; the view also showing the reclining chair in a reclined position.
Figure 50:
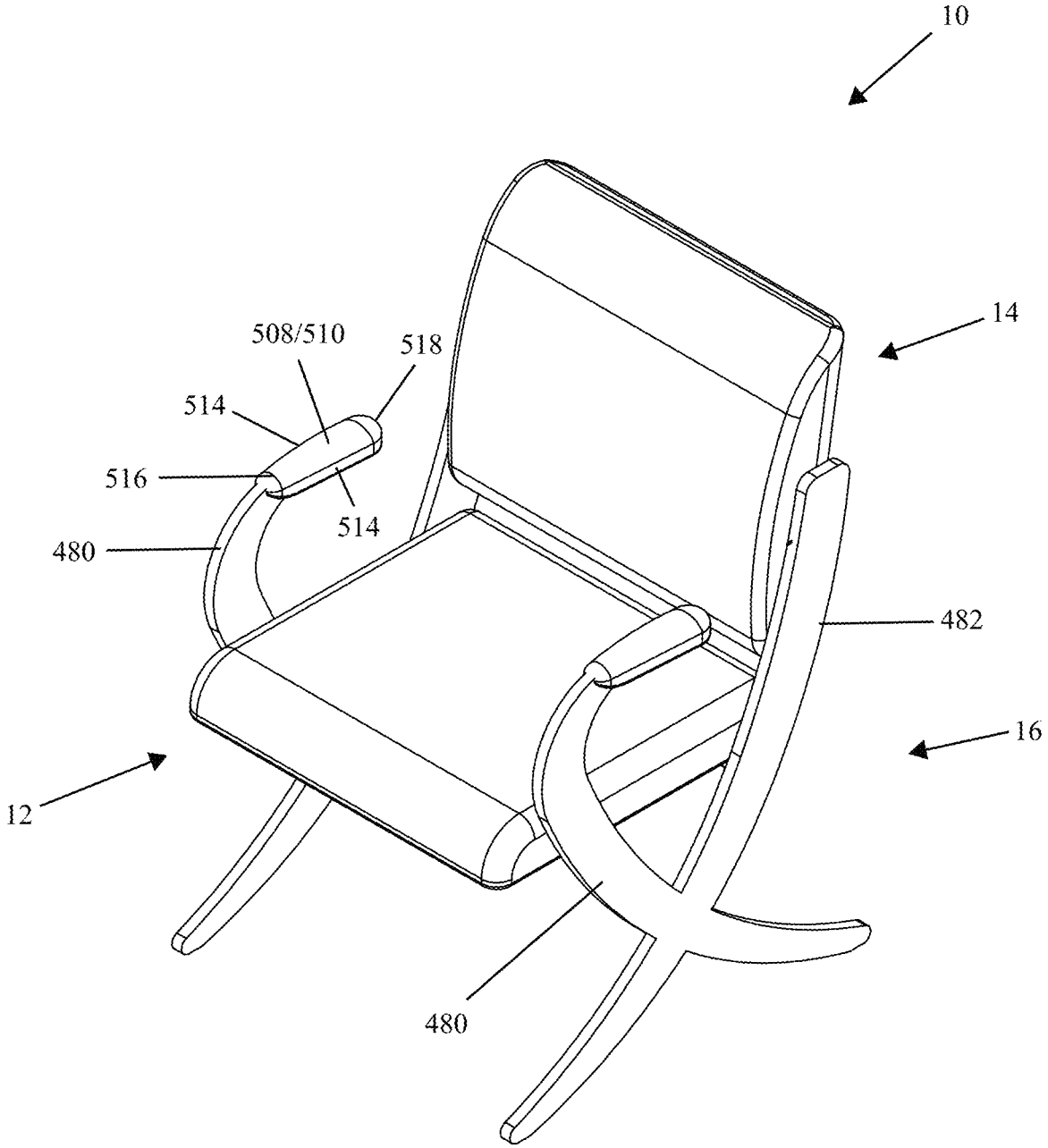
FIG. 50 is a perspective view of a reclining chair in accordance with one or more arrangements; the view showing the reclining chair having a seat, a backrest, a frame, and arm covers.
Figure 51:
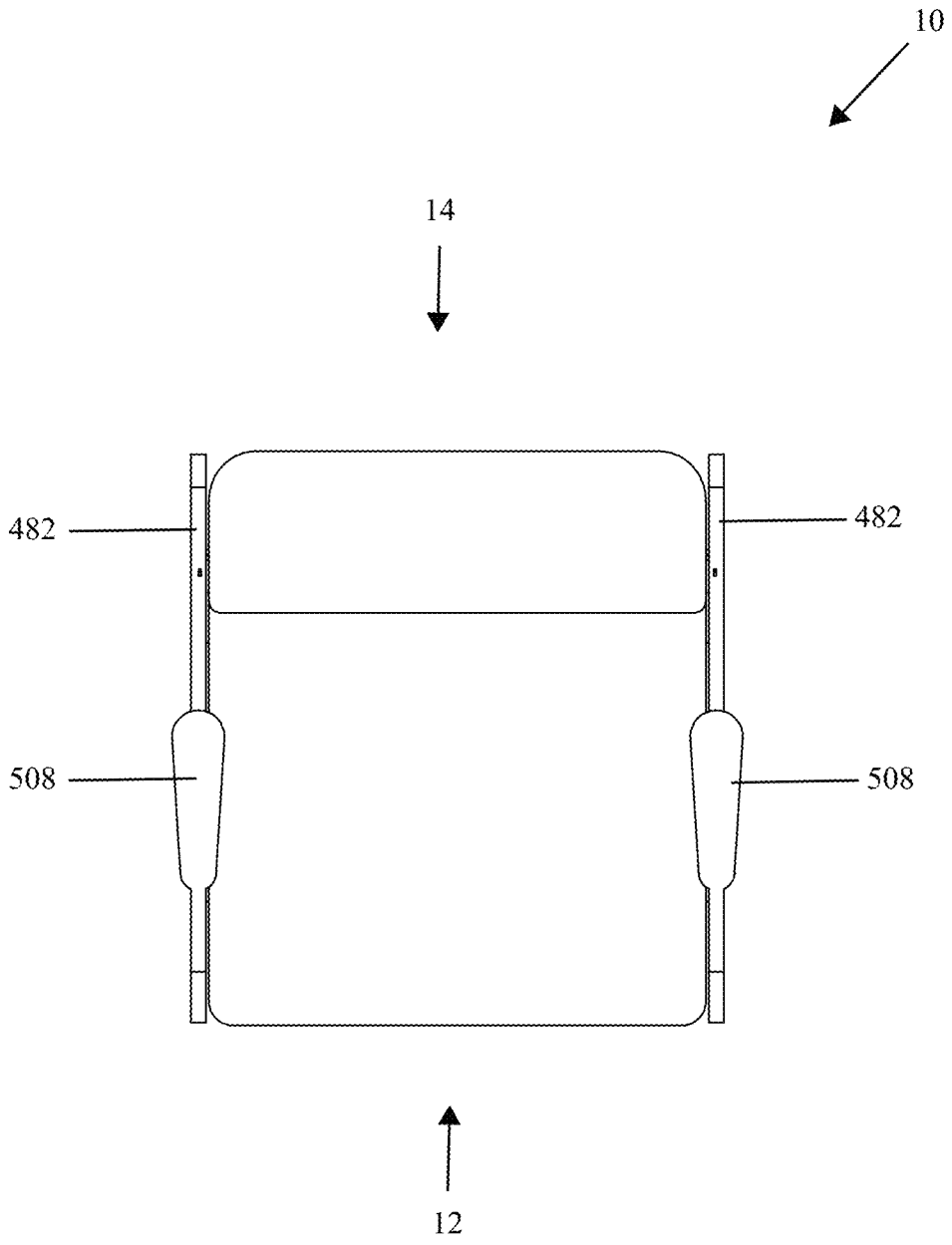
FIG. 51 is a top elevation view of a reclining chair in accordance with one or more arrangements; the view showing the reclining chair having a seat, a backrest, a frame, and arm covers.
Figure 52:
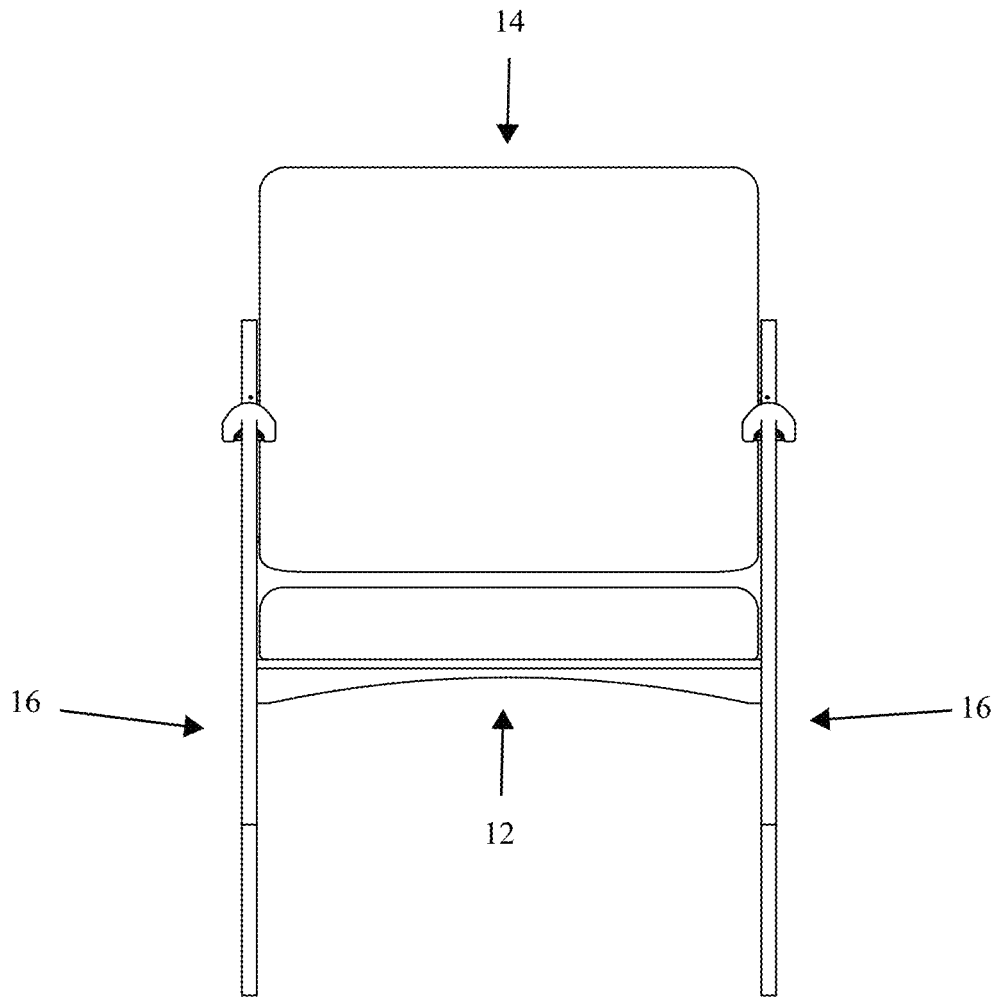
FIG. 52 is a front elevation view of a reclining chair in accordance with one or more arrangements; the view showing the reclining chair having a seat, a backrest, a frame, and arm covers.
Figure 53:
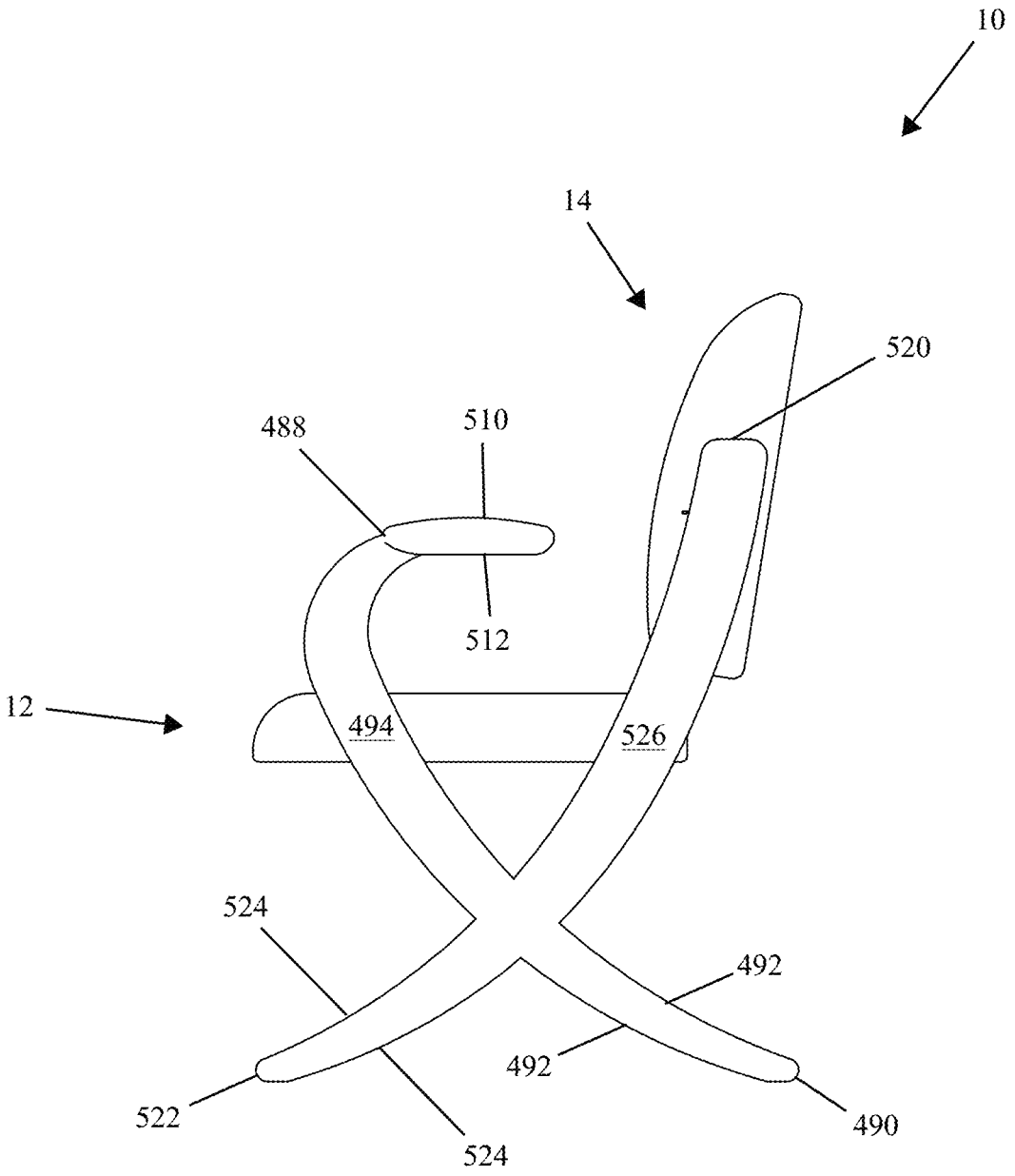
FIG. 53 is a side elevation view of a reclining chair in accordance with one or more arrangements; the view showing the reclining chair having a seat, a backrest, a frame, and arm covers.
Figure 54:
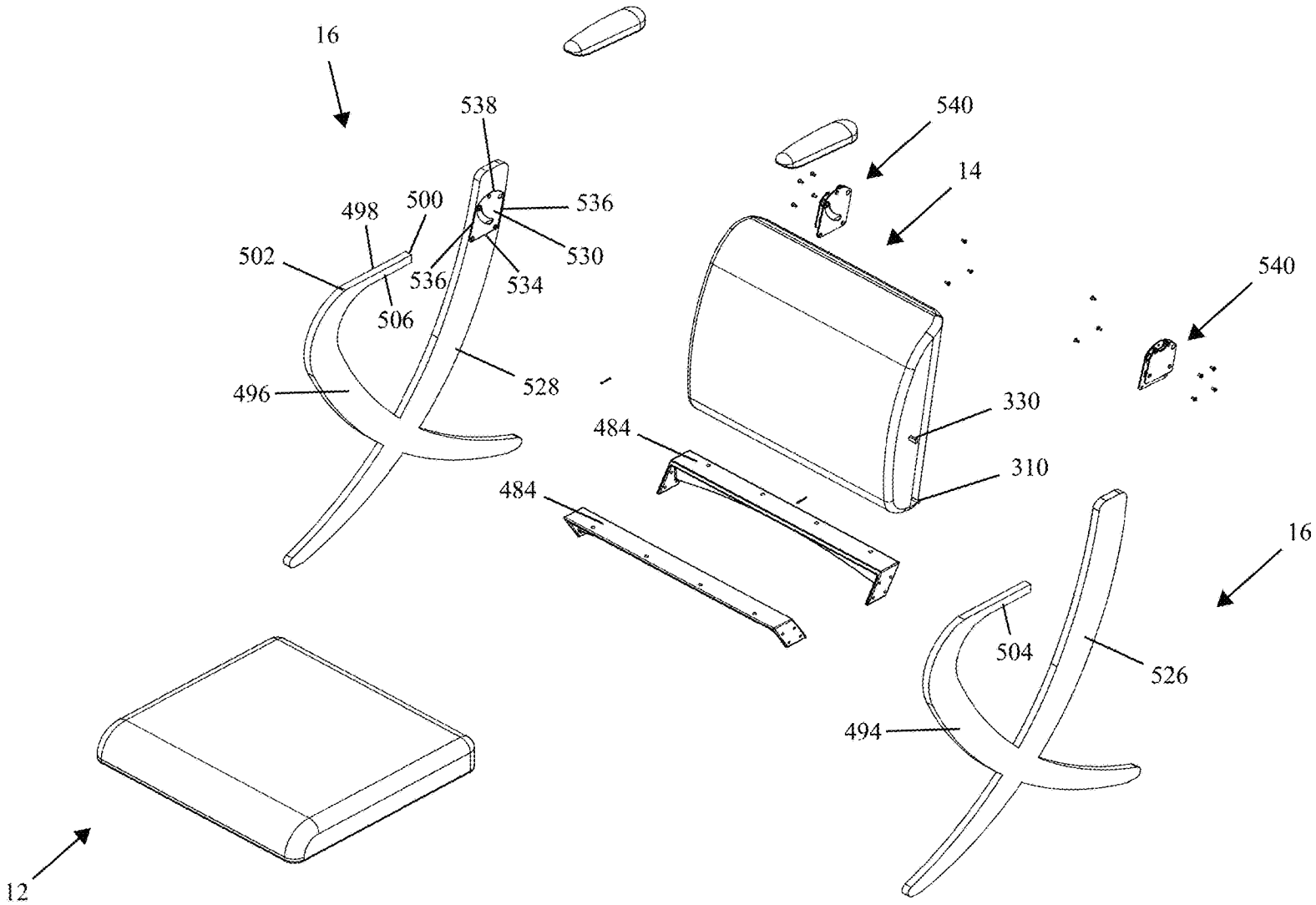
FIG. 54 is an exploded view of a reclining chair in accordance with one or more arrangements; the view showing the reclining chair having a seat, a backrest, a frame, arm covers, and cartridges.
Figure 55:
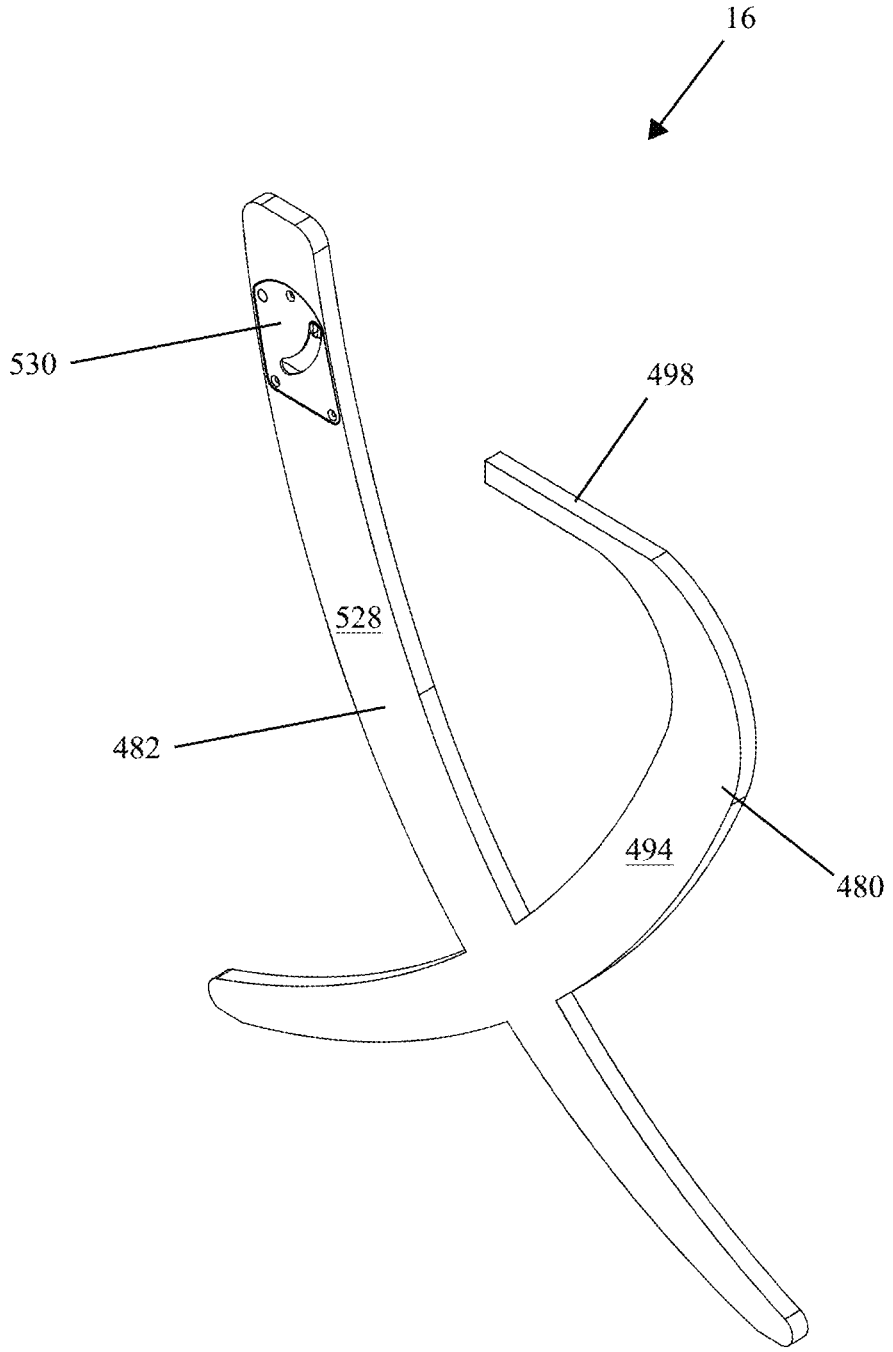
FIG. 55 is a perspective view of a frame of a reclining chair in accordance with one or more arrangements; the view showing the frame having a first leg with an arm and a second leg with a pocket on the inner surface of the second leg.
Figure 56:
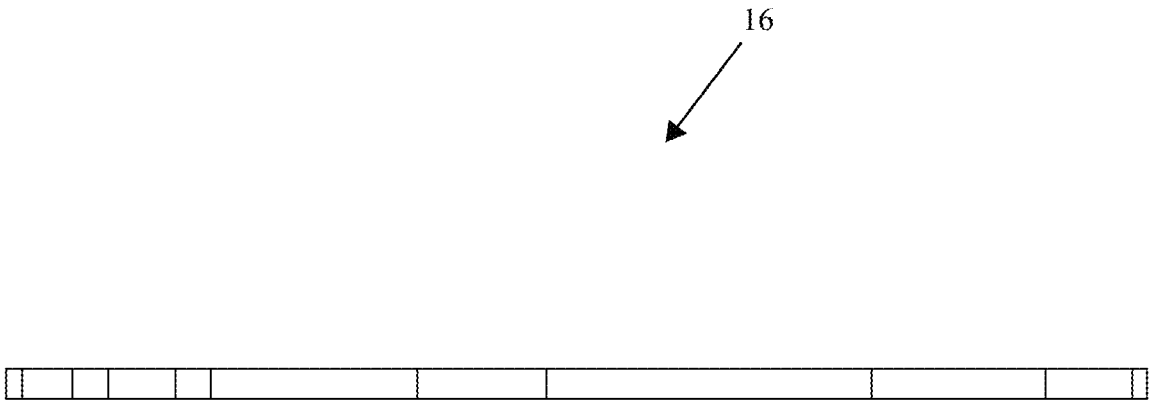
FIG. 56 is a top elevation view of a frame of a reclining chair in accordance with one or more arrangements.
Figure 57:
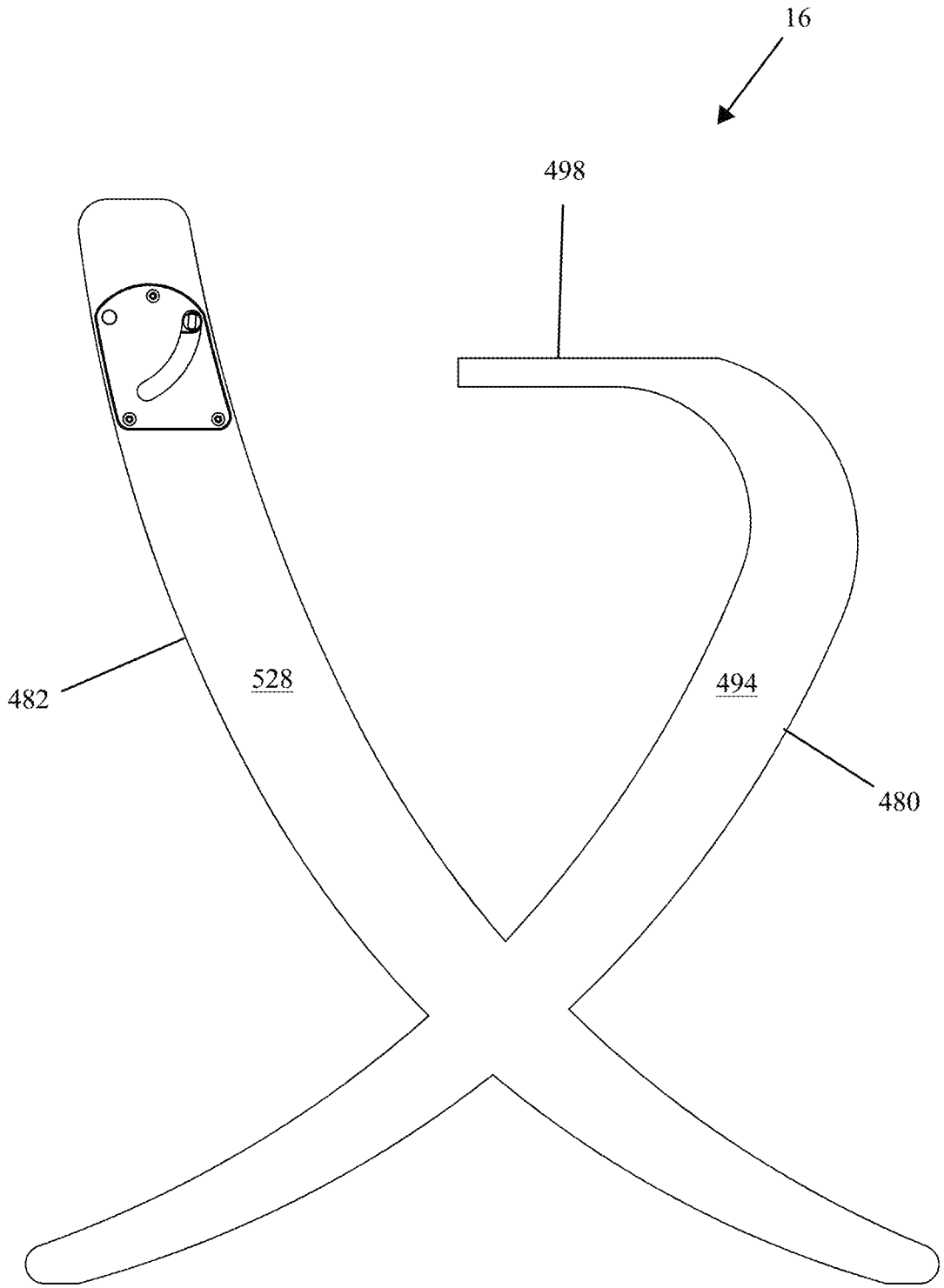
FIG. 57 is a side elevation view of a frame of a reclining chair in accordance with one or more arrangements; the view showing the frame having a first leg with an arm and a second leg with a pocket on the inner surface of the second leg.
Figure 58:
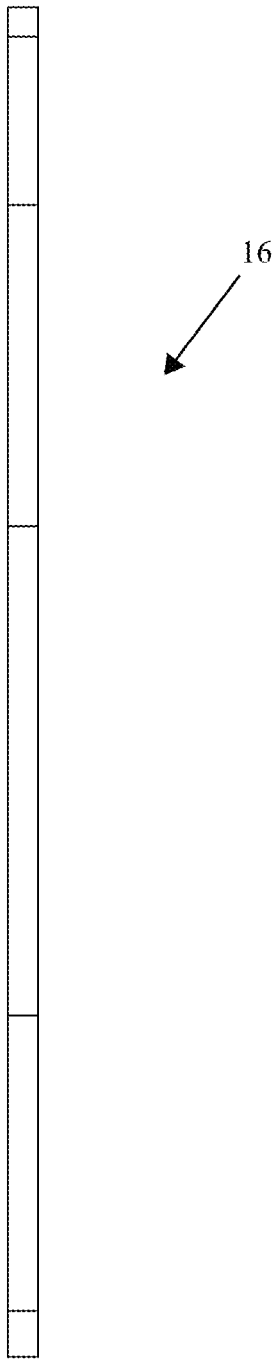
FIG. 58 is a front elevation view of a frame of a reclining chair in accordance with one or more arrangements.
Figure 59:
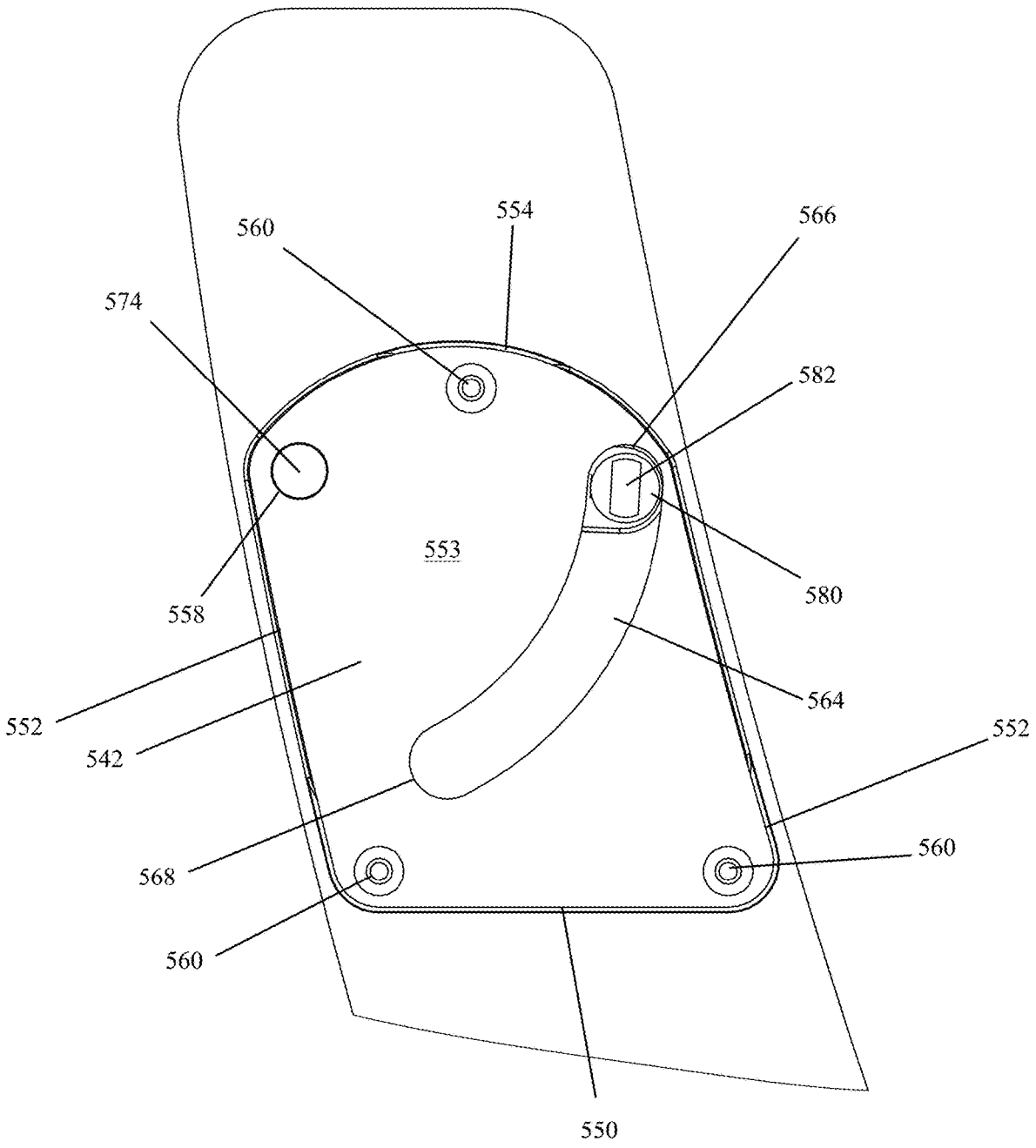
FIG. 59 is a detail view of a reclining chair in accordance with one or more arrangements; the view showing the reclining chair having a frame with a pocket therein and a cartridge positioned within the pocket of the frame; the view showing the cartridge having a front plate with a slot and an articulating link with a reception member configured to move along the slot in the front plate.
Figure 60:
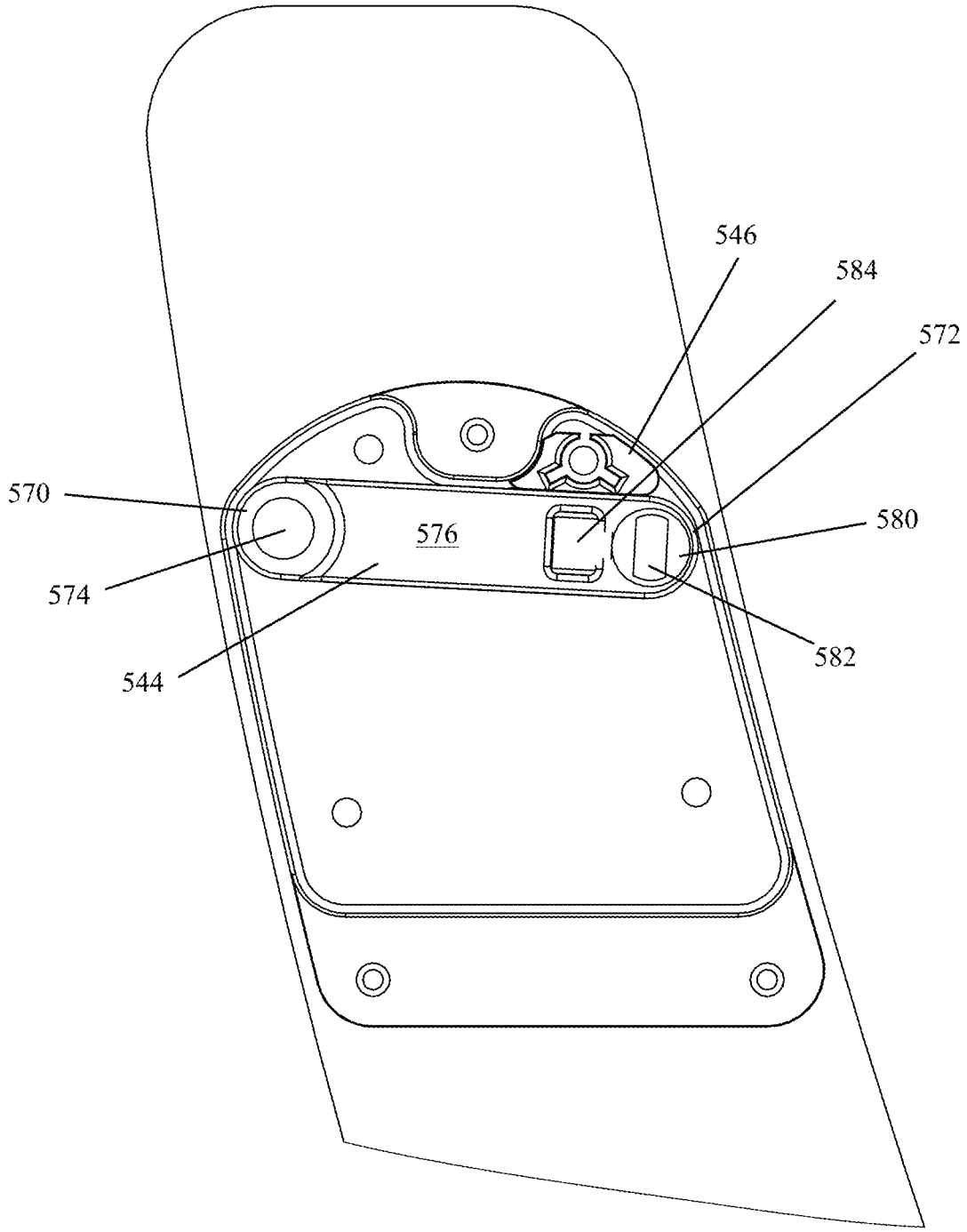
FIG. 60 is a detail view of a reclining chair in accordance with one or more arrangements; the view showing the reclining chair having a frame with a pocket therein and a cartridge positioned within the pocket of the frame; the view showing the cartridge having a an articulating link and a bumper; the view also showing the articulating link having a node and a reception member with a recess.
Figure 61:
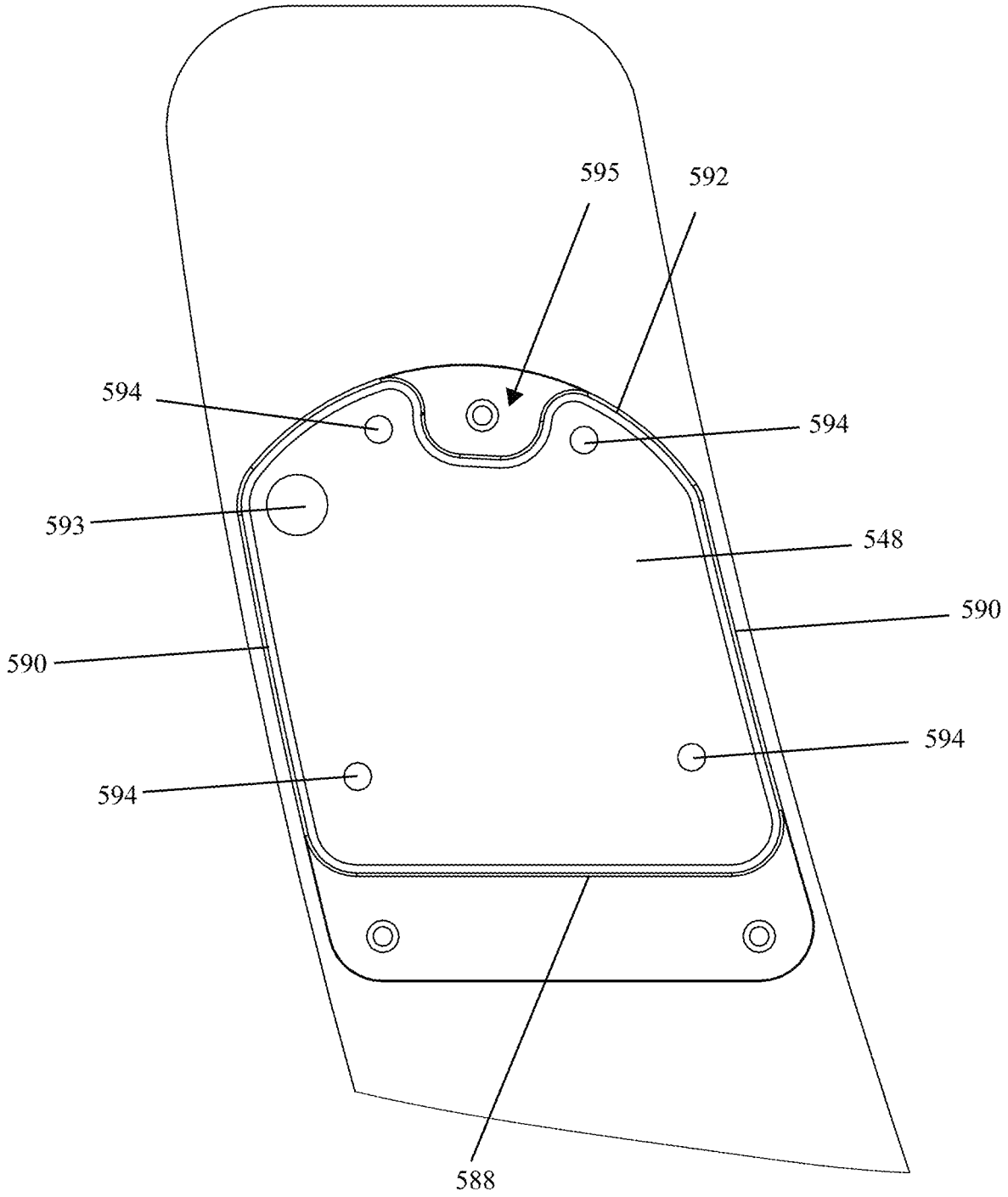
FIG. 61 is a detail view of a reclining chair in accordance with one or more arrangements; the view showing the reclining chair having a frame with a pocket therein and a cartridge positioned within the pocket of the frame; the view showing the cartridge having a back plate having a bottom edge, opposing sides, a top edge, and a recess within the top edge.
Figure 62:
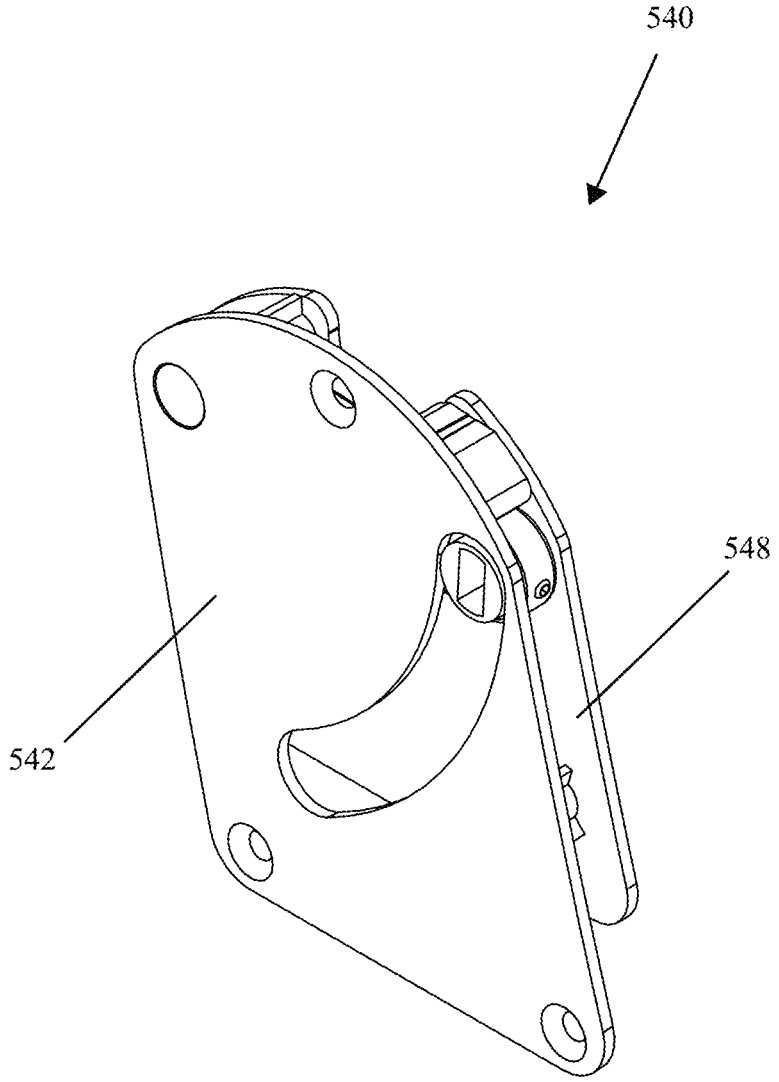
FIG. 62 is a perspective view of a cartridge of a reclining chair in accordance with one or more arrangements; the view showing the cartridge having a front plate and a back plate.
Figure 63:
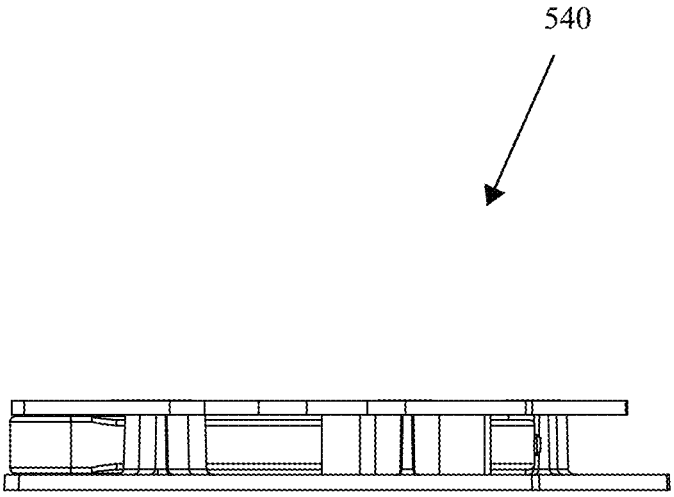
FIG. 63 is a top elevation view of a cartridge of a reclining chair in accordance with one or more arrangements.
Figure 64:
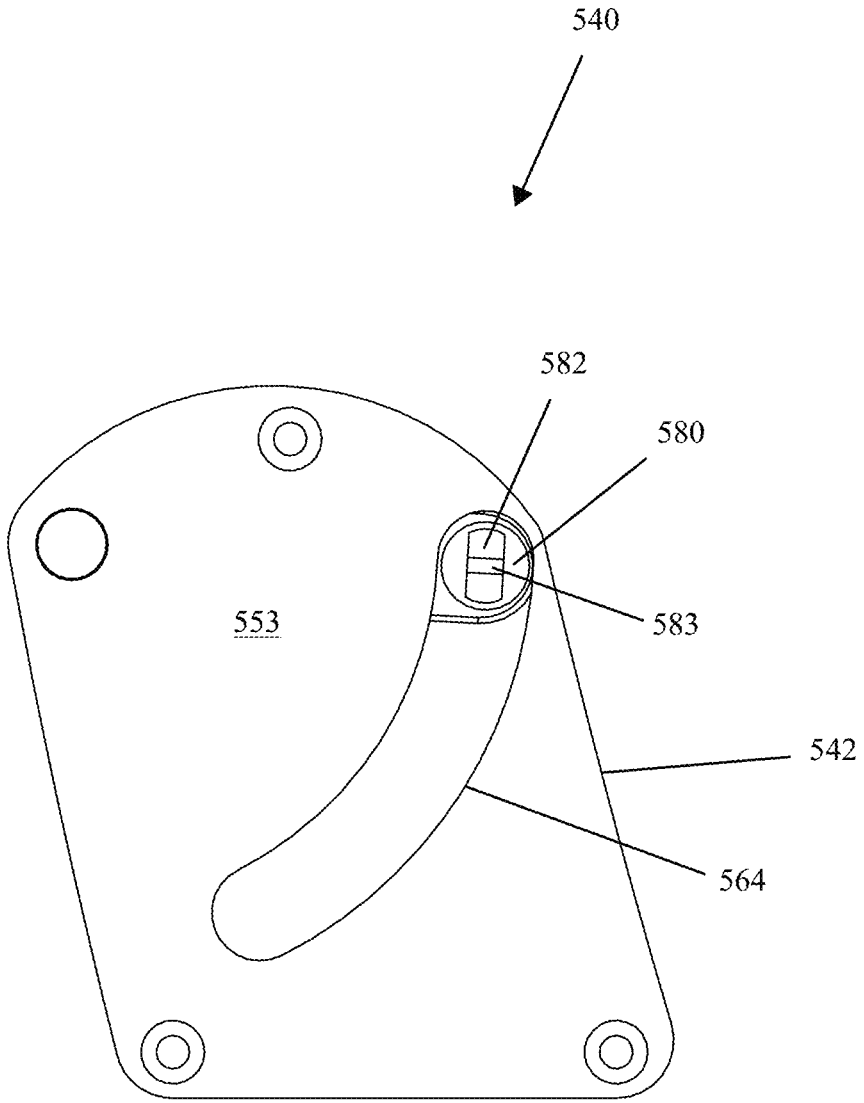
FIG. 64 is a front elevation view of a cartridge of a reclining chair in accordance with one or more arrangements; the view showing the cartridge having a front plate with a slot and an articulating link with a reception member configured to move along the slot in the front plate.
Figure 65:
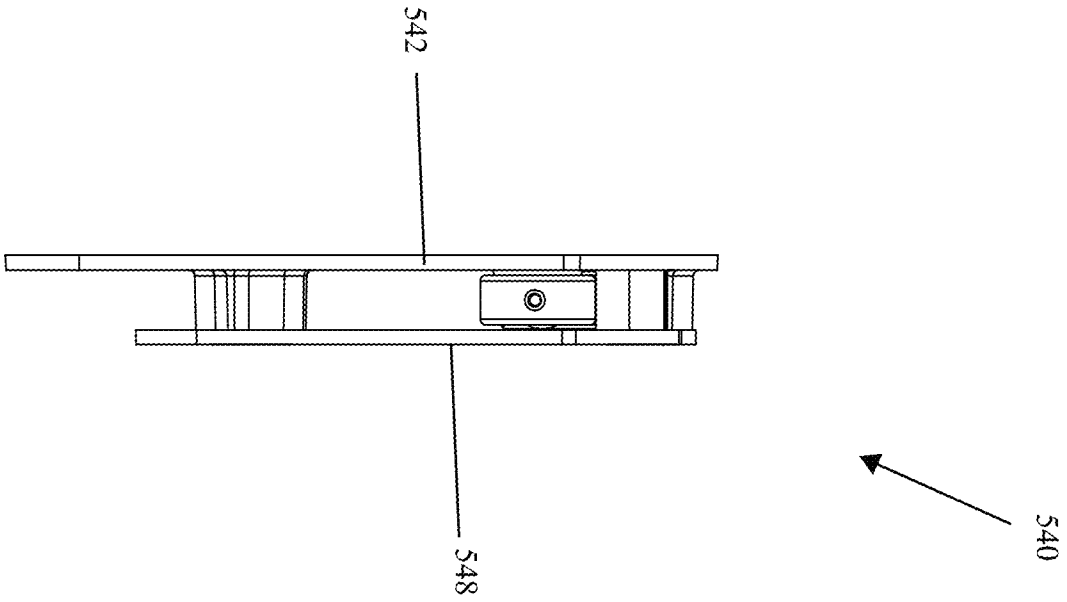
FIG. 65 is a side elevation view of a cartridge of a reclining chair in accordance with one or more arrangements.
Figure 66:
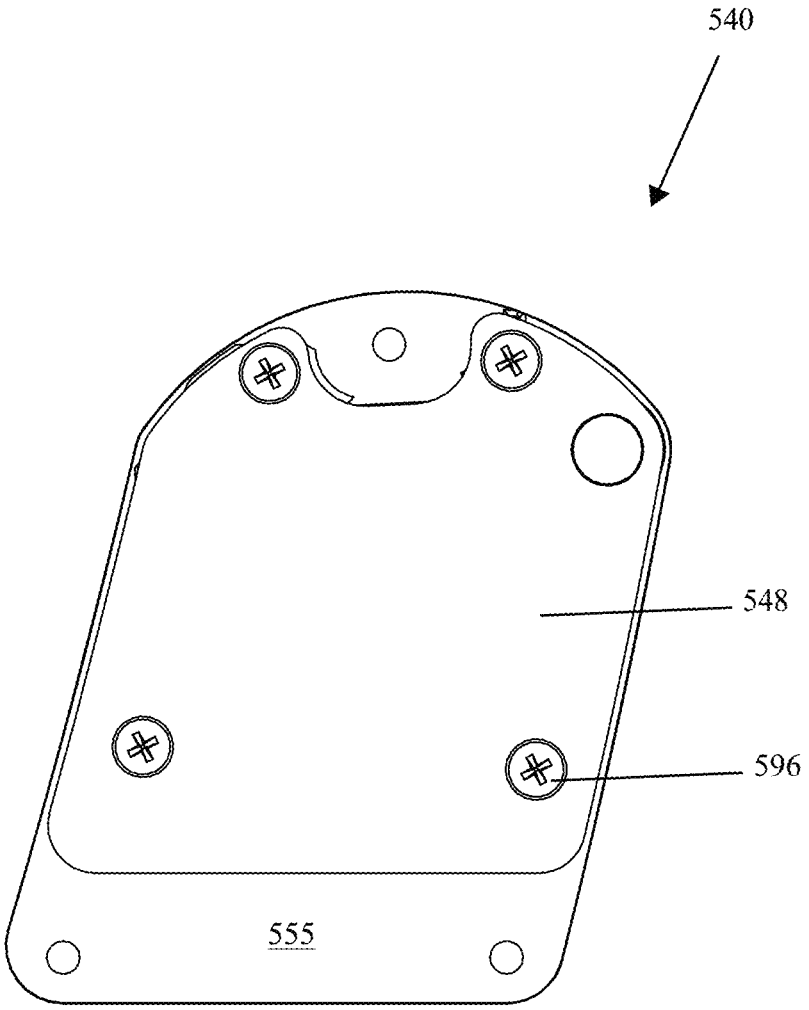
FIG. 66 is a back elevation view of a cartridge of a reclining chair in accordance with one or more arrangements; the view showing the cartridge having a back plate, a front plate, and fasteners.
Figure 67:
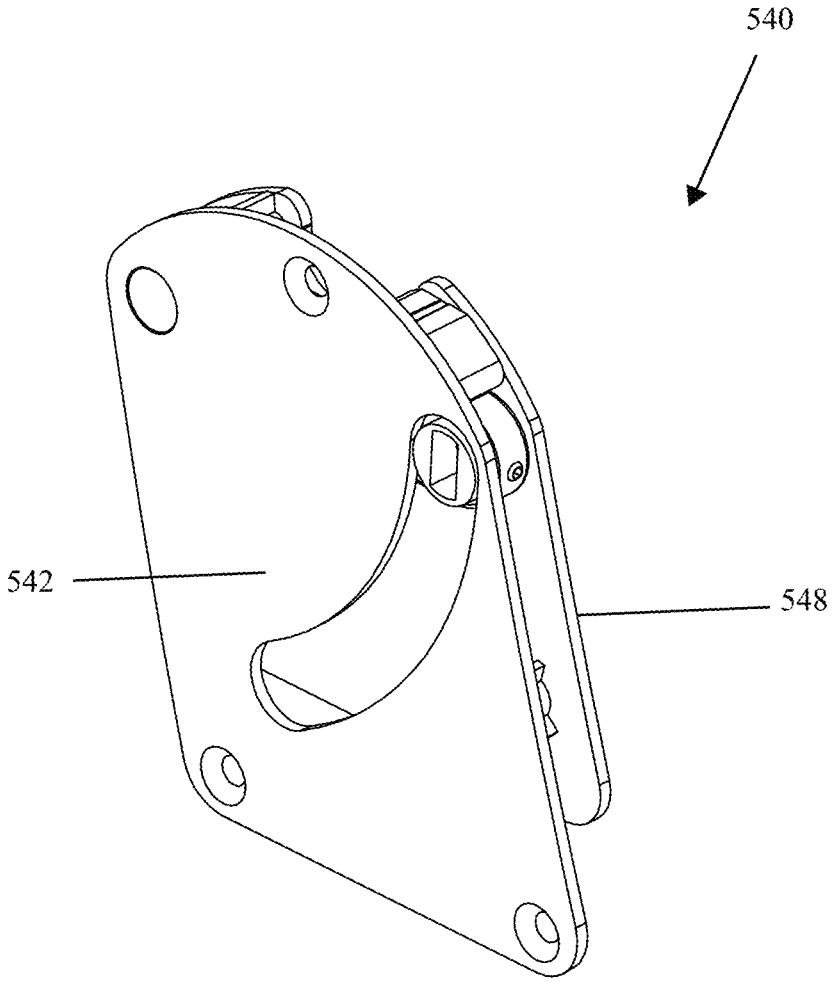
FIG. 67 is a perspective view of a cartridge of a reclining chair in accordance with one or more arrangements; the view showing the cartridge having a front plate and a back plate.
Figure 68:
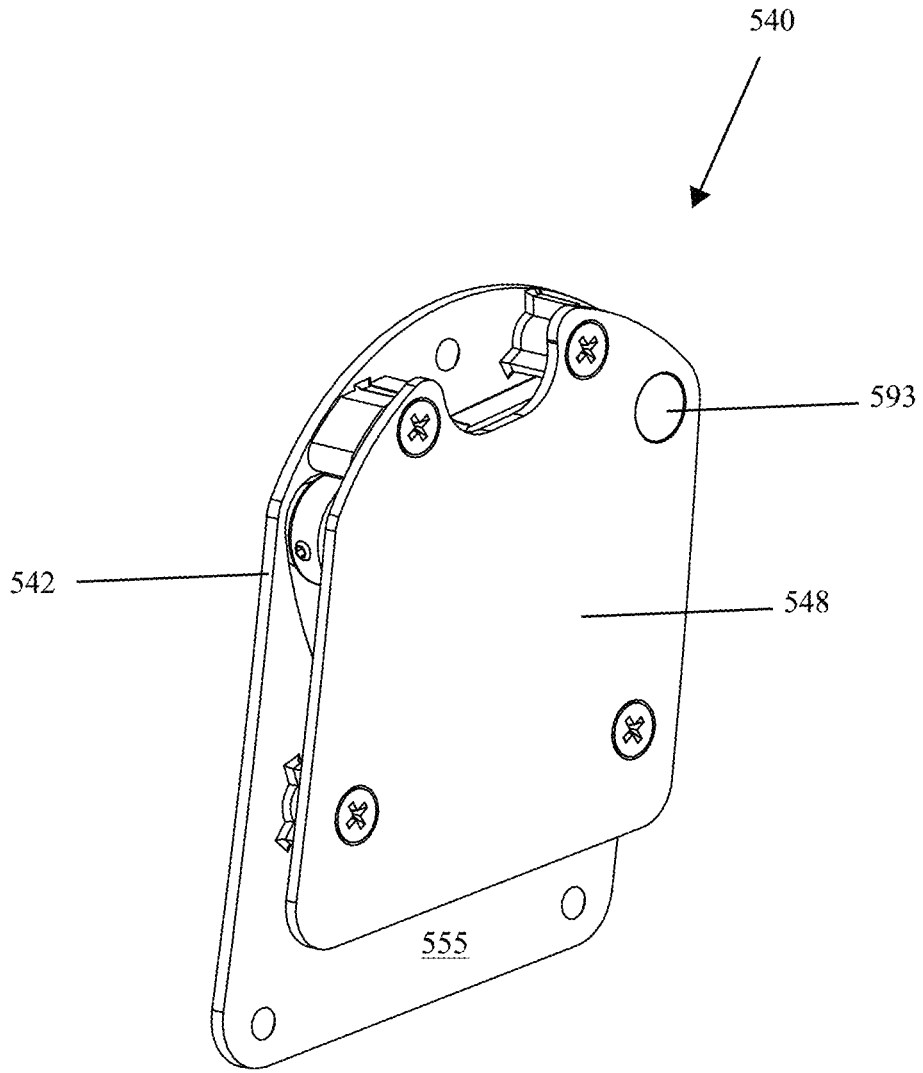
FIG. 68 is a rear perspective view of a cartridge of a reclining chair in accordance with one or more arrangements; the view showing the cartridge having a front plate and a back plate.
Figure 69:
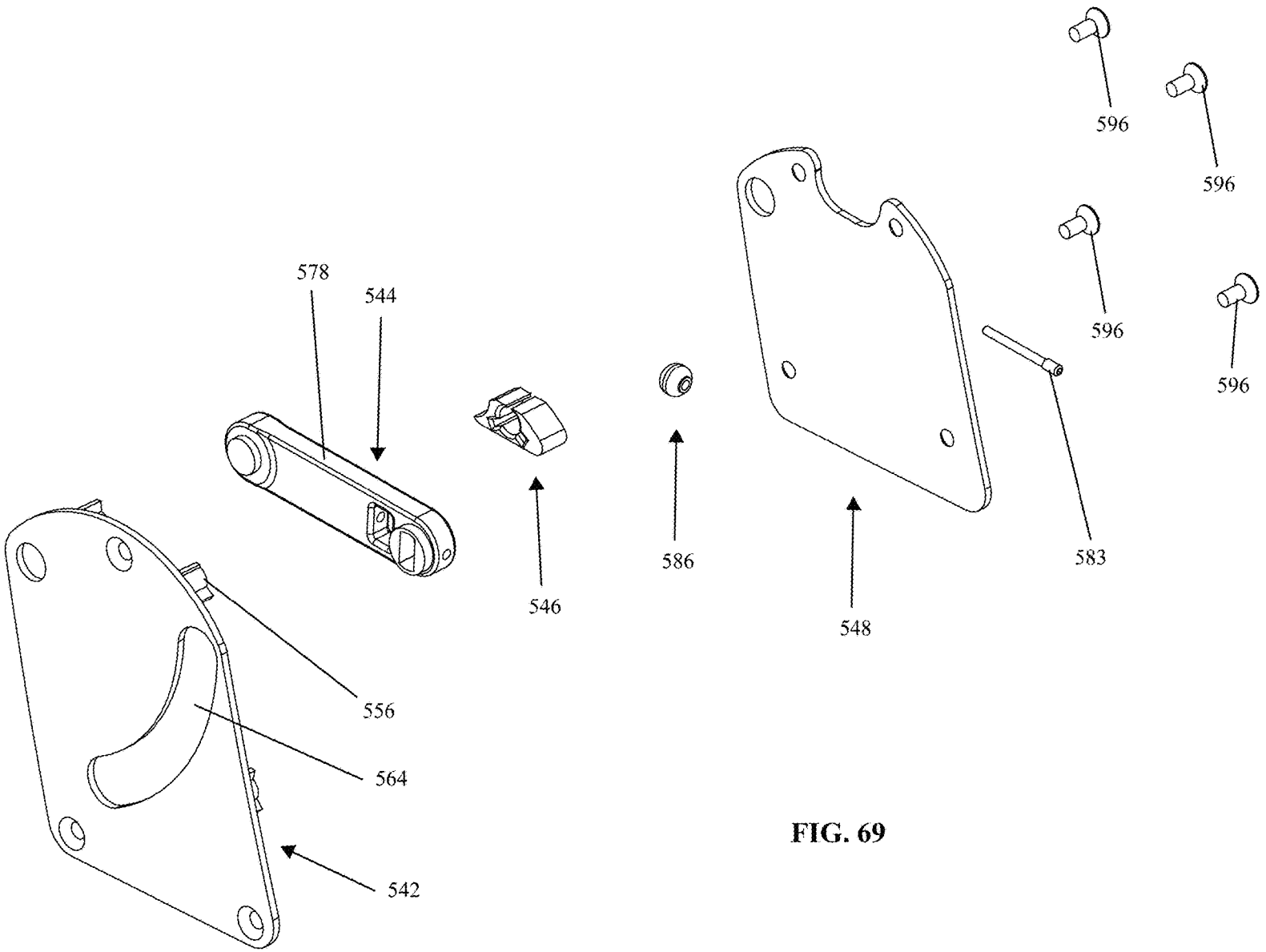
FIG. 69 is an exploded view of a cartridge of a reclining chair in accordance with one or more arrangements; the view showing the cartridge having a front plate with a slot, an articulating link, a bumper, a guide wheel, a back plate, a pin, and fasteners.
Figure 70:
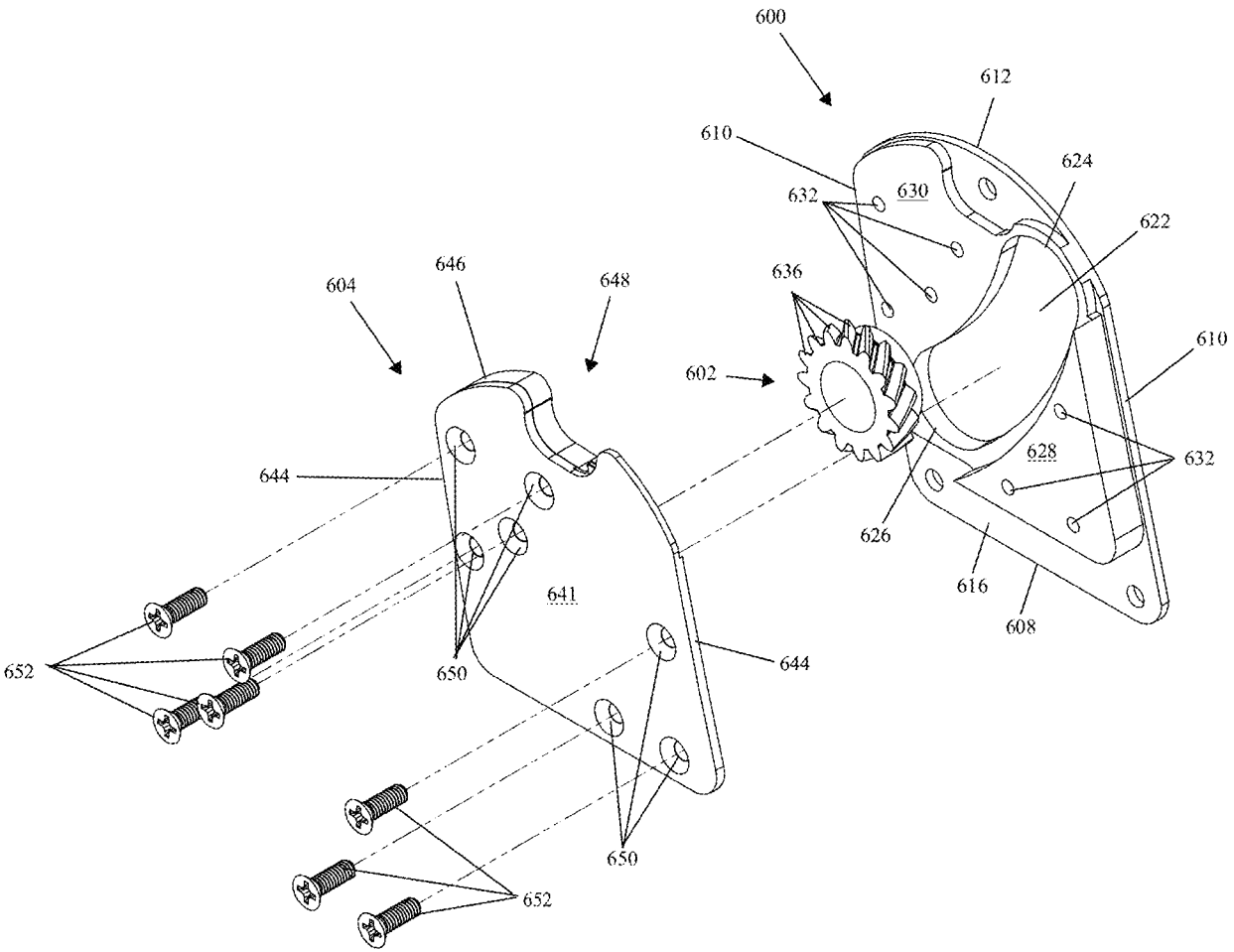
FIG. 70 is an exploded view of a cartridge of a reclining chair in accordance with one or more arrangements; the view showing the cartridge having a front plate with a slot, a gear with teeth, and a back plate.
Figure 71:
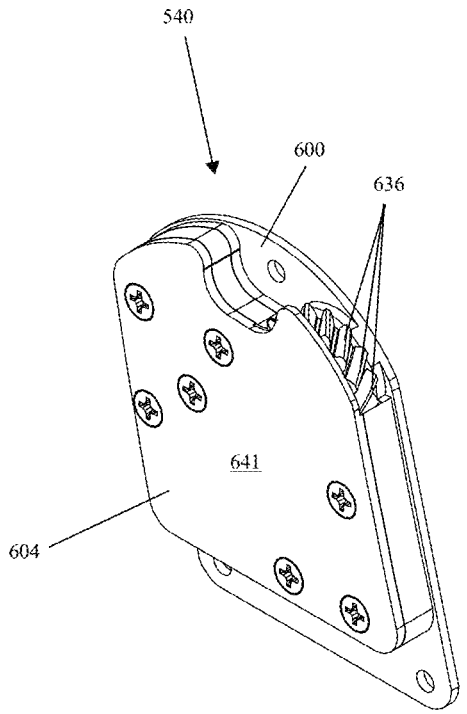
FIG. 71 is a rear perspective view of a cartridge of a reclining chair in accordance with one or more arrangements; the view showing the cartridge having a front plate a gear with teeth, and a back plate.
Figure 72:
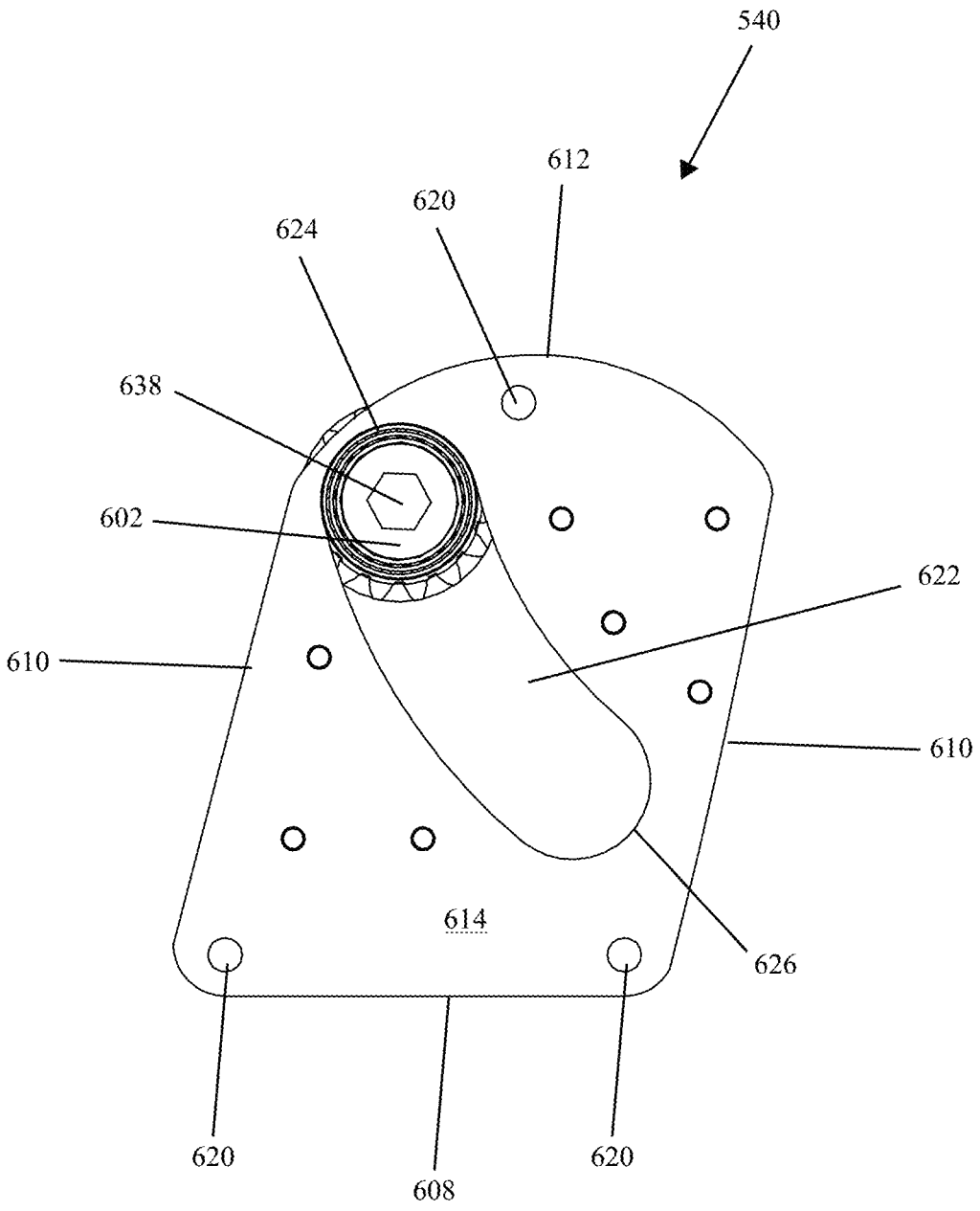
FIG. 72 is a front elevation view of a cartridge of a reclining chair in accordance with one or more arrangements; the view showing the cartridge having a front plate with a slot, and a gear with an engagement feature configured to move within the slot of the front plate.
Figure 73:
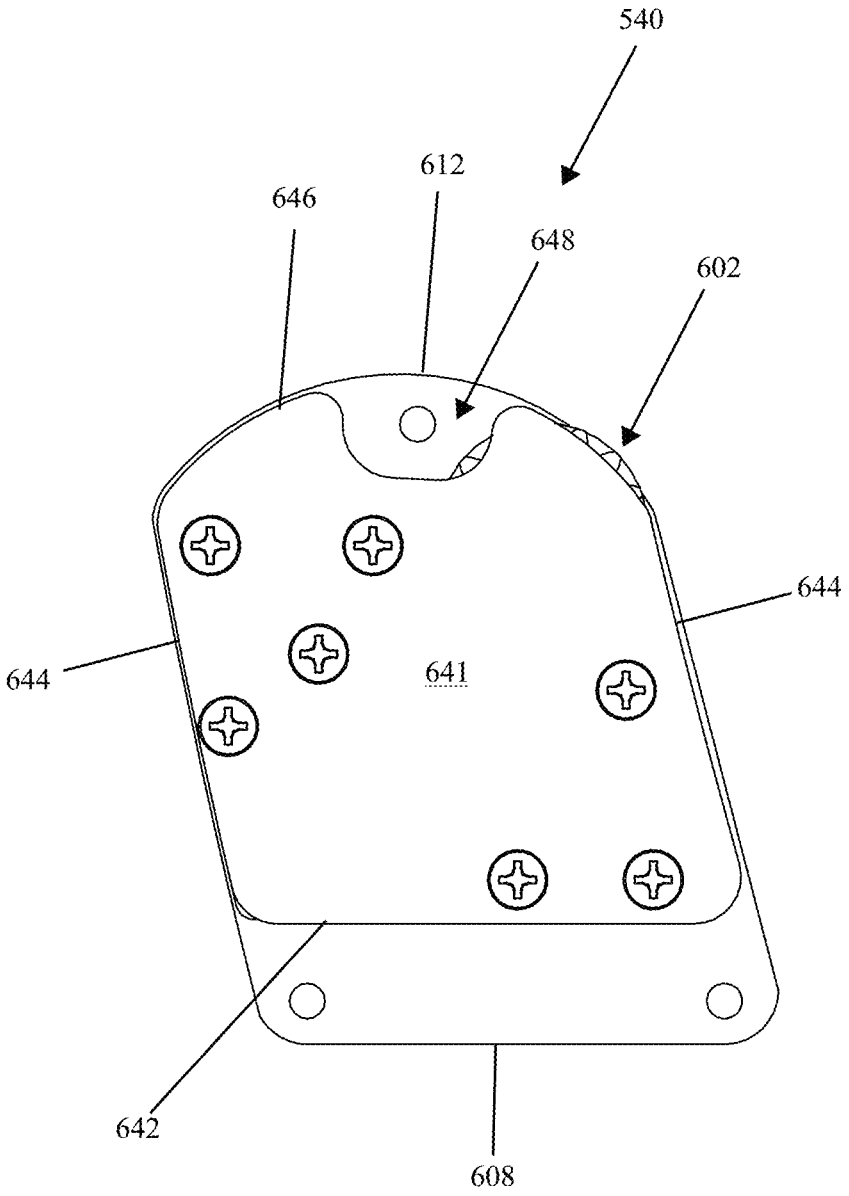
FIG. 73 is a back elevation view of a cartridge of a reclining chair in accordance with one or more arrangements; the view showing the cartridge having a front plate, a gear, and a back plate with a top edge having a recess therein.
Figure 74:
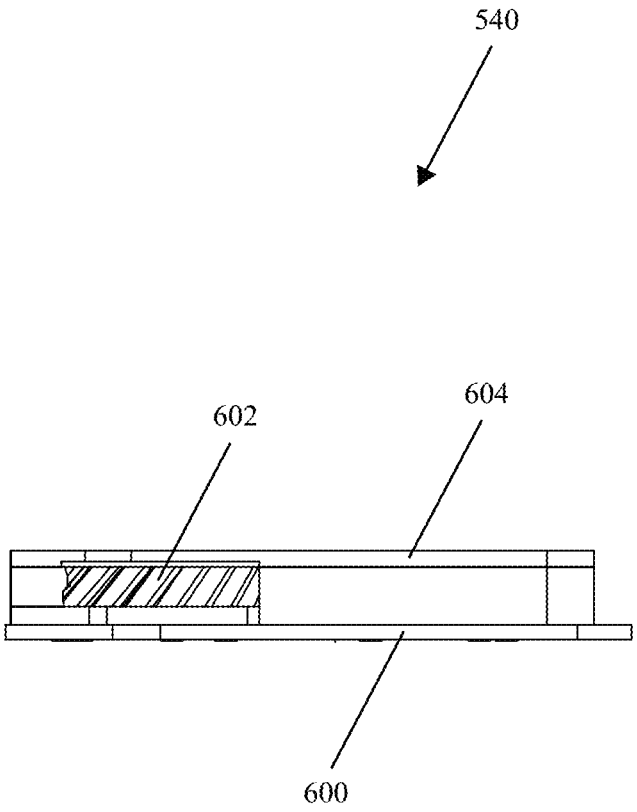
FIG. 74 is a top elevation view of a cartridge of a reclining chair in accordance with one or more arrangements; the view showing the cartridge having a front plate, a gear, and a back plate.
Figure 75:
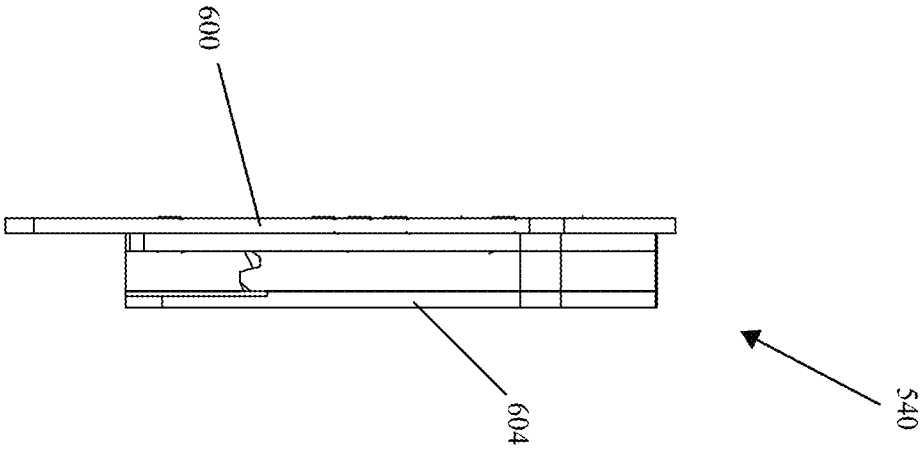
FIG. 75 is a side elevation view of a cartridge of a reclining chair in accordance with one or more arrangements; the view showing the cartridge having a front plate and a back plate.
Figure 76:
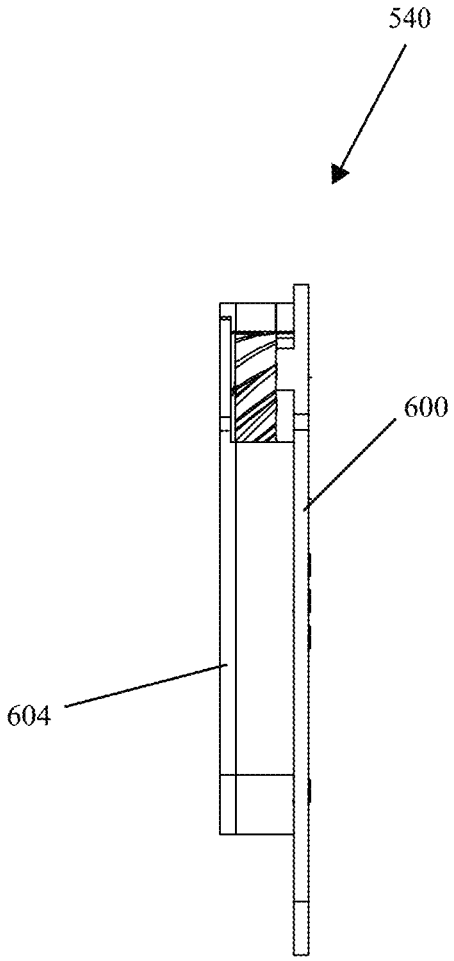
FIG. 76 is another side elevation view of a cartridge of a reclining chair in accordance with one or more arrangements; the view showing the cartridge having a front plate and a back plate.
Figure 77:
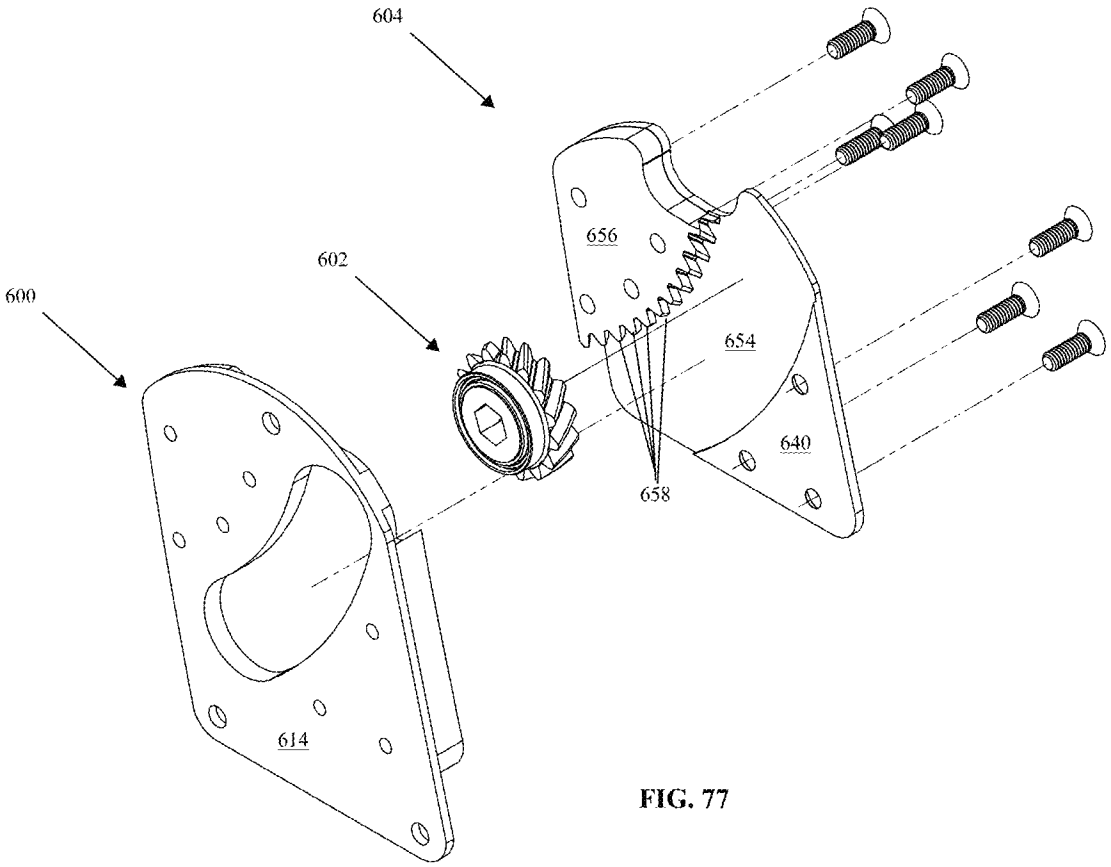
FIG. 77 is an exploded view of a cartridge of a reclining chair in accordance with one or more arrangements; the view showing the cartridge having a front plate with a slot, a gear with teeth, and a back plate having a protruded surface with teeth configured to engage with the teeth of the gear.
Figure 78:
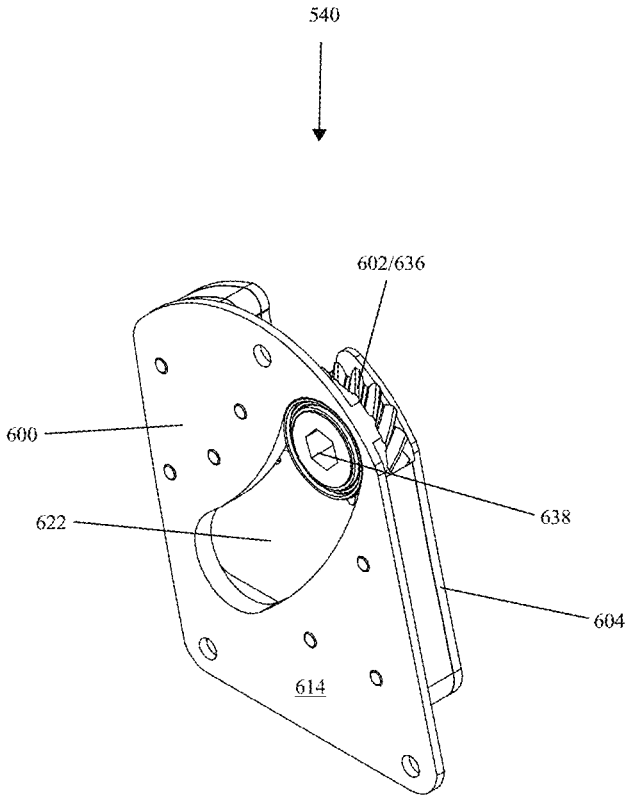
FIG. 78 is a perspective view of a cartridge of a reclining chair in accordance with one or more arrangements; the view showing the cartridge having a front plate with a slot, a gear with teeth and an engagement feature configured to move within the slot of the front plate, and a back plate.
Figure 79:
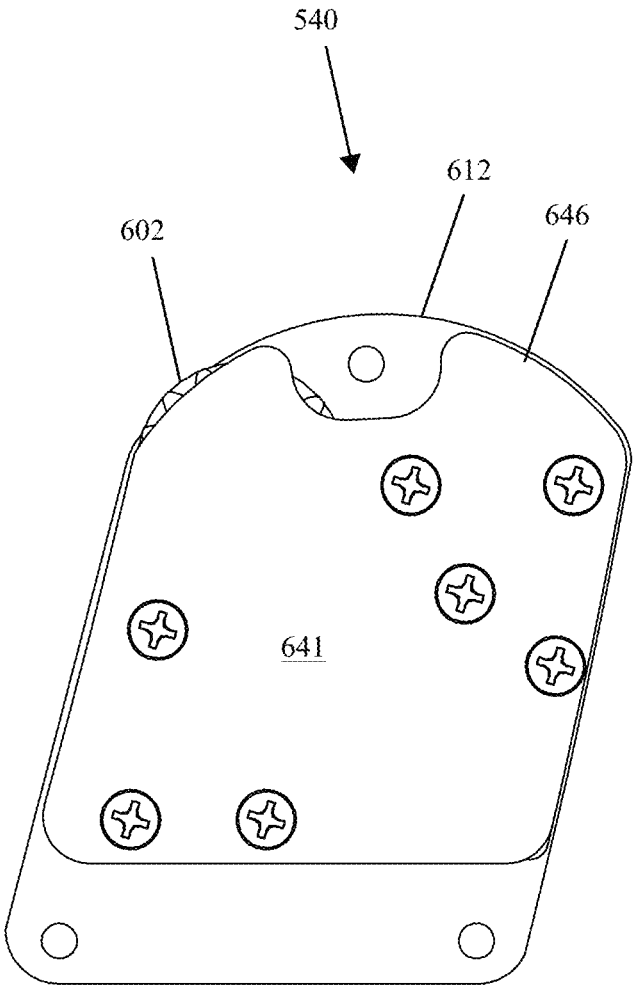
FIG. 79 is a back elevation view of a cartridge of a reclining chair in accordance with one or more arrangements; the view showing the cartridge having a front plate, a gear, and a back plate with a top edge having a recess therein.
Figure 80:
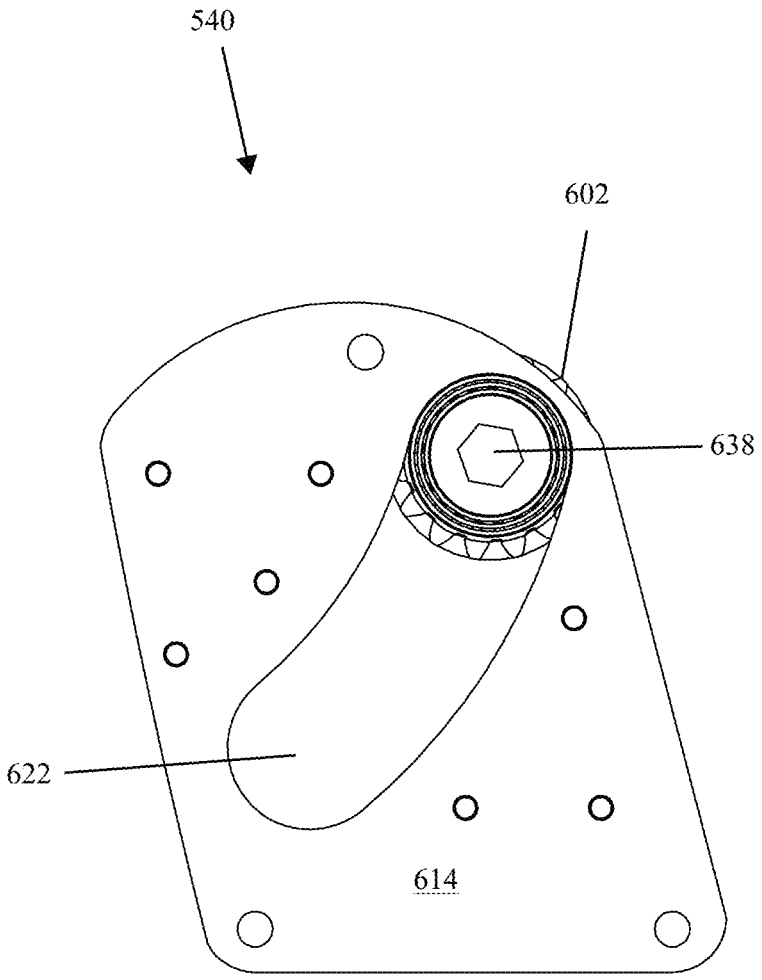
FIG. 80 is a front elevation view of a cartridge of a reclining chair in accordance with one or more arrangements; the view showing the cartridge having a front plate with a slot, and a gear with an engagement feature configured to move within the slot of the front plate.
Figure 81:
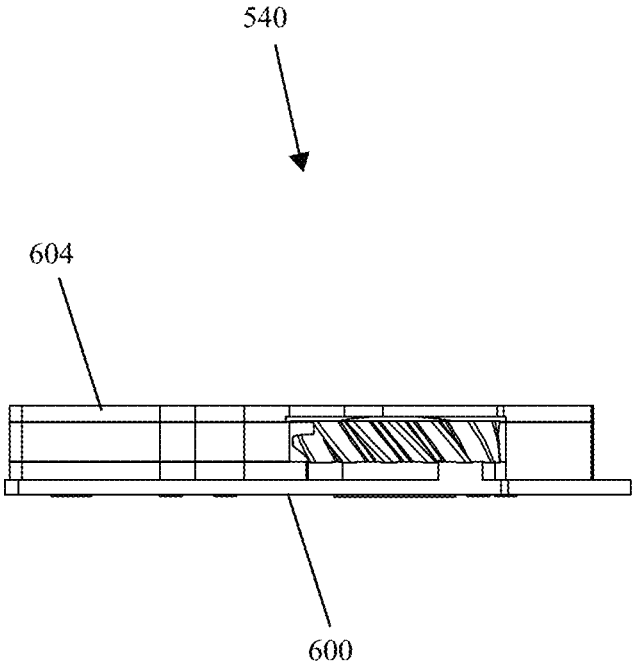
FIG. 81 is a top elevation view of a cartridge of a reclining chair in accordance with one or more arrangements; the view showing the cartridge having a front plate, a gear, and a back plate.
Figure 82:
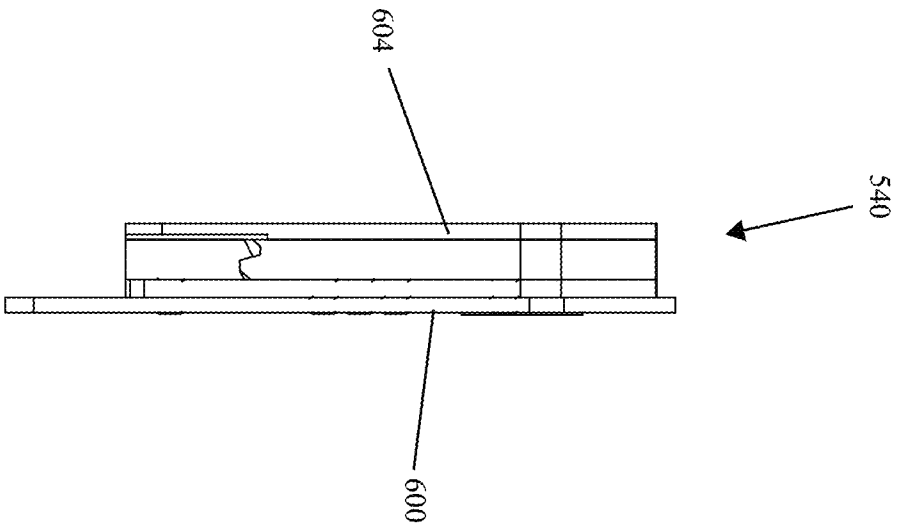
FIG. 82 is a side elevation view of a cartridge of a reclining chair in accordance with one or more arrangements; the view showing the cartridge having a front plate and a back plate.
Figure 83:
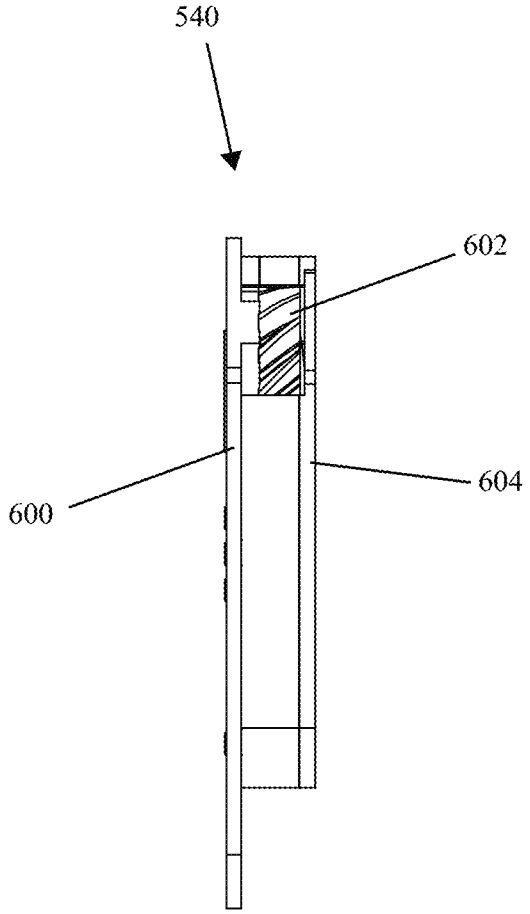
FIG. 83 is another side elevation view of a cartridge of a reclining chair in accordance with one or more arrangements; the view showing the cartridge having a front plate, a gear, and a back plate.
Figure 84:
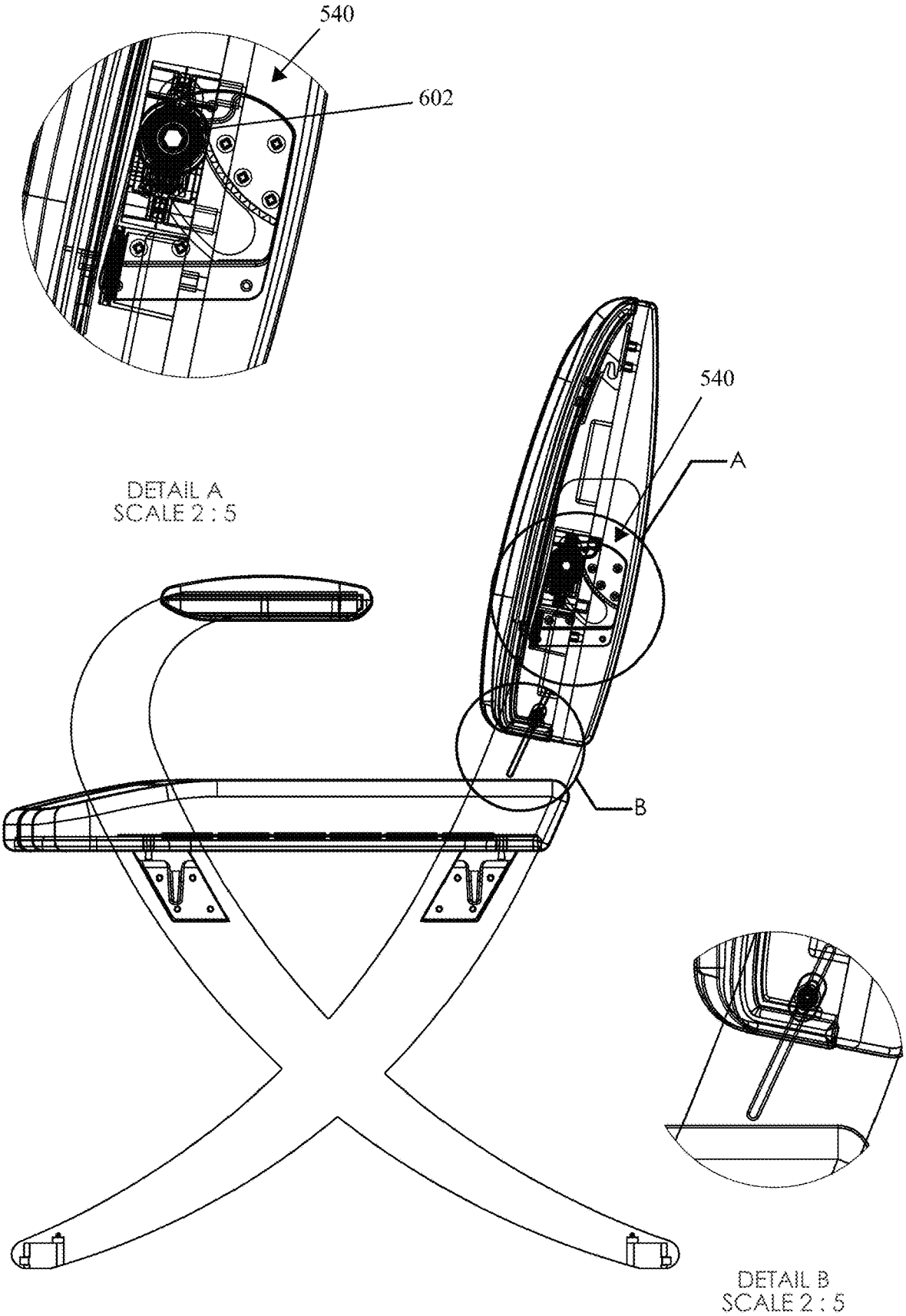
FIG. 84 is a section view of a reclining chair in accordance with one or more arrangements; the view showing the chair having a frame with a pocket and a cartridge positioned within the pocket; the view also showing the chair in an primarily upright position.
Figure 85:
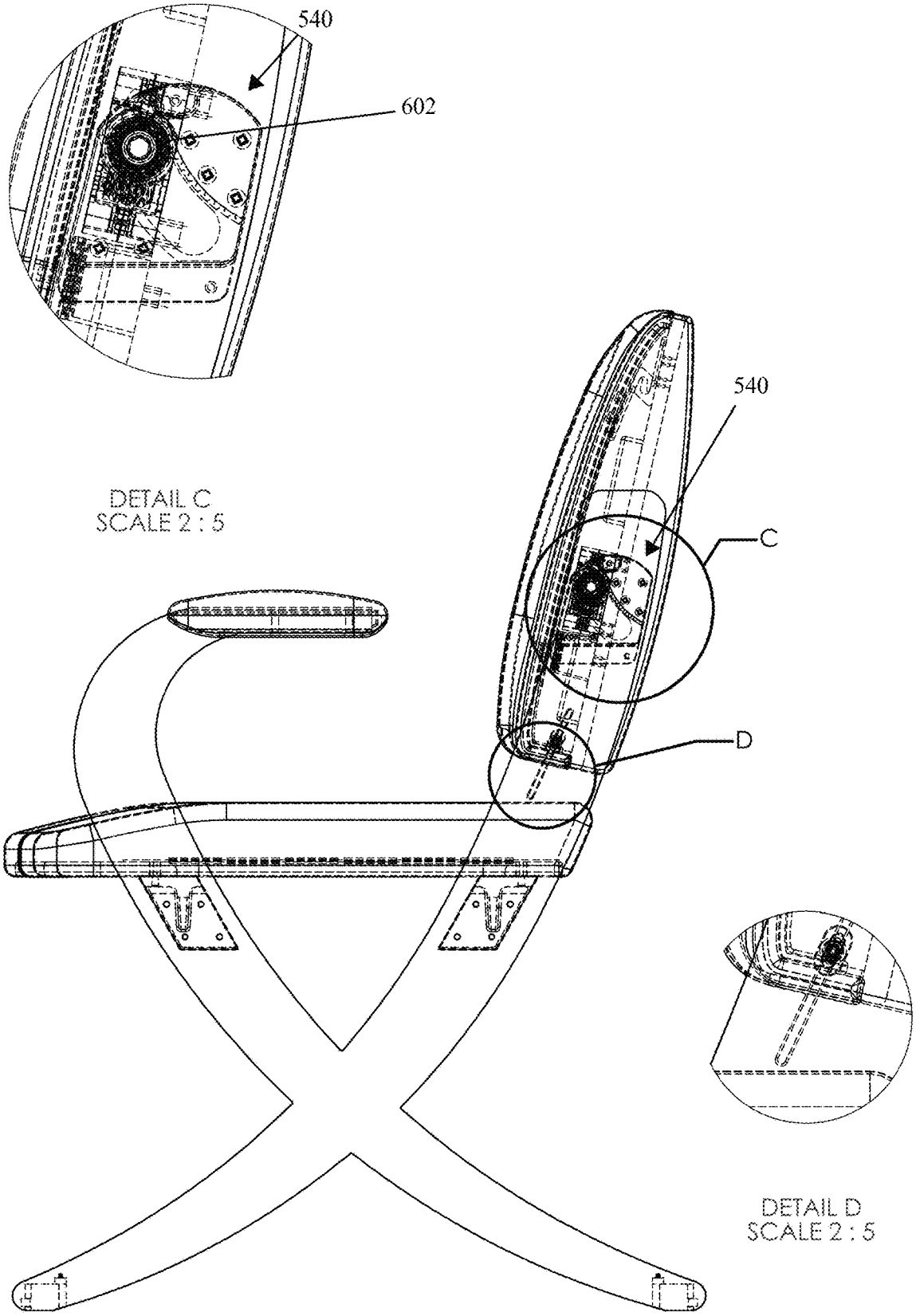
FIG. 85 is a section view of a reclining chair in accordance with one or more arrangements; the view showing the chair having a frame with a pocket and a cartridge positioned within the pocket; the view also showing the chair in a partially reclined position.
Figure 86:
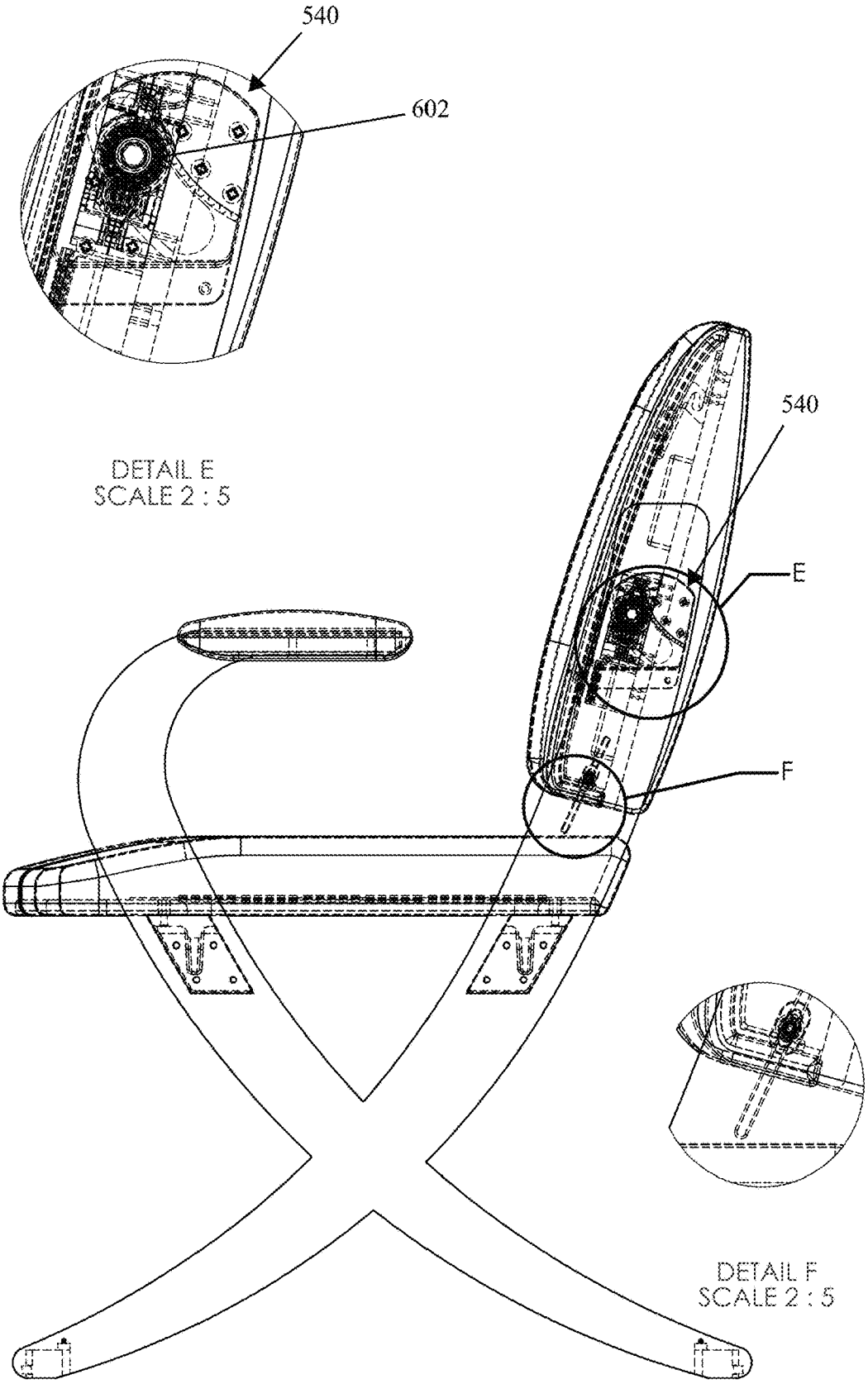
FIG. 86 is a section view of a reclining chair in accordance with one or more arrangements; the view showing the chair having a frame with a pocket and a cartridge positioned within the pocket; the view also showing the chair in a partially reclined position.
Figure 87:
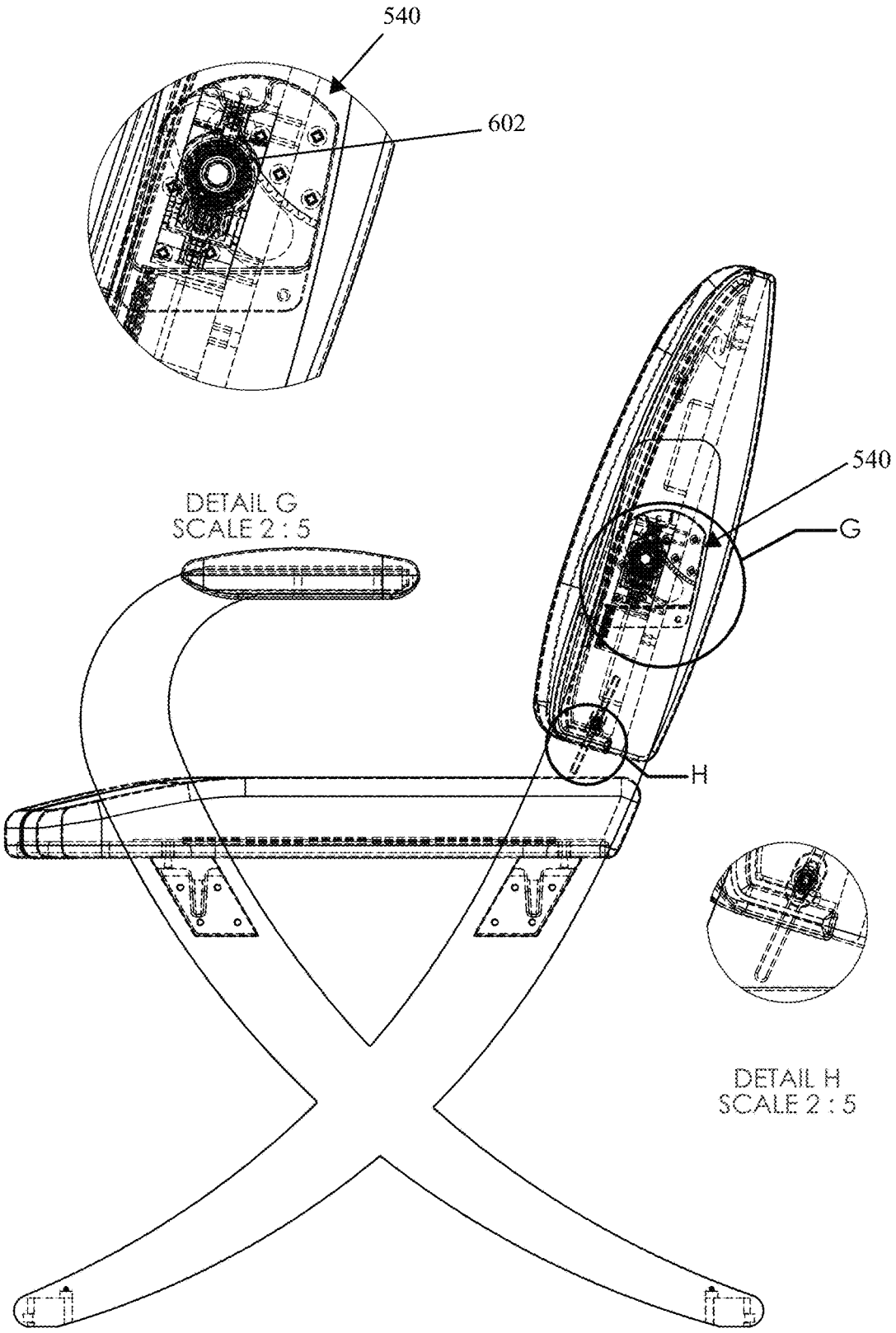
FIG. 87 is a section view of a reclining chair in accordance with one or more arrangements; the view showing the chair having a frame with a pocket and a cartridge positioned within the pocket; the view also showing the chair in a partially reclined position.
Figure 88:
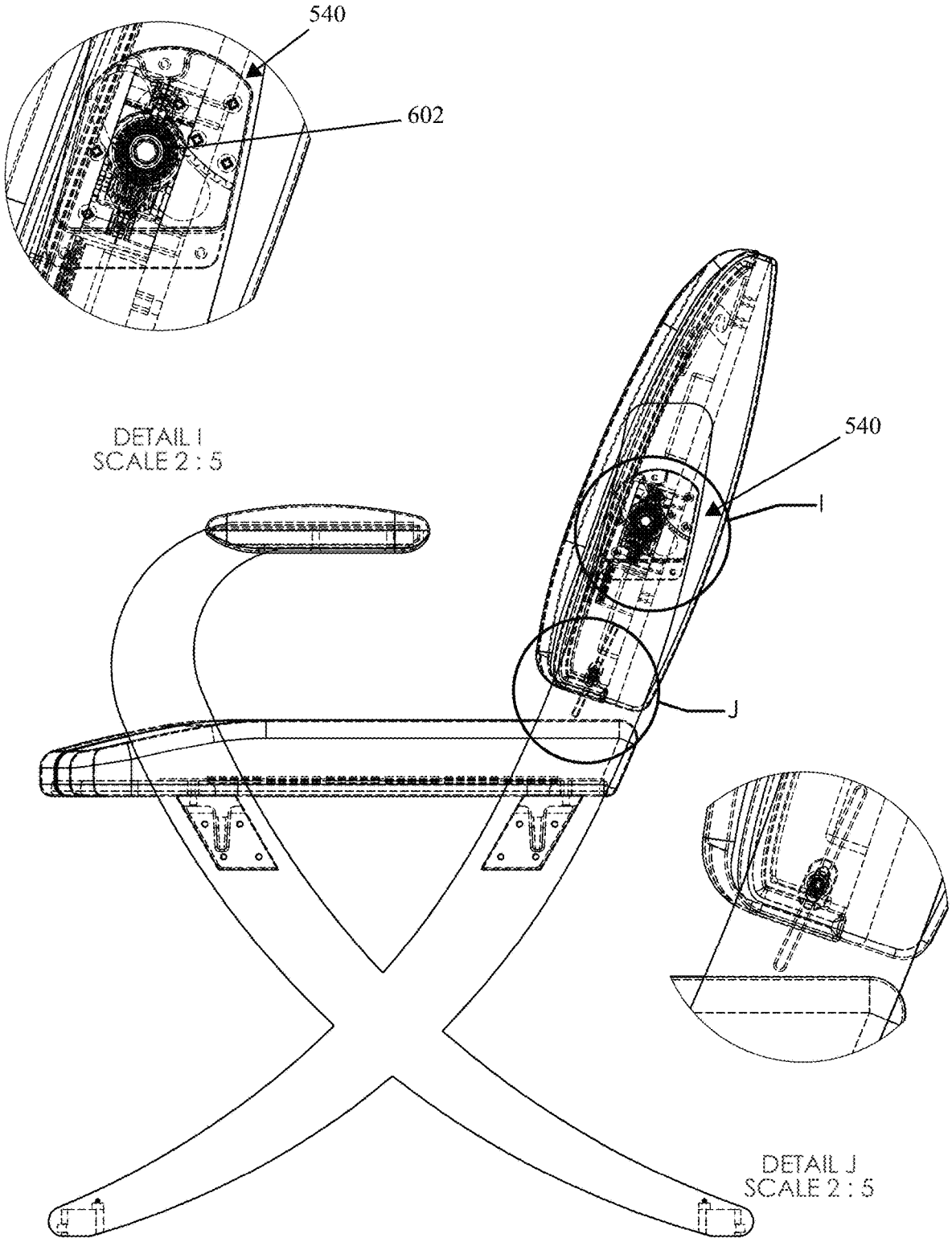
FIG. 88 is a section view of a reclining chair in accordance with one or more arrangements; the view showing the chair having a frame with a pocket and a cartridge positioned within the pocket; the view also showing the chair in a partially reclined position.
Figure 89:
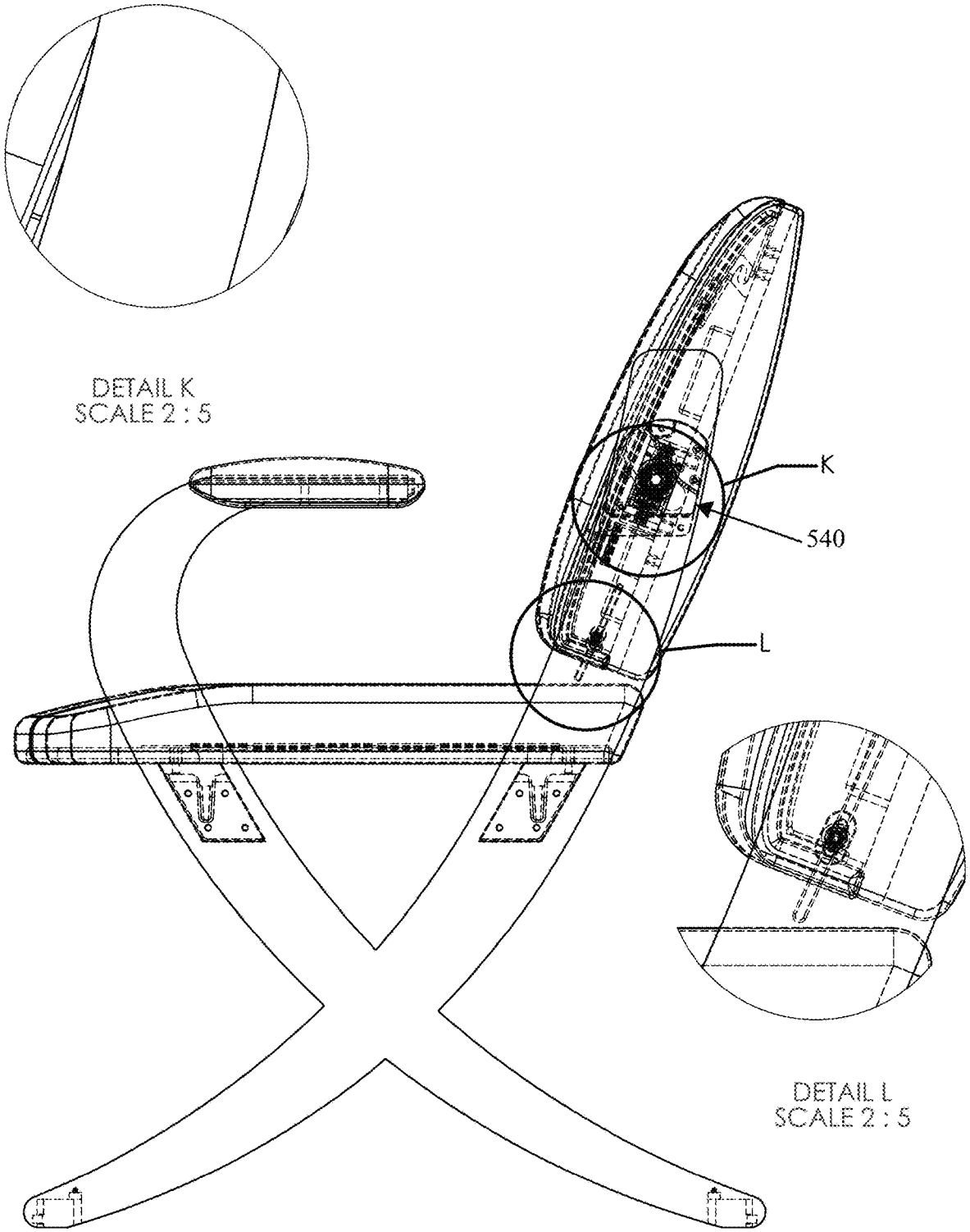
FIG. 89 is a section view of a reclining chair in accordance with one or more arrangements; the view showing the chair having a frame with a pocket and a cartridge positioned within the pocket; the view also showing the chair in a partially reclined position.
Figure 90:
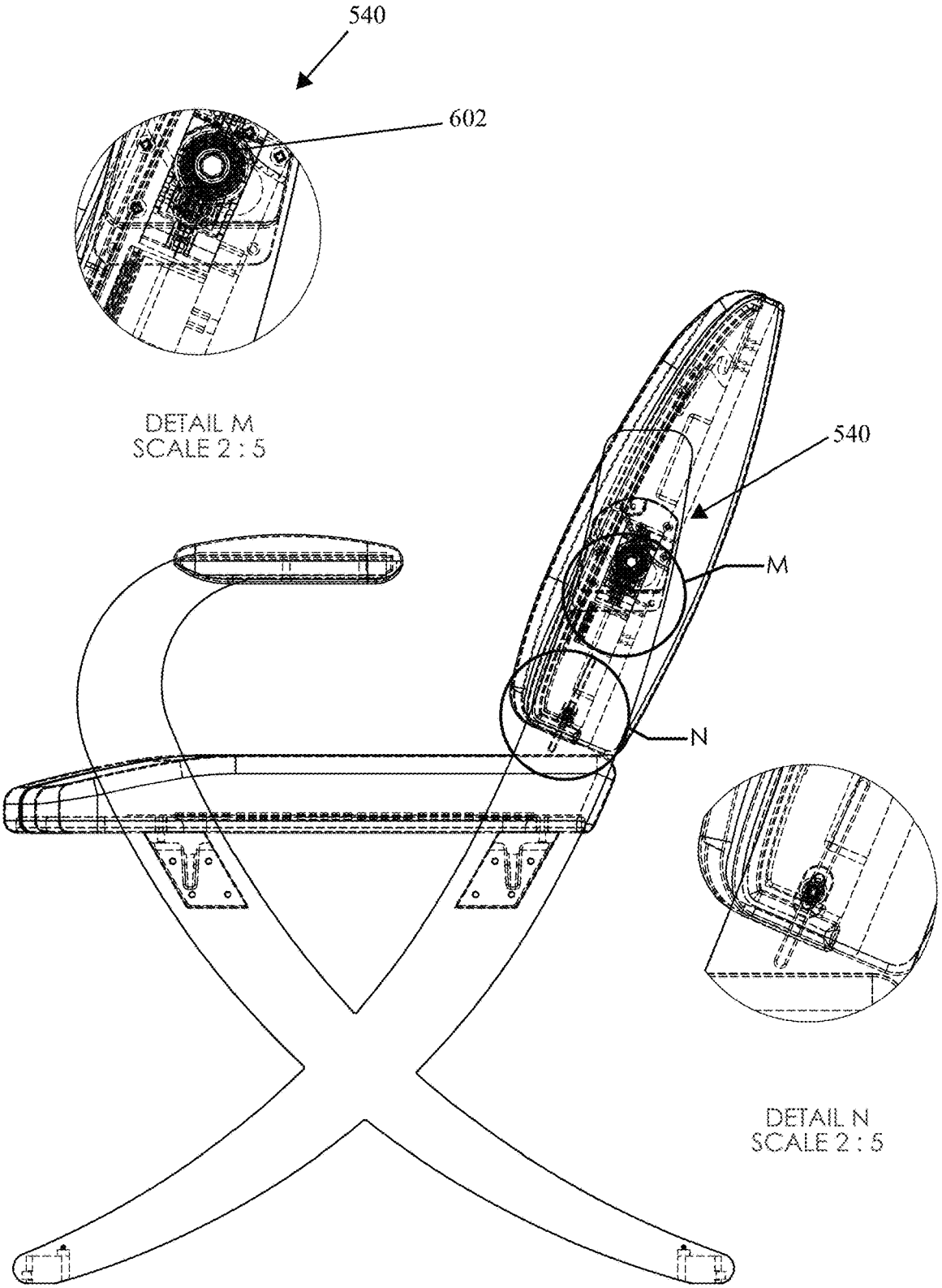
FIG. 90 is a section view of a reclining chair in accordance with one or more arrangements; the view showing the chair having a frame with a pocket and a cartridge positioned within the pocket; the view also showing the chair in a partially reclined position.
Figure 91:
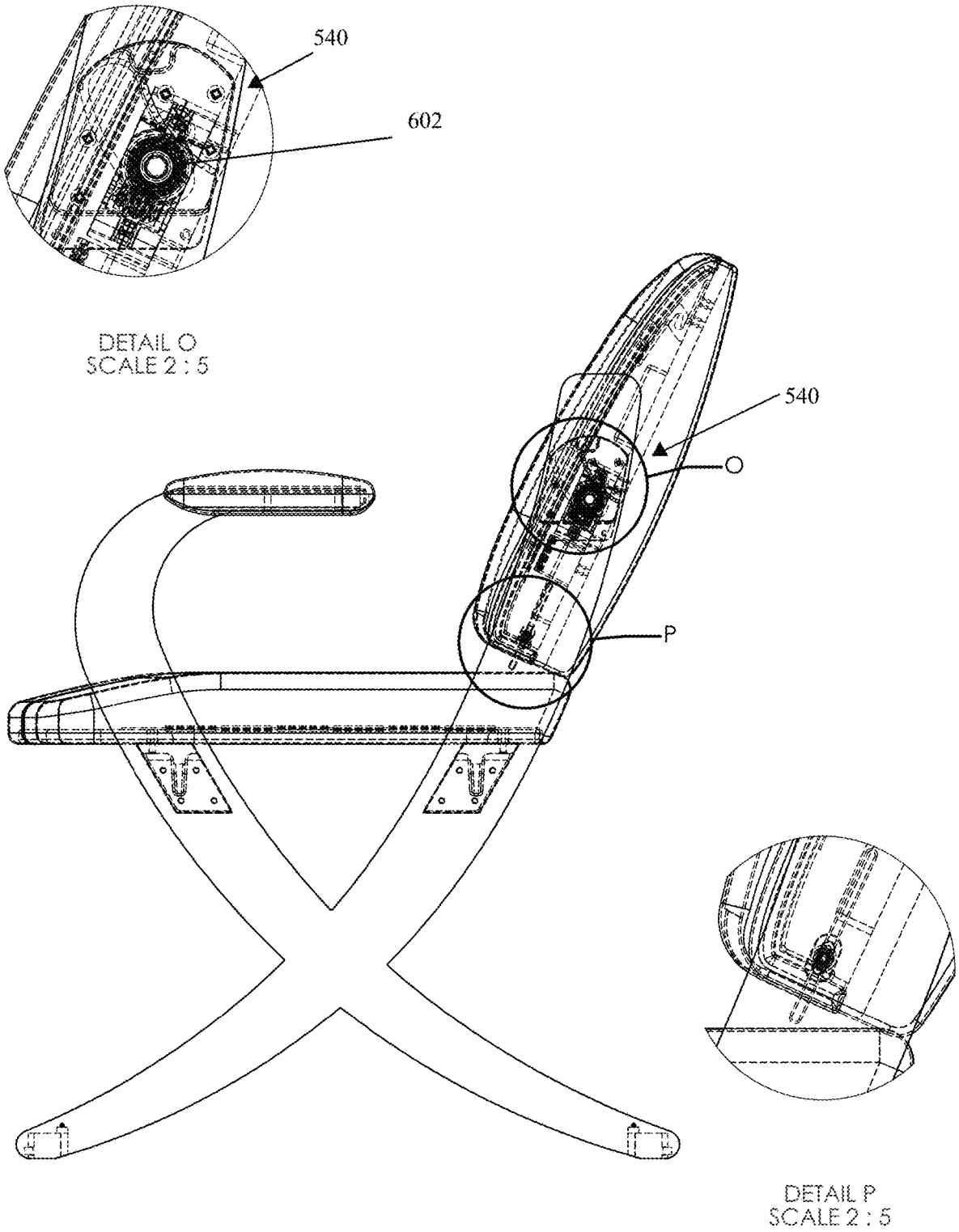
FIG. 91 is a section view of a reclining chair in accordance with one or more arrangements; the view showing the chair having a frame with a pocket and a cartridge positioned within the pocket; the view also showing the chair in a reclined position.

While some arrangements may be primarily shown or described as having a continuous axle 310 extending across backrest 14 and outward from the sides of backrest 14, the embodiments are not so limited. Rather, it is contemplated that in one or more arrangements, lower guide assembly 300 may include two separate lower axles 310 connected to each side of backrest 14 to facilitate connection with rollers 312 and slotted track 224, for example as shown in FIG. 14.

Rollers 312 are formed of any suitable size, shape, and design and are configured to connect with opposing ends 316 of lower axle 310 and move smoothly within frame 16 along the path of slotted track 224. In one or more various arrangements, rollers 312 may implemented using various means or methods for rolling known in the art including but not limited to, for example, wheels, balls, bearings, or a combination thereof. In one or more various arrangements, rollers 312 may be attached to opposing ends 316 of lower axle 310 using various methods or means for connecting including but not limited to, for example, screws, bolts, clamps, pins, rivets, welding, snap connectors, friction fit connectors, adhesives, chemical bonding, and/or any other process or means that results in a permanent of semi-permanent connection.

Upper Guide Assembly 302

Upper guide assembly 302 is formed of any suitable size, shape, and design and is configured to connect with and guide an upper portion of backrest 14 along a designated path when backrest 14 is moved from an upright position to a reclined position. In the arrangement shown, as one example, upper guide assembly 302 includes an upper axle 330, links 332, and hinged connections 336, among other components.

In this example arrangement, upper axle 330 has an elongated cylindrical shape extending between opposing ends 338. In this example arrangement, upper axle 330 extends through upper set of holes 136 in side portions 118 of rear support member 102 of backrest 14. In this example arrangement, upper axle 330 extends outward from the sides of backrest 14.

In this example arrangement, links 332 have an elongated generally rectangular planar shape extending between upper ends 342 and lower ends 344. In this example arrangement, lower ends 344 of links 332 are connected to the opposing ends 338 of upper axle 330. In this example arrangement, hinged connections 336 connect upper ends 342 of links 332 to arms 246 at holes 270. In one or more arrangements, edges and/or corners of link 332 are rounded to eliminate sharp edges or corners that may be contacted by an occupant of system 10.

Hinged connections 336 are formed of any suitable size, shape, or design, and are configured to facilitate connection of upper ends 342 of links 332 with arms 246, while permitting links 332 to pivot relative to arms 246. In the arrangement shown, as one example, hinged connections 336 are formed by holes in link 332 which are positioned around opposing ends 338 of upper axle 330 and fasteners (e.g., bolts, screws, or any other fasteners) that are connected to holes of arms 246. However, the embodiments are not so limited. Rather, it is contemplated that hinged connections 336 may be implemented using any various methods or means for providing a hinged connecting known in the art.

Counterbalance Assembly 304

Counterbalance assembly 304 is formed of any suitable size, shape, and design and is configured to apply a bias force sufficient to move backrest 14 to an upright position in the absence of a sufficient opposing force placed on backrest (e.g., by an occupant leaning backward).

In one arrangement shown, as one example, counterbalance assembly 304 includes a pair of arms 350 connected to first ends of torsion springs 352 positioned on upper axle 330 of upper guide assembly 302. In this example arrangement, arms 350 brace against lower axle 310 to prevent rotation of the first ends of torsion springs 352 when tensioned. In this example arrangement, the other ends of torsion springs 352 are connected to upper axle 330, which is connected to lower ends 344 of links 332 of upper guide assembly 302. When viewed from the left side torsion springs 352 are tensioned to rotate upper axle 330 and links 332 clockwise in absence of a sufficient opposing force, thereby moving backrest 14 to the upright position.

However, embodiments are not so limited. Rather, it is contemplated that in various different arrangements counterbalance assembly 304 may utilize various mechanisms to move backrest 14 to the upright position including but not limited to, for example, one or more springs, one or more gas pistons, one or more gas springs, one or more hydraulic pistons, one or more actuators, one or more solenoids, one or more pneumatic members, and/or any other force generating means or combination thereof.

As an alternative example, in one or more arrangements, counterbalance assembly 304 includes torsion springs 352 and a tensioner assembly 348 operably connected to upper axle 330. In this example arrangement, torsion springs 352 each have a first end connected to upper axle 330 and a second end connected to a tensioner assembly 348. When viewed from the left side, torsion springs 352 are tensioned to rotate upper axle 330 and links 332 clockwise in absence of a sufficient opposing force, thereby moving backrest 14 to the upright position.

Tensioner assembly 348 is formed of any suitable size, shape, and design and is configured to apply tension to torsion springs 352 so as to cause torsion springs 352 to apply the bias force, by rotating upper axle 330, to move backrest 14 to an upright position in the absence of a sufficient opposing force placed on backrest 14. In the arrangement shown, as one example, tensioner assembly 348 includes a generally cylindrical tube 368 shape extending between opposing ends, where tube 368 is operably connected to second ends of torsion springs 352, a tensioner gear mechanism 374 (not shown), and a housing 366 among other components.

In this example arrangement, upper axle 330 extends through tube 368 and is configured to freely rotate relative to tube 368. In this example arrangement, tube 368 has a set of teeth 372 formed on an exterior surface of the tube 368.

In this example arrangement, tensioner assembly 348 includes a tensioner gear mechanism 374 (not shown). Tensioner gear mechanism 374 (not shown) is formed of any suitable size, shape, and design and is configured to engage teeth 372 of tube 368 and facilitate rotation of tube 368 to tension torsion springs 352. In the arrangement shown, as one example, tensioner gear mechanism 374 (not shown) includes a worm gear 376 positioned to engage teeth 372 and cause tube 368 to rotate when the worm gear 376 is rotated by a user. In this example arrangement, worm gear 376 has a generally cylindrical shape extending from a forward end 378 to a rearward end 380 and has helical features 382 extending along an exterior surface of worm gear 376.

In this example arrangement, helical features 382 engage teeth 372 so as to cause tube 368 to rotate when worm gear 376 is rotated. In this example arrangement, worm gear 376 has a set of contact features 384 at forward end 378 to facilitate operable connection with a tool (e.g., a socket, wrench, screwdriver, or any other tool) for rotation of worm gear 376 by a user. In this example arrangement, features 384 at forward end 378 are accessible by a user via a hole 434 in backrest 14. For example, in one or more arrangements, features 384 at forward end 378 of worm gear 376 may be accessible from a hole 434 positioned in rear support member 102 of backrest support assembly 100. Additionally or alternatively, in one or more arrangements, features 384 at forward end 378 of worm gear 376 may be accessible from a hole 434 positioned in front support member 104 of backrest support assembly 100, which is accessible by removing cushion 106 from front support member 104. Additionally or alternatively, in one or more arrangements, features 384 at forward end 378 of worm gear 376 may be accessed by removing front support member 104 from rear support member 102 to expose tensioner assembly 348. However, the embodiments are not limited to these example arrangements. Rather it is contemplated that in various different arrangements may provide access for adjustment of tensioner assembly 348 using various other methods of means known in the art.

However, the arrangements are not so limited. Rather, it is contemplated that tensioner assembly 348 may be implemented using various different arrangements of components and/or may be positioned at various locations within system 10 to facilitate tensioning of torsion springs 352 of counterbalance assembly 304.

However, embodiments are not so limited. Rather, it is contemplated that in various different arrangements counterbalance assembly 304 may utilize various mechanisms to move backrest 14 to the upright position including but not limited to, for example, one or more springs, one or more gas pistons, one or more gas springs, one or more hydraulic pistons, one or more actuators, one or more solenoids, one or more pneumatic members, and/or any other force generating means or combination thereof.

Housing 366: Housing 366 is formed of any suitable size, shape, and design and is configured to house cylindrical tube 368 and tensioner gear mechanism 374 (not shown) and connect counterbalance assembly 304 with backrest 14. In the arrangement shown, as one example, housing 366 includes a front plate 400 and a back plate 402 forming a hollow interior 404 for housing cylindrical tube 368 and tensioner gear mechanism 374 (not shown).

In this example arrangement, front plate 400 has a generally rectangular shape having a front surface 406 and a back surface 408, extending between a top 410, a bottom 412, and opposing sides 414. In this example arrangement, back plate 402 also has a generally rectangular shape having a front surface 418 and a back surface 420, extending between a top 422, a bottom 424, and opposing sides 426.

In this example arrangement, front surface 418 of back plate 402 and back surface 408 of front plate 400 each have a set of semi-cylindrical recesses 430 configured to receive and hold tube 368 of tensioner assembly 348. In this example arrangement, tube 368 is positioned in an opening defined by recesses 450, which extends between opposing sides 414/426 of front plate 400 and back plate 402. In this example arrangement, front surface 418 of back plate 402 and back surface 408 of front plate 400 also have circular recesses 432 configured to receive and hold worm gear 376. In this example arrangement, circular recesses 432 are positioned proximate to semi-cylindrical recesses 430 so helical features 382 of worm gear 376 engage teeth 372 of tube 368. More specifically, rearward end 380 of worm gear 376 is positioned within circular recess 432 of back plate 402 and forward end 378 of worm gear 376 is positioned in circular recess 432 of front plate 400. In this example arrangement, front plate 400 has an access hole 434 extending from front surface 406 into circular recess 432 of front plate 400 to provide access to contact features 384 of worm gear 376 to facilitate tensioning of torsion springs 352. In one or more arrangements, front plate 400 and back plate 402 of tensioner assembly 348 are connected together by a set of fasteners 438 (e.g., bolts) that extend through holes 440 in front plate 400 and into back plate 402. However, the embodiments are not so limited. Rather, it is contemplated that in one or more arrangements front plate 400 and back plate 402 of tensioner assembly 348 may be connected using various methods or means including but not limited to, for example, screws, bolts, clamps, pins, rivets, welding, snap connectors, friction fit connectors, adhesives, chemical bonding, and/or any other process or means that results in a permanent of semi-permanent connection.

Stop Features 358

In one or more arrangements, reclining mechanism 20 includes one or more stop features 358 (not shown) configured to facilitate positioning of seat 12 at one or more intermediate positions between the upright position and the reclined position. In one or more arrangements, as one example, stop feature(s) 358 may be recesses inside frame 16 that rollers 312 roll over when backrest 14 is moved between the upright and reclined positions. Due to a slightly larger amount of force required to move rollers 312 out of such recess, reclining mechanism 20 helps hold backrest 14 at one or more defined intermediate positions, thereby increasing reclining options for the occupant. However, the embodiments are not so limited. Rather, it is contemplated that reclining mechanism 20 may utilize various methods and means for holding backrest 14 at one or more intermediate positions including but not limited to, for example, recesses, protrusions, indents, detents, holes, compressive fittings, frictional stops, magnetic components, gears, latches, non-linear springs, non-linear cams, and pulleys and/or any other suitable means or methods known in the art.

In one arrangement shown, as one example, stop feature 358 may be locking assembly 360. Locking assembly 360 is formed of any suitable size, shape, and design and is configured to hold backrest 14 in various intermediate positions between the fully reclined position and the fully upright position. This essentially converts system 10 from a reclining chair to a non-reclining chair when desired by the occupant of system 10. In the arrangement shown, as one example, locking assembly 360 includes a movable body 361 with teeth 362, and a stationary member 363 with indents 364. In the arrangement shown, as one example, locking assembly 360 is configured to connect to reclining mechanism 20 through upper axle 330. More specifically, in the arrangement shown as one example, upper axle 330 extends through apertures in both movable body 361 and stationary member 363, thereby connecting locking assembly 360 to reclining mechanism 20.

Movable body 361 is formed of any suitable size, shape, and design and is configured to move along at least a portion of upper axle 330 and between a locked position and an unlocked position. In the arrangement shown, as one example, movable body 361 includes teeth 362. Teeth 362 are formed of any suitable size, shape, and design and are configured to be inserted into indents 364 of stationary member 363 in order to lock backrest 14 in an intermediate position. In the arrangement shown, as one example, movable body 361 includes six teeth 362, configured to lock backrest 14 at six different intermediate positions, however any other number of teeth 362 may be present to lock backrest 14 at any number of intermediate positions. In the arrangement shown, as one example, teeth 362 extend outward from movable body 361 in a direction toward stationary member 363. In the arrangement shown, as one example, teeth 362 are chamfered, such that teeth 362 form a pointed end. The purposes of teeth 362 being chamfered is so teeth 362 can more easily be inserted into indents 364 (i.e., perfect alignment is not needed). The chamfered shaped of teeth 362 help to guide teeth 362 into indents 364 properly.

Stationary member 363 is formed of any suitable size, shape, and design and is configured to help facilitate the locking of backrest 14 at intermediate positions. In the arrangement shown, as one example, stationary member 363 includes indents 364. Indents 364 are formed of any suitable size, shape, and design and are configured to receive and hold teeth 362 therein when movable body 361 is in a locked position. Similar to teeth 362, in the arrangement shown as one example there are six indents 364 which help define six intermediate positions, however any other number of indents 364 may be present in order to lock backrest 14 at any number of intermediate positions. Additionally, similar to teeth 362, indents 364 are chamfered in the arrangement shown as one example. The chamfered shape of indents 364 and teeth 362 helps facilitate proper alignment of, insertion into, and engagement of teeth 362 with indents 364. The chamfered indents 364 help guide teeth 362 as they are being inserted into indents 364.

In the arrangement shown, when movable body 361 is in the unlocked position, teeth 362 are disengaged from indents 364 of stationary member 363 and backrest 14 is freely movable between the upright position and the reclined position. When a user wants to lock backrest 14 at an intermediate position, the user can move backrest 14 to the desired position and then move movable body 361 of locking assembly 360 inward along upper axle 330. When movable body 361 is moved inward along upper axle 330, teeth 362 are inserted into, and held in locked engagement with, indents 364 of stationary member 363 and backrest 14 is locked in place at the desired position, which can be any position between fully upright, fully reclined, or anywhere in between fully upright and fully reclined. When the user desires to reposition backrest 14 again, the user can move movable body 361 outward along upper axle 330 to the unlocked position, thereby disengaging teeth 362 from indents 364 and allowing backrest 14 to freely move again.

In the arrangement shown, as one example, movable body 361 extends a length from an inward end (which is the end having teeth 362) and an outward end. The length of movable body 361 is as such to give a user a fair amount of surface area to properly engage and operate movable body 361 between an unlocked position and a locked position.

In an unlocked position, movable body 361 rotates with upper axle 330 of reclining mechanism 20. This is accomplished by movable body 361 having a non-round opening through its approximate middle that fits over the non-round exterior surface of upper axle 330 within close and tight tolerances that allow movable body 361 to slide a length along upper axle 330 but prevent relative rotation between upper axle 330 and movable body 361. In the unlocked position movable body 361 is disengaged from stationary member 363 and backrest 14 is in an unlocked position (i.e., backrest 14 is free to move between a fully upright position and a fully reclined position).

In a locked position, movable body 361 is engaged with stationary member 363 of locking assembly 360, thereby inhibiting the rotation of movable body 361. As noted above, movable body fits over upper axle 330 with close and tight tolerances that allow movable body 361 to slide a length along upper axle 330 but prevent relative rotation between upper axle 330 and movable body 361. When movable body 361 is engaged with stationary member 363, movable body 361 is inhibited from rotating which inhibits rotation of upper axle 330 of reclining mechanism 20. In this configuration, backrest 14 is in a locked position at the set position which can be the fully upright position, the fully reclined position, or any other position in between the fully upright position and the fully reclined position.

While locking assembly 360 and its various components have been described according to the arrangement shown, as one example, locking assembly 360 and its various components may be formed of any other size, shape, or design in order to facilitate the locking of backrest 14 at intermediate positions between the fully upright position and the fully reclined position.

In Operation

In operation, when backrest 14 is moved to an upright position, rollers 312 are moved within frame 16 upward and rearward along slotted track 224 to an upper end of slotted track 224, thereby moving a lower end of backrest 14 upward and rearward. At the same time, link 332 of upper guide assembly 302 moves an upper end of backrest 14 upward and forward.

Conversely, when backrest 14 is moved to a reclined upright position, rollers 312 are moved downward and forward along slotted track 224 to a lower end of slotted track 224, thereby moving lower end of backrest 14 downward and forward. At the same time, link 332 of upper guide assembly 302 moves the upper end of backrest 14 downward and rearward. This guided movement of backrest 14 between upright and reclined positioned facilitates a more natural movement of an occupant between upright and reclined positions.

Alternative Arrangement

An alternative arrangement of system 10 is presented in various figures shown as additional examples. The alternative arrangements presented are similar to the system 10 described above and shown in various other figures, and therefore unless specifically stated otherwise herein, the prior teaching and disclosure apply equally to these alternative arrangements. That is, the alternative arrangements described below are configured to be used with the same or similar seat 12, backrest 14, arm covers 18, and reclining mechanism 20 and the like, with the primary difference relating to frame 16 as is described herein.

Frame 16

In one or more alternative arrangements shown in one or more figures, as examples, frame 16 is formed of any suitable size, shape, and design and is configured to operably connect with and support seat 12, backrest 14, and reclining mechanism 20 of system 10 to provide seating for an occupant of system 10. In the arrangement shown, as one example, frame 16 is a chair frame formed of elongated bar stock and having a base section 170, a seat support section 172, and an arm support section 174, among other components.

Base Section 170

Base Section 170 of frame 16 is formed of any suitable size, shape, and design and is configured to provide stable support of system 10 on a floor. In the arrangement shown, as one example, base section 170 includes front legs 180, lower front corners 182, side bars 184, lower rear corners 186, and rear legs 188, among other components.

In this example arrangement, front legs 180 have a generally elongated rectangular shape extending from upper ends 190, connected to seat support section 172, to lower ends 192 connected to lower front corners 182. In this example arrangement, lower front corners 182 have a generally elongated rectangular shape extending from lower ends 192 and curving rearward before connecting to front ends 198 of side bars 184. In this example arrangement, side bars 184 each have an elongated rectangular shape extending from front end 198, where side bars 184 are connected to lower front corner 182, to a rear end 200, where side bars 184 are connected to lower rear corner 186. In this example arrangement, lower rear corners 186 have a generally elongated rectangular shape extending from rear ends 200 of side bars 184 and curving upward before connecting to lower ends 206 of rear legs 188. In this example arrangement, rear legs 188 have an elongated rectangular shape extending from lower ends 206, where rear legs 188 are connected to lower rear corners 186, to upper ends 208, where rear legs 188 connect with seat support section 172. In this example arrangement, rear legs 188 extend forward at an angle as rear legs 188 extend from lower ends 206 to upper ends 208.

Seat Support Section 172

Seat support section 172 of frame 16 is formed of any suitable size, shape, and design and is configured to support and facilitate connection of frame 16 with seat 12, while operably connecting arm support section 174 to base section 170. In the arrangement shown, as one example, seat support section 172 includes upper rear corners 214 and side bars 220, among other components.

In this example arrangement, upper rear corners 214 have a generally elongated rectangular shape extending from upper ends 208 of rear legs 188 and curving forward before connecting to rear ends 234 of side bars 220. In this example arrangement, side bars 220 each have an elongated rectangular shape extending from rear ends 234, where side bars 220 are connected to center corners 218, to a front end 236, where side bars 220 are connected to upper ends 190 of front legs 180.

Arm Support Section 174

Arm support section 174 of frame 16 is formed of any suitable size, shape, and design and is configured to provide an arm rest for an occupant seated in seat 12 while operably connecting backrest 14 with frame 16. In the arrangement shown, arm support section 174 includes front vertical sections 238, lower front bends 240, front sloped sections 242, upper front bends 244, a pair of arms 246, rear bends 248, and rear sloped sections 252.

In this example arrangement, front vertical sections 238 have a generally elongated rectangular shape extending from a lower end 260 connected to upper ends 190 of front legs 180 to an upper end 262.

In this example arrangement, front sloped sections 242 each have a contoured elongated shape extending rearward at an angle from a lower end 256, where front sloped sections 242 connect to upper end 262 of front vertical section 238, to an upper end 258, where front sloped sections 242 connect to upper front bend 244.

In this example arrangement, front bends 244 have a generally elongated rectangular shape extending from upper end 258 of front sloped sections 242 and curving rearward before connecting to front end 264 of arms 246.

In this example arrangement, arms 246 each have an elongated rectangular shape extending from front end 264 to rear ends 266, where arms 246 are connected to rear bends 248. In this example arrangement, arms 246 include holes 270 located proximate to rear ends 266 and extending sideways through arms 246 to facilitate connection with link 332 of upper guide assembly 302 of reclining mechanism 20.

In this example arrangement, arms 246 have recesses 450 in a bottom surface proximate to rear ends 266. Recesses 450 are formed of any suitable size, shape, and design and are configured to receive and conceal link 332 of upper guide assembly 302 when backrest 14 is moved to the upright position. In the arrangement shown, as one example implementation, recesses 450 in each arm 246 includes a first channel 452 extending upward from a bottom surface of arms 246 from a rearward end 454 to a forward end 456. In this example arrangement, recesses 450 in each arm 246 also include a second channel 458 extending from first channel 452 proximate to forward end 456 to an inner side edge of arm 246. The second channel 458 is configured to receive an end 338 of upper axle 330, where upper axle 330 connects with link 332, when backrest 14 is moved to the upright position. In this manner upper guide assembly 302 is concealed from view when backrest is not reclined, thereby giving system a more aesthetically pleasing appearance.

In this example arrangement, rear bends 248 connect arms 246 to rear sloped sections 252. In this example arrangement, rear bends 248 have a generally elongated rectangular shape extending from rear end 266 of arms 246 and curving downward and then forward before connecting to an upper end 276 of rear sloped section 252.

In this example arrangement, rear sloped sections 252 have an elongated rectangular shape extending from upper end 276 to a lower end 278, where rear sloped sections 252 connect with upper rear corners 214 of seat support section 172.

In this example arrangement, rear sloped sections 252 include a slotted track 224 positioned on an inner side of upper rear corners 214. As discussed in more detail with reference to reclining mechanism 20, slotted track 224 is configured to facilitate guiding a lower end of backrest 14 along a designated path when being moved from an upright position to a reclined position. In the example arrangement shown, slotted track 224 is configured to receive a guide member 314 operably connected to an end 316 of lower axle 310 within slotted track 224. Guide member 314 is formed of any suitable size, shape, and design, and is configured to operably hold and guide end 316 of lower axle 310 along slotted track 224 as backrest 14 is moved between reclined and upright positions. In the arrangement shown, guide member 314 is an elongated generally rectangular shaped member configured to be received and move smoothly within slotted track 224 with minimal binding. In the arrangement shown, guide member 314 is connected to end 316 of lower axle 310 by a fastener extending through a hole 318 and into end 316 of lower axle 310. However, the embodiments are not so limited. Rather, it is contemplated that in one or more arrangements guide member 314 may be connected to end 316 of lower axle 310 using various methods or means including but not limited to, for example, screws, bolts, clamps, pins, rivets, welding, snap connectors, friction fit connectors, adhesives, chemical bonding, and/or any other process or means that results in a permanent of semi-permanent connection.

Adjustable Restriction of Movement by Inserts 460

In one or more arrangements, the range of movement of backrest may be restricted using inserts 460 (not shown). Inserts 460 are formed of any suitable size, shape, and design, and are configured to be inserted into and held within slotted track 224 to restrict the range of motion of guide member 314 within slotted track 224. As an illustrative example, in one or more arrangements, a user may insert an insert 460 into a lower end of slotted track 224 to restrict the distance that guide member 314 can travel downward, and thereby restrict the amount that backrest can be reclined. Conversely, as another example, in one or more arrangements, the user may insert an insert 460 into an upper end of slotted track 224 to restrict the distance that guide member 314 can travel upward, and thereby restrict the amount that backrest can be moved toward the fully upright position. In this manner, positioning and range of motion of backrest 14 may be customized to suit the preferences of a user.

Locking Upper Guide Assembly 302

In one or more arrangements, upper guide assembly 302 of reclining mechanism 20 has link 332 positioned to move backrest 14 into a locked upright position when force is applied to a rear portion of backrest 14, where force is typically applied to backrest when a user is seated upright. In this example arrangement, link 332 of upper guide assembly 302 is configured to permit reclining mechanism 20 to be moved to the reclined position when force is applied to an upper portion of backrest 14, where force is typically applied o backrest when a user leans backward while seated.

In one or more arrangements, upper guide assembly 302 of reclining mechanism 20 has link 332 configured to form an over-center latch that holds backrest 14 in the upward position when an occupant leans backward into backrest 14. In one arrangement shown, upper axle 330, where forward end of link 332 is pivotally connected to backrest 14, is positioned higher than holes 270, where rearward end of link 332 is pivotally connected to in arms 246 when backrest is in the upright position. In this position, when an occupant leans backward into backrest 14, force is placed on link 332 to push the forward end of link 332 and upper axle 330 upward into recess 450 in arms 350. In this position, link 332 of upper guide assembly 302 forms an over-center latch that prevents backrest 14 from reclining.

To recline backrest 14, user may shift backrest 14 somewhat downward to a position where upper axle 330 is positioned lower than holes 270, where the rearward end of link 332 is pivotally connected to in arms 246. When an occupant leans backward with backrest 14 in this position, upper guide assembly 302 of reclining mechanism 20 guides an upper edge 112/124 of backrest 14 downward and rearward while lower guide assembly 300 guides lower edge 114/126 of backrest 14 downward and forward, as previously described.

In one or more arrangements shown, components of frame 16 are described as separate components and/or sections that are connected together. However, the embodiments are not so limited. Rather, it is contemplated that, in one or more arrangements, multiple portions of frame 16 may be formed as a unitary piece, for example, formed by bending a single piece of stock.

Alternative Arrangement

With reference to FIGS. 50-91, an alternative arrangement of system 10 is presented. This alternative arrangement presented in FIGS. 50-91 is similar to the system 10 presented in FIGS. 1-49 and therefore, unless specifically stated otherwise herein, the prior teaching and disclosure shown in FIGS. 1-49 applies equally to the alternative arrangement shown in FIGS. 50-91. That is, the arrangement shown in FIGS. 50-91 is configured to be used with the same or similar seat 12, backrest 14, and reclining mechanism 20 with the primary difference relating to frame 16 and the inclusion of cartridge 540 as is described herein.

Frame 16

In the arrangement shown in FIGS. 50-91, as one example, frame 16 is formed of any suitable size, shape, and design and is configured to operably connect with and support seat 12, backrest 14, and reclining mechanism 20 of system 10 to provide seating for an occupant of system 10. In the arrangement shown, as one example, frame 16 is a chair frame formed of a pair of first legs 480, a pair of second legs 482, and support members 484.

First Legs 480: In the arrangement shown in FIGS. 50-91, frame 16 includes a pair of first legs 480. First legs 480 are formed of any suitable size, shape, and design and are configured to help provide stable support of system 10 on a floor. In the arrangement shown, as one example, each first leg 480 is a generally elongated member which extends between a top end 488 and a bottom end 490. In the arrangement shown, as one example, first leg 480 is curved and starts at its top end 488, which is towards the front of system 10 and extends downward from its top end 488 to its bottom end 490 while curving such that the bottom end 490 is located at or near the back of system 10. In the arrangement shown, as one example, first legs 480 extend a width between opposing left and right sides 492 (or simply "sides 492"). In the arrangement shown, as one example, first legs 480 include an outer surface 494 and an inner surface 496 and the distance between the outer surface 494 and inner surface 496 is the thickness of first legs 480. First leg 480 may be formed of any material suitable for use as legs on a chair, including a metallic material, or a wooden material, a plastic material, or any other non-metallic material.

In the arrangement shown as one example, first legs 480 include arms 498. Arms 498 are formed of any suitable size, shape, and design and are configured to provide a surface for a user to rest their arms on. In the arrangement shown, as one example, arms 498 is a generally square member which extends a distance between a first end 500 and a second end 502. In the arrangement shown, as one example, arms 498 include an outer surface 504 and an inner surface 506 which are co-planar with outer surface 494 and inner surface 496 of first legs 480, respectively.

In the arrangement shown, as one example, arms 498 include an arm cover 508. Arm cover 508 is formed of any suitable size, shape, and design and is configured to connect with arms 498 and provide comfortable arm rests for an occupant seated in seat 12 while providing an aesthetically pleasing appearance. In the arrangement shown, as one example, arm covers 508 each have a top 510, a bottom 512, and opposing sides 514 extending between a front end 516 and a back end 518. In the arrangement shown, as one example arm covers 508 are generally elongated and ovular in shape, with a width at the back end 518 that is larger than the width at front end 516. In this example arrangement, arm covers 508 are configured to fit over arms 498.

In one or more arrangements, arm covers 508 are connected to arms 498 by a set of fasteners (not shown) such as bolts which extend through holes (not shown) in arms 498 and connect with arm covers 508. As another example, in one or more arrangements, fasteners may include connectors extending upward from arms 498 and are configured to be received and connect with receivers formed in bottom 512 of arm covers 508. For instance, bottom 512 may include keyhole shaped openings having a wide portion and a narrow portion. Such openings may be configured to receive a head of connectors of arms 498 and lock with the connectors by sliding arm covers 508 so the head is positioned in the narrow portion, thereby connecting arm covers 508 to arms 498. In one or more arrangements, the keyhole shaped opening may have a J-shape or L-shape, for example, to prevent arm covers 508 from being disconnected from arms 498 via movement of arm covers 508 in a single direction.

However, embodiments are not so limited. Rather, it is contemplated that in various arrangements, arm covers 508 may be connected to arms 498 of first legs 480 using various methods or means including but not limited to, for example, screws, bolts, clamps, pins, rivets, welding, snap connectors, interconnects (e.g., slide connectors, rotational connectors, or any other type of interconnect), friction fit connectors, adhesives, chemical bonding, and/or any other process or means that results in a permanent of semi-permanent connection.

In the arrangement shown, as one example, as first legs 480 curve such that they move from the top end 488 near the front of system 10 to the bottom end 490 near the back of system 10, first legs 480 cross second legs 482 as second legs 482 extend from their top end 520 near the back of system 10 to their bottom end 522 near the front of system 10. In the arrangement shown, as one example, where first legs 480 and second legs 482 cross, the outer surface 494 of first legs 480 and the outer surface 526 of second legs 482 are co-planar and form a singular plane. Similarly, where first legs 480 and second legs 482 cross, the inner surface 496 of first legs 480 and the inner surface 528 of second legs 482 are co-planar and form a singular plane.

Second Legs 482: In the arrangement shown in FIGS. 50-91, frame 16 includes a pair of second legs 482. Second legs 482 are formed of any suitable size, shape, and design and are configured to help provide stable support of system 10 on a floor and to support backrest 14 and hold cartridge 540. In the arrangement shown, as one example, each second leg 482 is a generally elongated member which extends between a top end 520 and a bottom end 522. In the arrangement shown, as one example, second leg 482 is curved and starts at its top end 520, which is adjacent backrest 14, and extends downward from its top end 520 to its bottom end 522 while curving such that the bottom end 522 is located at or near the front of system 10. In the arrangement shown, as one example, second legs 482 extend a width between opposing left and right sides 524 (or simply "sides 524"). Second legs 482 may be formed of any material suitable for use as legs on a chair, including a metallic material, or a wooden material, a plastic material, or any other non-metallic material.

In the arrangement shown, as one example, second legs 482 have an outer surface 526 and an inner surface 528. In the arrangement shown, as one example, the outer surface 526 of second legs 482 is a generally flat and planar surface. In the arrangement shown, as one example, the inner surface 528 is a generally flat and planar surface with the exception of pocket 530 and slot 532 (not shown). Pocket 530 is formed of any suitable size, shape, and design and is configured to receive and hold cartridge 540 therein. In the arrangement shown, as one example, pocket 530 is a recess within second legs 482 and is located near top end 520 of second legs 482. That is, in the arrangement shown, as one example, pocket 530 is a generally recessed area which is formed in, and extends inward from, the inner surface 528 of second legs 482. In the arrangement shown, as one example, pocket 530 has a flat bottom edge 534 which extends from near one side 524 to near the other side 524. In the arrangement shown, as one example, bottom edge 534 extends between opposing side edges 536 of pocket 530. In the arrangement shown, as one example, opposing side edges 536 extend in approximate parallel spaced relation to opposing sides 524 of second legs 482, and opposing side edges 536 extend from bottom edge 534 to top edge 538. In the arrangement shown, as one example, top edge 538 extends from one opposing side edge 536 to the other opposing side edge 536 with a convex curvature. While pocket 530 has been described according to the arrangement shown as one example, pocket 530 may be formed of any other shape or design so long as it is able to receive and hold cartridge 540 therein.

In the arrangement shown, as one example, the inner surface 528 of second legs 482 also include slot 532 (not shown). Slot 532 is formed of any suitable size, shape, and design and is configured to receive lower axle 310 therein and guide lower axle 310 as backrest 14 is moved between a reclined position and an upright position.

Support Members 484: In the arrangement shown, as one example, frame 16 includes two sets of first legs 480 and second legs 482. In the arrangement shown, as one example, the two sets are connected by support members 484. Support members 484 are formed of any suitable size, shape, and design and are configured to connect the two sets of first legs 480 and second legs 482 and support seat 12. In the arrangement shown, as one example, support members are generally elongated rectangular members which extend laterally between the first set of first leg 480 and second leg 482 and the second set of first leg 480 and second leg 482. In the arrangement shown, as one example, support members connect to the two sets of first legs 480 and second legs 482 using fasteners which may be screws, bolts, pins, nails, or any other types of fastener which facilitates connection between the sets of first leg 480 and second leg 482 and support members 484.

Cartridge 540

In the arrangement shown, as one example, frame 16 includes pocket 530, which is configured to receive and hold cartridge 540. Cartridge 540 is formed of any suitable size, shape, and design and is configured to help facilitate movement of backrest 14 between an upright position and a reclined position. In the arrangement shown, as one example, cartridge 540 includes a front plate 542, an articulating link 544, a bumper 546, and a back plate 548.

Front Plate 542: In the arrangement shown, as one example, cartridge 540 includes front plate 542. Front plate 542 is formed of any suitable size, shape, and design and is configured to help facilitate movement of backrest 14 between an upright position and a reclined position while helping contain additional components of cartridge 540. In the arrangement shown, as one example, front plate 542 has a bottom edge 550, opposing sides 552, and a top edge 554. In the arrangement shown, as one example, bottom edge 550 is a generally flat and planar edge which extends between opposing sides 552. Opposing sides 552 are generally flat and planar edges which extend at an angle upward from bottom edge 550 until they reach top edge 554, and opposing sides 552 extend in approximate parallel planar spaced relation to one another. In the arrangement shown, as one example, top edge 554 extends between opposing sides 552 and has a generally convex curvature as it extends across. In the arrangement shown, as one example, front plate 542 includes a generally flat and planar front surface 553 and a generally flat and planar back surface 555.

Front plate 542 may be formed of any material suitable for use as a plate, including various metallic materials such as stainless steel, aluminum, chromium, or any other metallic material, or various non-metallic materials such as a plastic material, a fiberglass material, or any other non-metallic material.

In the arrangement shown, as one example, front plate 542 includes reception members 556. Reception members 556 are formed of any suitable size, shape, and design and are configured to receive fasteners therein in order to connect with various components of cartridge 540. In the arrangement shown, as one example, reception members 556 extend outward from back surface 555 of front plate 542 and include an opening which is configured to receive fasteners therein.

In the arrangement shown, as one example, front plate 542 includes bossed holes 560. Bossed holes 560 are formed of any suitable size, shape, and design and are configured to receive a fastener therethrough to facilitate connection of cartridge 540 to second legs 482. In the arrangement shown, as one example, bossed holes 560 extend through front plate 542 from the front surface 553 to the back surface 555.

In the arrangement shown, as one example, front plate 542 includes a slot 564. Slot 564 is formed of any suitable size, shape, and design and is configured to receive a portion of articulating link 544 therein and allow for the movement of articulating link 544 along slot 564 as it moves between an upright position and a reclined position. In the arrangement shown, as one example, slot 564 extends through front plate 542 from the front surface 553 to the back surface 555. In the arrangement shown, as one example, slot 564 extends a length from a first edge 566 to a second edge 568. In the arrangement shown, as one example, first edge 566 is located at the top right portion of slot 564 and second edge 568 is located at the bottom left portion of slot 564. In the arrangement shown, as one example, a portion of articulating link 544 is placed through slot 564 and can travel along slot 564 as the backrest 14 is moved from an upright position to a reclined position.

In the arrangement shown, as one example, front plate 542 also includes an opening 558. Opening 558 is formed of any suitable size, shape, and design and is configured to connect receive node 574 of articulating link 544 therein in order to facilitate secured and pivotal connection of articulating link 544 to front plate 542. In the arrangement shown, as one example, opening 558 extends through front plate 542 from the front surface 553 to the back surface 555. In the arrangement shown, as one example, opening 558 is a generally round opening, which allows node 574 of articulating link 544 to rotate or pivot within opening 558 as needed.

Articulating link 544: In the arrangement shown, as one example, cartridge 540 included articulating link 544. Articulating link 544 is formed of any suitable size, shape, and design and is configured to connect to upper axle 330 and help facilitate movement of backrest 14 between an upright position and a reclined position. In the arrangement shown, as one example, articulating link 544 is a generally elongated member extending between a first edge 570 and a second edge 572.

In the arrangement shown, as one example, first edge 570 and second edge 572 are each generally rounded edges. In the arrangement shown, as one example, first edge 570 includes node 574. Node 574 is a generally cylindrical protrusion which extends a distance outward from both the front surface 576 of articulating link 544 and the back surface 578 of articulating link 544. In the arrangement shown, as one example, the portion of node 574 extending outward from the front surface 576 is configured to be received within opening 558 of front plate 542 and the portion of node 574 extending through the back surface 578 is configured to be received within hole 593 of back plate 548, thereby facilitating secured and pivotal connection of articulating link 544 with both front plate 542 and back plate 548.

In the arrangement shown, as one example, articulating link 544 includes a reception member 580 near second edge 572 which extends outward from the front surface 576 of articulating link 544. In the arrangement shown, as one example, reception member 580 is a generally cylindrical protrusion with a generally rectangular recess 582 therein. Reception member 580 is generally configured to extend through slot 564 of front plate 542 and receive upper axle 330 within recess 582. In the arrangement shown, as one example, when upper axle 330 is placed into recess 582, a pin 583 is placed through a small opening in the second edge 568 of articulating link 544 which helps securely hold upper axle 330 within recess 582. In this way, articulating link 544 is securely connected to upper axle 330 and configured to move along slot 564 of front plate 542 when backrest 14 is moving between an upright position and a reclined position.

In the arrangement shown, as one example, articulating link 544 also includes a slot 584. Slot 584 is a generally rectangular slot which extends through articulating link 544 and is configured to receive guide wheel 586 of articulating link 544 therein. In the arrangement shown, as one example, guide wheel 586 is configured to provide a buffer between articulating link 544 and front plate 542 and back plate 548 so that articulating link 544, front plate 542, and back plate 548 are not damaged as backrest 14 is moved between an upright position and a reclined position.

Bumper 546: In the arrangement shown, as one example, cartridge 540 includes bumper 546. Bumper 546 is formed of any suitable size, shape, and design and is configured to reduce the noise of the hard stop which occurs when backrest 14 is moving from the reclined position to the upright position. Generally, movement of backrest 14 from the upright position to the reclined position is a slow process with controlled speed, however when occupant moves backrest 14 from a reclined position to an upright position, it is much harder to control speed, resulting in a hard stop and a loud noise when backrest 14 reaches the upright position. In order to prevent this, cartridge 540 includes bumper 546, which is a formed of soft rubber and acts as a cushion to reduce the noise when the backrest 14 reaches the upright position.

Back Plate 548: In the arrangement shown, as one example, cartridge 540 includes back plate 548. Back plate 548 is formed of any suitable size, shape, and design and is configured to facilitate connection of the various components of cartridge 540. In the arrangement shown, as one example, back plate 548 is a generally planar member which has a generally flat and planar bottom edge 588, opposing sides 590, and a top edge 592. In the arrangement shown, as one example, bottom edge 588 extends between opposing sides 590. In the arrangement shown, as one example, opposing sides 590 extend upward and at an angle from bottom edge 588 and opposing sides 590 extent in approximate parallel spaced relation to one another. In the arrangement shown, as one example, top edge 592 extends between opposing sides 590 in a generally convex curved manner, however top edge 592 has a recess 595 therein.

In the arrangement shown, as one example, back plate 548 is generally smaller than front plate 542. In the arrangement shown, as one example, back plate 548 is positioned such that top edge 592 of back plate 548 is generally aligned with top edge 554 of front plate 542. However, opposing sides 590 of back plate 548 are shorter than opposing sides 552 of front plate 542. Back plate 548 is configured to be smaller than front plate 542 in order for fasteners, which can be screws, bolts, nails, or any other type of fastener, to extend through front plate 542 near the bottom portion of cartridge 540 and past back plate 548 in order to connect to pocket 530 within inner surface 528 of second legs 482. Additionally, recess 595 is present within the top edge 592 of back plate 548 in order to allow an additional fastener to be passed through front plate 542 at the top portion of cartridge 540 and past back plate 548 in order to connect to pocket 530 within inner surface 528 of second legs 482.

In the arrangement shown, as one example, back plate 548 includes hole 593 configured to receive the portion of node 574 extending outward from the back surface 578 of articulating link 544. In this way, articulating link 544 may be securely and pivotally attached to back plate 548.

In the arrangement shown, as one example, back plate 548 also includes openings 594. Openings 594 are formed of any suitable size, shape, and design and are configured to allow fasteners 596 to pass therethrough. Fasteners 596 are formed of any suitable size, shape, and design and are configured to connect back plate 548 to front plate 542. More specifically, fasteners 596 extend through openings 594 of back plate 548 and are received within reception member 556 of front plate 542.

While cartridge 540 has been described according to the arrangement shown, as one example, it will be understood by those skilled in the art that modifications may be made to cartridge 540 which do not depart from the scope of this invention.

Assembly of Cartridge 540 and Connection to Pocket 530

In the arrangement shown, as one example, cartridge 540 must be assembled and then inserted onto frame 16. In the arrangement shown, as one example, the portion of node 574 extending outward from the back surface 578 of articulating link 544 is positioned and inserted into hole 593 of back plate 548. After this, bumper 546 is operably connected to back plate 548 through any means or method of attachment, such as adhesion, screwing, nailing, or any other method. Once bumper 546 is attached to back plate 548, guide wheel 586 is then positioned within slot 584 of articulating link 544. Once this is done, front plate 542 should be positioned such that the opening 558 of front plate 542 is aligned with the portion of node 574 extending outward from the front surface 576 of articulating link 544 and this portion of node 574 may then be inserted into opening 558. Next, reception members 556 of front plate 542 should be aligned with openings 594 of back plate 548 and fasteners 596 may then be inserted through openings 594 and into reception members 556. Once fasteners 596 are inserted through back plate 548 and into reception members 556 of front plate 542, cartridge 540 is assembled.

Once cartridge 540 has been assembled, cartridge 540 is then attached to upper axle 330 extending out of backrest 14. In the arrangement shown, as one example, upper axle 330 is aligned with recess 582 of reception member 580 of articulating link 544 and upper axle 330 is then inserted into recess 582. Once upper axle 330 is in recess 582, pin 583 is inserted through second edge 572 of articulating link 544, and pin 583 engages upper axle 330 within recess 582, thereby securing upper axle 330 in recess 582.

Next, cartridge 540 is to be aligned with pocket 530 within inner surface 528 of second legs 482. Cartridge 540 is then placed into pocket 530. In this angle, front plate 542 of cartridge 540 is wholly or partially covered by backrest 14. A user can rotate backrest 14 in order to view front plate 542, and more specifically bossed holes 560 of front plate 542. When the user can view and access bossed holes 560, the user can secure cartridge 540 to pocket 530 using fasteners such as screws, bolts, nails, or any other type of fastener, which are placed through bossed holes 560 of front plate 542 and driven into second legs 482. The user will need to move backrest 14 between multiple positions in order to insert fasteners into all of the bossed holes 560. Once fasteners have been placed into all bossed holes 560, cartridge 540 is connected to pocket 530 and is ready for use.

In Operation

The operation of system 10 in the alternative arrangement presented in FIGS. 50-91 is similar to the operation of system 10 in the arrangements shown in FIGS. 1-49. However, when backrest 14 is moved between an upright position and a reclined position, upper axle 330, which is connected to articulating link 544, articulating link 544 and upper axle 330 slide along slot 564 of front plate 542 of cartridge 540. Additionally, in this configuration, the lower axle 310 extending outward from backrest 14 moves along slot 532 (not shown) within the inner surface 528 of second legs 482.

Alternative Arrangement of Cartridge 540

In the arrangement shown in FIGS. 50-91, as one example, frame 16 includes pocket 530, which is configured to receive and hold cartridge 540. Cartridge 540 is formed of any suitable size, shape, and design and is configured to facilitate movement of backrest 14 between an upright position and a reclined position. In the arrangement shown in FIGS. 70-91, as one example, cartridge 540 is a geared cartridge having a front plate 600, a gear 602, and a back plate 604. In the arrangement shown, as one example, a cartridge 540 is provided in the pocket 530 present in each of the second legs 482.

Front Plate 600: In the arrangement shown, as one example, cartridge 540 includes front plate 600. Front plate 600 is formed of any suitable size, shape, and design and is configured to allow for the movement of backrest 14 between an upright position and a reclined position while helping contain additional components of cartridge 540. In the arrangement shown, as one example, front plate 600 has a bottom edge 608, opposing sides 610, and a top edge 612. In the arrangement shown, as one example, bottom edge 608 is a generally flat and planar edge which extends between opposing sides 610. Opposing sides 610 are generally flat and planar edges which extend at an angle upward from bottom edge 608 until they reach top edge 612 and opposing sides 610 extend in approximate parallel planar spaced relation to one another. In the arrangement shown, as one example, top edge 612 extends between opposing sides 610 and has a generally convex curvature as it extends across. In the arrangement shown, as one example, front plate 600 includes a generally flat and planar front surface 614 and a back surface 616.

Front plate 600 may be formed of any material suitable for use as a plate, including various metallic materials such as stainless steel, aluminum, chromium, or any other metallic material, or various non-metallic materials such as a plastic material, a fiberglass material, or any other non-metallic material.

In the arrangement shown, as one example, front plate 600 includes bossed holes 620, a slot 622 having a first edge 624 and a second edge 626, a first protruded surface 628, a second protruded surface 630, and holes 632.

In the arrangement shown, as one example, front plate 600 includes bossed holes 620. Bossed holes 620 are formed of any suitable size, shape, and design and are configured to receive a fastener therethrough to facilitate connection of cartridge 540 to second legs 482. In the arrangement shown, as one example, bossed holes 620 extend through front plate 600 from the front surface 614 to the back surface 616.

In the arrangement shown, as one example, front plate 600 includes a slot 622. Slot 622 is formed of any suitable size, shape, and design and is configured to receive a portion of gear 602 therein and allow for the movement of gear 602 along slot 622 as the backrest 14 moves between an upright position and a reclined position. In the arrangement shown, as one example, slot 622 extends through front plate 600 from the front surface 614 to the back surface 616. In the arrangement shown, as one example, slot 622 extends a length from a first edge 624 to a second edge 626. In the arrangement shown, as one example, first edge 624 is located at the top right portion of slot 622 and second edge 626 is located at the bottom left portion of slot 622. In the arrangement shown, as one example, a portion of gear 602 is placed through slot 622 and can travel along slot 622 as the backrest 14 is moved from an upright position to a reclined position.

In the arrangement shown, as one example, slot 622 has a width slightly larger than the circumference of the portion of gear 602 extended through slot 622, which allows gear 602 to move along slot 622 with relatively little friction.

In the arrangement shown, as one example, front plate 600 includes a first protruded surface 628 and a second protruded surface 630. First protruded surface 628 and second protruded surface 630 are formed of any suitable size, shape, and design and are configured to help facilitate engagement between front plate 600 and back plate 604 while allowing gear 602 to be properly engaged and operable when positioned between front plate 600 and back plate 604. In the arrangement shown, as one example, first protruded surface 628 extends a first distance outward from the back surface 616 of front plate 600 and the second protruded surface 630 extends a second distance outward from the back surface 616 of front plate 600. In the arrangement shown, as one example, the first distance is greater than the second distance, meaning the first protruded surface 628 extends outward from back surface 616 a greater distance than the second protruded surface 630. However, in various other arrangements, as examples, the first protruded surface 628 and the second protruded surface 630 may extend outward from back surface 616 the same distance, or the second protruded surface 630 may extend outward from back surface 616 a greater distance than the first protruded surface 628.

In the arrangement shown, as one example, when the front plate 600 and back plate 604 are brought together, the first protruded surface 628 of the front plate 600 is positioned adjacent the back surface 640 of back plate 604. Likewise, when front plate 600 and back plate 604 are brought together, the second protruded surface 630 of front plate 600 is positioned adjacent the protruded surface 656 of back plate 604. In this arrangement, as one example, gear 602 is able to be positioned in between front plate 600 and back plate 604 such that the teeth 636 of gear 602 engage with the teeth 658 of the protruded surface 656 of back plate 604. That is, the first protruded surface 628 and second protruded surface 630 of front plate 600, and the protruded surface 656 of back plate 604 create a space that allows the teeth 636 of gear 602 to engage with the teeth 658 of the protruded surface 656 of back plate 604 while still allowing gear 602 to rotate and move along slot 622, rather than be held in place due to friction between gear 602 and front plate 600 and/or back plate 604.

In the arrangement shown, as one example, front plate 600 also includes holes 632. Holes 632 are formed of any suitable size, shape, and design and are configured to help facilitate connection of front plate 600 to back plate 604. In the arrangement shown, as one example, holes 632 are generally circular holes configured to receive bolts, screws, or various other fasteners configured to hold front plate 600 and back plate 604 in secured engagement. However, holes 632 may be formed of any other shape or size in order to accommodate various fasteners to hold front plate 600 and back plate 604 together.

Gear 602: In the arrangement shown in FIGS. 70-91, as one example, cartridge 540 includes gear 602. Gear 602 is formed of any suitable size, shape, and design and is configured to connect to upper axle 330 and facilitate smooth and efficient movement of backrest 14 between an upright position and a reclined position. In the arrangement shown, as one example, gear 602 is a helical gear with teeth 636 and an engagement feature 638. In the arrangement shown, as one example, a helical gear is used as gear 602 in order to facilitate smoother and quieter reclining operation, as teeth 636 of gear 602 and teeth 658 of the protruded surface 656 of back plate 604 engage and gear 602 moves along slot 622 of front plate 600. However, in various alternative arrangements, any other type or configuration of gear 602 may be used, and such other gears are hereby contemplated for use as gear 602, including spur gears, bevel gears, internal gears, or any other type of gear.

In the arrangement shown, as one example, gear 602 is generally cylindrical in shape and has teeth 636 extending outward from gear 602. Teeth 636 are formed of any suitable size, shape, and design and are configured to help facilitate movement of gear 602 when backrest 14 is moving between a reclined position and an upright position. In the arrangement shown, as one example, teeth 636 extend outward from gear 602 in a generally helical manner, however in other arrangements teeth 636 may extend outward from gear 602 in a straight manner or in any other manner. In the arrangement shown, as one example, teeth 636 are configured to engage with teeth 658 of the protruded surface 656 of back plate 604. When the backrest 14 of system 10 is being reclined or moved to an upright position, gear 602 will move in a path along slot 622 and the teeth 636 of gear 602 rotate, in the process engaging with teeth 658 of the protruded surface 656 of back plate 604, in order to facilitate smooth and quiet reclining of backrest 14.

In the arrangement shown, as one example, gear 602 includes engagement feature 638. Engagement feature 638 is formed of any suitable size, shape, and design and is configured to facilitate connection between gear 602 and reclining mechanism 20. In the arrangement shown, as one example, engagement feature 638 is a hole generally in the shape of a hexagon which is configured to receive upper axle 330 of upper guide assembly 302 of reclining mechanism 20, thereby facilitating engagement between gear 602 and reclining mechanism 20. While engagement feature 638 is shown as being a hole generally in the shape of a hexagon, it will be understood by those of skill in the art that engagement feature 638 may be a hole in any other shape, and engagement feature 638 may be formed of any other shape or design configured to engage upper axle 330. In this way, gear 602 of cartridge 540 is connected to reclining mechanism 20 and reclining mechanism 20 and cartridge 540 work together to smoothly facilitate the movement of backrest 14 between a reclined and upright position.

Back Plate 604: In the arrangement shown, as one example, cartridge 540 includes back plate 604. Back plate 604 is formed of any suitable size, shape, and design and is configured to help facilitate connection of the various components of cartridge 540. In the arrangement shown, as one example, back plate 604 is a generally planar member which has a bottom edge 642, opposing sides 644, and a top edge 646. In the arrangement shown, as one example, bottom edge 642 extends between opposing sides 644 and opposing sides 644 are generally flat and planar edges which extend at an angle upward from bottom edge 642 until they reach top edge 646, and opposing sides 644 extend at an approximate parallel planar spaced relation to one another. In the arrangement shown, as one example, top edge 646 extends between opposing sides 644 in a generally convex curved manner, however top edge 646 has a recess 648 therein. In the arrangement shown, as one example, back plate 604 also includes a generally flat and planar front surface 641 and a back surface 640.

In the arrangement shown, as one example, back plate 604 is generally smaller than front plate 600. In the arrangement shown, as one example, back plate 604 is positioned such that top edge 646 of back plate 604 is generally aligned with top edge 612 of front plate 600. However, opposing sides 644 of back plate 604 are shorter than opposing sides 610 of front plate 600. Back plate 604 is configured to be smaller than front plate 600 in order for fasteners, which can be screws, bolts, nails, or any other type of fastener, to extend through front plate 600 near the bottom portion of cartridge 540 and past back plate 604 in order to connect to pocket 530 within inner surface 528 of second legs 482. Additionally, recess 648 is present within the top edge 646 of back plate 604 in order to allow an additional fastener to be passed through front plate 600 at the top portion of cartridge 540 and past back plate 604 in order to connect to pocket 530 within inner surface 528 of second legs 482.

In the arrangement shown, as one example, back plate 604 also includes openings 650. Openings 650 are formed of any suitable size, shape, and design and are configured to allow fasteners 652 to pass therethrough. Fasteners 652 are formed of any suitable size, shape, and design and are configured to connect back plate 604 to front plate 600. More specifically, fasteners 652 extend through openings 650 of back plate 604 and are received within holes 632 of front plate 600

In the arrangement shown, as one example, the back surface 640 of back plate 604 includes a recessed surface 654 and a protruded surface 656 having teeth 658. In the arrangement shown, as one example, recessed surface 654 is formed into back surface 640 and extends in a path generally similar to the path of slot 622. In the arrangement shown, as one example, recessed surface 654 is provided to allow gear 602 to slide smoothly along back surface 640 of back plate 604 as it also moves along slot 622. That is, recessed surface 654 is provided such that when gear 602 moves along slot 622, gear 602 experiences reduced friction and resistance from back surface 640 due to recessed surface 654.

In the arrangement shown as one example, back surface 640 also included a protruded surface 656. Protruded surface 656 is formed of any suitable size, shape, and design and is configured to help facilitate engagement between front plate 600 and back plate 604 while allowing gear 602 to be properly engaged and operable when positioned between front plate 600 and back plate 604. In the arrangement shown, as one example, protruded surface 656 extends a distance outward from the back surface 640 of back plate 604. As described herein, when front plate 600 and back plate 604 are brought together, protruded surface 656 of back plate 604 is positioned adjacent second protruded surface 630 of front plate 600.

In the arrangement shown, as one example, protruded surface 656 also includes teeth 658. Teeth 658 are formed of any suitable size, shape, and design and are configured to engage with teeth 636 of gear 602. In the arrangement shown, as one example, teeth 658 extend across an edge of protruded surface 656 along a path generally parallel to the path of slot 622 in order for teeth 658 to engage teeth 636 of gear 602 while gear 602 is positioned within and moving along slot 622. In the arrangement shown, as one example, teeth 658 of protruded surface 656 also help facilitate the smooth movement of backrest 14 between the upright and reclined positions.

While cartridge 540 has been described according to the alternative arrangement shown, as one example, it will be understood by those skilled in the art that modifications may be made to cartridge 540 which do not depart from the scope of this invention.

Assembly of Alternative Cartridge 540 and Connection to Pocket 530

In the arrangement shown in FIGS. 70-91, as one example, cartridge 540 must be assembled and then inserted onto frame 16. In the arrangement shown, cartridge 540 is assembled by positioning gear 602 in alignment with slot 622 of front plate 600. In this alignment, engagement feature 638 of gear 602 is positioned such that upper axle 330 of upper guide assembly 302 of reclining mechanism 20 may be inserted into engagement feature 638.

Back plate 604 may then be aligned such that teeth 636 of gear 602 and teeth 658 of protruded surface 656 of back plate 604 are in alignment. In this position, the openings 650 of back plate 604 and the holes 632 of front plate 600 should also be in alignment, thereby allowing fasteners 652 to be inserted through openings 650 and holes 632, in order to secure front plate 600 and back plate 604 together. Once fasteners 652 are placed through openings 650 of back plate 604 and holes 632 of front plate 600, the first protruded surface 628 of front plate 600 will rest adjacent the back surface 640 of back plate 604 and the second protruded surface 630 of front plate 600 will rest adjacent the protruded surface 656 of back plate 604.

Once cartridge 540 has been assembled, cartridge 540 is then attached to upper axle 330 extending out of backrest 14. In the arrangement shown, as one example, upper axle 330 is aligned with engagement feature 638 of gear 602 and upper axle 330 is then inserted into engagement feature 638.

Next, cartridge 540 is to be aligned with pocket 530 within inner surface 528 of second legs 482. Cartridge 540 is then placed into pocket 530. In this angle, front plate 600 of cartridge 540 is wholly or partially covered by backrest 14. A user can rotate backrest 14 in order to view front plate 600, and more specifically bossed holes 620 of front plate 600. When the user can view and access bossed holes 620, the user can secure cartridge 540 to pocket 530 using fasteners such as screws, bolts, nails, or any other type of fastener, which are placed through bossed holes 620 of front plate 600 and driven into second legs 482. The user will need to move backrest 14 between multiple positions in order to insert fasteners into all of the bossed holes 620. Once fasteners have been placed into all bossed holes 620, cartridge 540 is connected to pocket 530 and is ready for use.

Operation of Alternative Cartridge 540

The operation of system 10 with alternative cartridge 540 presented in FIGS. 70-91 is similar to the operation of system 10 with cartridge 540 presented in FIGS. 50-69 and described above. However, when backrest 14 is moved between an upright position and a reclined position, gear 602 and upper axle 330, which is connected to gear 602, slide along slot 622 within the front plate 600 of cartridge 540. Additionally, in this configuration, the lower axle 310 extending outward from backrest 14 moves along slot 532 (not shown) within the inner surface 528 of second legs 482.

From the above discussion it will be appreciated that the described system improves upon the state of the art. Specifically, one or more embodiments provide an improved seating system: that has a compact reclining mechanism concealed within the chair that is configured to support an occupant in upright and reclined positions; that is strong, robust, and durable; that is comfortable; that is easy and intuitive to use; that is easy to manufacture; that is cost effective; that is high quality; that has a long useful life; and/or that is aesthetically pleasing among various other features and/or advantages.

It will be appreciated by those skilled in the art that other various modifications could be made to the device without parting from the spirit and scope of this disclosure. All such modifications and changes fall within the scope of the claims and are intended to be covered thereby.

What is claimed:

1. A reclining chair seating system comprising:
a frame;
a seat;
the seat operably connected to the frame;
a backrest;
the backrest operably connected to the frame;
the backrest having an upper axle;
a cartridge;
the cartridge having a link;
wherein the cartridge is operably connected to the frame;
wherein the link of the cartridge is configured to connect to the upper axle of the backrest;
the cartridge having a front plate;
the front plate having a slot;
wherein a portion of the link is configured to extend through the slot of the front plate;
wherein the link of the cartridge is configured to facilitate movement of the backrest between an upright position and a reclined position, and
wherein when the backrest is moved between the upright position and the reclined position, the portion of the link is configured to slide within the slot of the front plate.

2. The system of claim 1 further comprising:
a counterbalance assembly;
the counterbalance assembly positioned within a hollow interior of the backrest;
wherein the counterbalance assembly is configured to provide a counterbalance force to the backrest.

3. The system of claim 1 further comprising:
a counterbalance assembly;
the counterbalance assembly positioned within a hollow interior of the backrest;
wherein the counterbalance assembly is configured to provide a counterbalance force to the backrest;
wherein the counterbalance assembly includes the upper axle, thereby operably connecting the counterbalance assembly to the link of the cartridge.

4. The system of claim 1 wherein the cartridge includes a bumper configured to reduce sound when the backrest is moved from a reclined position to an upright position.

5. The system of claim 1 wherein the frame includes a slot and the backrest includes a lower axle; and wherein the lower axle is configured to move within the slot when the backrest is moved between the upright position and the reclined position.

6. The system of claim 1 wherein the frame includes a slot and the backrest includes a lower axle; and wherein the lower axle is configured to move within the slot when the backrest is moved between the upright position and the reclined position;
further comprising a bumper positioned in the slot;

wherein the bumper is configured to reduce sound when the backrest is moved from the reclined position to the upright position.

7. The system of claim 1 wherein the backrest is configured to cover the cartridge such that the cartridge cannot be viewed, including when the backrest is in an upright position and when the backrest is in a reclined position.

8. The system of claim 1 further comprising the frame having a pocket wherein the cartridge is positioned within the pocket.

9. A reclining chair seating system comprising:
a frame;
a seat;
the seat operably connected to the frame;
a backrest;
the backrest operably connected to the frame;
the backrest having an upper axle;
a cartridge;
the cartridge having a link;
wherein the cartridge is operably connected to the frame;
wherein the link of the cartridge is configured to connect to the upper axle of the backrest;
wherein the link of the cartridge is configured to facilitate movement of the backrest between an upright position and a reclined position;
the cartridge having a front plate;
the front plate having a slot;
the cartridge having a back plate;
wherein the link is operably connected to the front plate and the back plate;
wherein a portion of the link is configured to extend through the slot of the front plate; and
wherein when the backrest is moved between the upright position and the reclined position, the portion of the link is configured to slide within the slot of the front plate.

10. A reclining chair seating system comprising:
a frame;
the frame having a pocket;
a seat;
the seat operably connected to the frame;
a backrest;
the backrest operably connected to the frame;
the backrest having an upper axle;
a cartridge;
the cartridge having a link;
the cartridge having a front plate;
the cartridge having a back plate;
a bumper;
the bumper operably connected to the frame;
wherein the cartridge is configured to be placed within the pocket of the frame;
wherein the link of the cartridge is configured to connect to the upper axle of the backrest;
wherein the link of the cartridge is configured to be placed between the front plate and the back plate;
wherein the link of the cartridge is configured to facilitate movement of the backrest between an upright position and a reclined position;
wherein the link is configured to facilitate movement of the backrest from the reclined position to the upright position; and
wherein the bumper is configured to reduce the impact and the noise caused by movement from the reclined position to the upright position.

11. The system of claim 10, wherein the bumper is associated with the cartridge.

12. The system of claim 10 further comprising:
the front plate having a slot;
wherein the link is operably connected to the front plate and the back plate; and
wherein a portion of the link is configured to extend through the slot of the front plate; and
wherein when the backrest is moved between an upright position and a reclined position, the portion of the link is configured to slide within the slot of the front plate.

13. The system of claim 10 further comprising:
a counterbalance assembly;
the counterbalance assembly positioned within a hollow interior of the backrest;
wherein the counterbalance assembly is configured to provide a counterbalance force to the backrest.

14. The system of claim 10 further comprising:
a counterbalance assembly;
the counterbalance assembly positioned within a hollow interior of the backrest;
wherein the counterbalance assembly is configured to provide a counterbalance force to the backrest;
wherein the counterbalance assembly includes the upper axle, thereby operably connecting the counterbalance assembly to the link of the cartridge.

15. The system of claim 10 wherein the backrest is configured to cover the cartridge such that the cartridge cannot be viewed, including when the backrest is in an upright position and when the backrest is in a reclined position.

16. A reclining chair seating system comprising:
a frame;
the frame having a pocket;
a seat;
the seat operably connected to the frame;
a backrest;
the backrest operably connected to the frame;
the backrest having an upper axle;
a cartridge;
the cartridge having a link;
a bumper;
the bumper operably connected to the frame;
wherein the cartridge is configured to be placed within the pocket of the frame;
wherein the link of the cartridge is configured to connect to the upper axle of the backrest;
wherein the link of the cartridge is configured to facilitate movement of the backrest between an upright position and a reclined position;
wherein the link is configured to facilitate movement of the backrest from the reclined position to the upright position,
wherein the bumper is configured to reduce the impact and the noise caused by movement from the reclined position to the upright position; and
wherein the bumper is positioned within a slot of the frame.

17. A reclining chair seating system comprising,
a frame;
the frame having a pocket;
a seat;
the seat operably connected to the frame;
a backrest;
the backrest operably connected to the frame;
the backrest having an upper axle;
a cartridge;
the cartridge having a link;
a bumper;

the bumper operably connected to the frame;
wherein the cartridge is configured to be placed within the pocket of the frame;
wherein the link of the cartridge is configured to connect to the upper axle of the backrest;
wherein the link of the cartridge is configured to facilitate movement of the backrest between an upright position and a reclined position;
wherein the link is configured to facilitate movement of the backrest from the reclined position to the upright position;
wherein the bumper is configured to reduce the impact and the noise caused by movement from the reclined position to the upright position;
wherein the frame includes a slot and the backrest includes a lower axle; and
wherein the lower axle is configured to move within the slot when the backrest is moved between the upright position and the reclined position.

18. A reclining chair seating system comprising:
a frame;
the frame having a pocket;
a seat;
the seat operably connected to the frame;
a backrest;
the backrest operably connected to the frame;
the backrest having an upper axle;
a cartridge;
the cartridge having at least one gear;
wherein the cartridge is placed within the pocket of the frame;
wherein the at least one gear of the cartridge is configured to connect to the upper axle of the backrest;
wherein the at least one gear of the cartridge is configured to facilitate movement of the backrest between an upright position and a reclined position;
the cartridge having a front plate;
the front plate having a slot;
wherein the at least one gear is configured to move along the slot in the front plate when the backrest is moved between the upright position and the reclined position; and
wherein a portion of the upper axle is configured to move within the slot of the front plate.

19. The system of claim 18,
wherein a portion of the upper axle is configured to extend through the slot of the front plate.

20. The system of claim 18 further comprising:
a counterbalance assembly;
the counterbalance assembly positioned within a hollow interior of the backrest;
wherein the counterbalance assembly is configured to provide a counterbalance force to the backrest.

21. The system of claim 18 further comprising:
a counterbalance assembly;
the counterbalance assembly positioned within a hollow interior of the backrest;
wherein the counterbalance assembly is configured to provide a counterbalance force to the backrest;
wherein the counterbalance assembly includes the upper axle, thereby operably connecting the counterbalance assembly to the at least one gear of the cartridge.

22. The system of claim 18 wherein the cartridge includes a bumper configured to reduce sound when the backrest is moved from a reclined position to an upright position.

23. The system of claim 18 wherein the frame includes a slot and the backrest includes a lower axle; and wherein the lower axle is configured to move within the slot in the frame when the backrest is moved between the upright position and the reclined position.

24. The system of claim 18 wherein the backrest is configured to cover the cartridge such that the cartridge cannot be viewed, including when the backrest is in an upright position and when the backrest is in a reclined position.

25. The system of claim 18 further comprising:
the cartridge having a back plate;
wherein the at least one gear is operably connected to the front plate and the back plate;
wherein a portion of the at least one gear is configured to extend through the slot of the front plate; and
wherein when the backrest is moved between the upright position and the reclined position, the portion of the at least one gear is configured to slide within the slot of the front plate.

26. A reclining chair seating system comprising:
a frame;
the frame having a pocket;
a seat;
the seat operably connected to the frame;
a backrest;
the backrest operably connected to the frame;
the backrest having an upper axle;
a cartridge;
the cartridge having a link;
the cartridge having a front plate;
the cartridge having a back plate;
wherein the cartridge is positioned within the pocket of the frame;
wherein the cartridge is hidden from sight by the backrest when the backrest is in an upright position and in a reclined position;
wherein the link of the cartridge is configured to be placed between the front plate and the back plate;
wherein the link of the cartridge is configured to connect to the upper axle of the backrest; and
wherein the link of the cartridge is configured to facilitate movement of the backrest between the upright position and the reclined position.

27. The system of claim 26 further comprising:
the front plate having a slot;
wherein the link is operably connected to the front plate and the back plate;
wherein a portion of the link is configured to extend through the slot of the front plate; and
wherein when the backrest is moved between the upright position and the reclined position, the portion of the link is configured to slide within the slot of the front plate.

28. The system of claim 26 further comprising:
a counterbalance assembly;
the counterbalance assembly positioned within a hollow interior of the backrest;
wherein the counterbalance assembly is configured to provide a counterbalance force to the backrest.

29. The system of claim 26 further comprising:
a counterbalance assembly;
the counterbalance assembly positioned within a hollow interior of the backrest;
wherein the counterbalance assembly is configured to provide a counterbalance force to the backrest;
wherein the counterbalance assembly includes the upper axle, thereby operably connecting the counterbalance assembly to the link of the cartridge.

30. The system of claim 26 wherein the cartridge includes a bumper configured to reduce sound when the backrest is moved from a reclined position to an upright position.

31. The system of claim 26 wherein the frame includes a slot and the backrest includes a lower axle; and wherein the lower axle is configured to move within the slot when the backrest is moved between the upright position and the reclined position;

further comprising a bumper positioned in the slot;

wherein the bumper is configured to reduce sound when the backrest is moved from the reclined position to the upright position.

32. The system of claim 26 wherein the backrest is configured to cover the cartridge such that the cartridge cannot be viewed, including when the backrest is in the upright position and when the backrest is in the reclined position.

33. A reclining chair seating system comprising:

a frame;

the frame having a pocket;

a seat;

the seat operably connected to the frame;

a backrest;

the backrest operably connected to the frame;

the backrest having an upper axle;

a cartridge;

wherein the cartridge is positioned within the pocket of the frame;

wherein the cartridge is hidden from sight by the backrest when the backrest is in an upright position and in a reclined position;

the cartridge having a link:

wherein the link of the cartridge is configured to connect to the upper axle of the backrest;

wherein the link of the cartridge is configured to facilitate movement of the backrest between the upright position and the reclined position;

wherein the frame includes a slot and the backrest includes a lower axle; and wherein the lower axle is configured to move within the slot when the backrest is moved between the upright position and the reclined position.

34. A reclining chair seating system comprising:

a frame;

a seat;

the seat operably connected to the frame;

a backrest;

the backrest operably connected to the frame;

the backrest having a hollow interior;

the backrest having an upper axle;

a locking assembly;

the locking assembly positioned within the hollow interior of the backrest;

the locking assembly operably connected to the upper axle of the backrest;

the locking assembly having a stationary member;

the locking assembly having a movable body;

a cartridge;

wherein the cartridge is operably connected to the frame;

the cartridge having a link;

wherein the link of the cartridge is configured to connect to the upper axle of the backrest;

wherein the link of the cartridge is configured to facilitate movement of the backrest between an upright position and a reclined position;

wherein the movable body of the locking assembly is configured to selectively engage the stationary member;

wherein when the movable body is disengaged from the stationary member the backrest is movable between a fully upright position and a fully reclined position;

wherein when the movable body is engaged with the stationary member the backrest is locked in position and is unable to move between the fully upright position and the fully reclined position.

35. The system of claim 34 further comprising:

the cartridge having a front plate;

the front plate having a slot;

the cartridge having a back plate;

wherein the link is operably connected to the front plate and the back plate;

wherein a portion of the link is configured to extend through the slot of the front plate; and wherein when the backrest is moved between the upright position and the reclined position, the portion of the link is configured to slide within the slot of the front plate.

36. The system of claim 34 wherein the frame includes a slot and the backrest includes a lower axle; and wherein the lower axle is configured to move within the slot when the backrest is moved between the upright position and the reclined position.

37. The system of claim 34 wherein the frame includes a slot and the backrest includes a lower axle; and wherein the lower axle is configured to move within the slot when the backrest is moved between the upright position and the reclined position;

further comprising a bumper positioned in the slot;

wherein the bumper is configured to reduce sound when the backrest is moved from the reclined position to the upright position.

38. The system of claim 34 wherein the backrest is configured to cover the cartridge such that the cartridge cannot be viewed, including when the backrest is in the upright position and when the backrest is in the reclined position.

* * * * *